US009085814B2

(12) United States Patent
Na et al.

(10) Patent No.: US 9,085,814 B2
(45) Date of Patent: Jul. 21, 2015

(54) BULK NICKEL-BASED CHROMIUM AND PHOSPHOROUS BEARING METALLIC GLASSES

(75) Inventors: Jong Hyun Na, Pasadena, CA (US); Marios D. Demetriou, Los Angeles, CA (US); William L. Johnson, San Marino, CA (US); Glenn Garrett, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 328 days.

(21) Appl. No.: 13/592,095

(22) Filed: Aug. 22, 2012

(65) Prior Publication Data

US 2013/0048152 A1 Feb. 28, 2013

Related U.S. Application Data

(60) Provisional application No. 61/526,153, filed on Aug. 22, 2011.

(51) Int. Cl.

| | |
|---|---|
| ***C22C 19/05*** | (2006.01) |
| ***C22C 45/04*** | (2006.01) |
| ***C22C 1/00*** | (2006.01) |

(52) U.S. Cl.

CPC ..... *C22C 1/002* (2013.01); *C22C 19/058* (2013.01); *C22C 45/04* (2013.01)

(58) Field of Classification Search

None

See application file for complete search history.

(56) References Cited

U.S. PATENT DOCUMENTS

| | | | | |
|---|---|---|---|---|
| 4,126,284 | A | 11/1978 | Ichikawa et al. | |
| 4,144,058 | A | 3/1979 | Chen et al. | |
| 4,385,932 | A | 5/1983 | Inomata et al. | |
| 4,892,628 | A | 1/1990 | Guilinger | |
| 4,968,363 | A | 11/1990 | Hashimoto et al. | |
| 5,429,725 | A | 7/1995 | Thorpe et al. | |
| 5,634,989 | A | 6/1997 | Hashimoto et al. | |
| 6,325,868 | B1 * | 12/2001 | Kim et al. | 148/403 |
| 2009/0110955 | A1 | 4/2009 | Hartmann et al. | |
| 2012/0073710 | A1 | 3/2012 | Kim et al. | |
| 2013/0048152 | A1 | 2/2013 | Na et al. | |
| 2014/0238551 | A1 | 8/2014 | Na et al. | |

FOREIGN PATENT DOCUMENTS

| | | |
|---|---|---|
| DE | 102011001783 | 10/2012 |
| DE | 102011001784 A1 | 10/2012 |
| EP | 0014335 | 8/1980 |
| EP | 0260706 | 3/1988 |
| EP | 1108796 | 6/2001 |
| JP | 54-76423 | 6/1979 |
| JP | S57-13146 | 1/1982 |
| JP | 63-079930 | 4/1988 |

(Continued)

OTHER PUBLICATIONS

International Search Report and Written Opinion dated Apr. 16, 2013, PCT/US2012/051921, 14 pages.

(Continued)

*Primary Examiner* — George Wyszomierski

(74) *Attorney, Agent, or Firm* — Polsinelli PC

(57) ABSTRACT

Ni-based Cr- and P-bearing alloys that can from centimeter-thick amorphous articles are provided. Within the family of alloys, millimeter-thick bulk-glassy articles can undergo macroscopic plastic bending under load without fracturing catastrophically.

44 Claims, 59 Drawing Sheets

(56) References Cited

FOREIGN PATENT DOCUMENTS

| | | |
|---|---|---|
| JP | 63079931 | 4/1988 |
| JP | 63-277734 | 11/1988 |
| JP | 1-205062 | 8/1989 |
| JP | 08-269647 | 10/1996 |
| JP | 2001-049407 | 2/2001 |
| WO | WO 2012/053570 | 4/2012 |
| WO | WO 2013/028790 | 2/2013 |

OTHER PUBLICATIONS

Habazaki et al., "Corrosion behaviour of amorphous Ni—Cr—Nb—P—B bulk alloys in 6M HCI solution," *Material Science and Engineering*, A318, 2001, pp. 77-86.
Murakami (Editor), *Stress Intensity Factors Handbook*, vol. 2, Oxford: Pergamon Press, 1987, 4 pages.
Yokoyama et al., "Viscous Flow Workability of Ni-Cr-P-B Metallic Glasses Produced by Melt-Spinning in Air," *Materials Transactions*, vol. 48, No. 12, 2007, pp. 3176-3180.
Park T.G. et al., "Development of new Ni-based amorphous alloys containing no metalloid that have large undercooled liquid regions," *Scripta Materialia*, vol. 43, No. 2, 2000, pp. 109-114.
Mitsuhashi A. et al., "The corrosion behavior of amorphous nickel base alloys in a hot concentrated phosphoric acid," *Corrosion Science*, vol. 27, No. 9, 1987, pp. 957-970.
Kawashima A. et al., "Change in corrosion behavior of amorphous Ni—P alloys by alloying with chromium, molybdenum or tungsten," *Journal of Non-Crystalline Solids*, vol. 70, No. 1, 1985, pp. 69-83.
Abrosimova G. E. et al., "Phase segregation and crystallization in the amorphous alloy $Ni_{70}Mo_{10}P_{20}$," *Physics of the Solid State*, vol. 40., No. 9, 1998, pp. 1429-1432.
Yokoyama M. et al., "Hot-press workability of Ni-based glassy alloys in supercooled liquid state and production of the glassy alloy separators for proton exchange membrane fuel cell," *Journal of the Japan Society of Powder and Powder Metallurgy*, vol. 54, No. 11, 2007, pp. 773-777.
Rabinkin et al., "Brazing Stainless Steel Using New MBF-Series of Ni—Cr—B—Si Amorphous Brazing Foils: New Brazing Alloys Withstand High-Temperature and Corrosive Environments," *Welding Research Supplement*, 1998, pp. 66-75.
Chen S.J. et al., "Transient liquid-phase bonding of T91 steel pipes using amorphous foil," *Materials Science and Engineering A*, vol. 499, No. 1-2, 2009, pp. 114-117.
Hartmann, Thomas et al., "New Amorphous Brazing Foils for Exhaust Gas Application," *Proceedings of the 4th International Brazing and Soldering Conference*, Apr. 26-29, 2009, Orlando, Florida, USA.
U.S. Appl. No. 14/029,719, filed Sep. 17, 2013, Na et al.
U.S. Appl. No. 14/048,894, filed Oct. 8, 2013, Na et al.
U.S. Appl. No. 14/067,521, filed Oct. 30, 2013, Na et al.
U.S. Appl. No. 14/077,830, filed Nov. 12, 2013, Na et al.
U.S. Appl. No. 14/081,622, filed Nov. 15, 2013, Na et al.
U.S. Appl. No. 14/149,035, filed Jan. 7, 2014, Na et al.
U.S. Appl. No. 14/458,091, filed Aug. 12, 2014, Na et al.
U.S. Appl. No. 14/501,779, filed Sep. 30, 2014, Na et al.
U.S. Appl. No. 14/540,815, filed Nov. 30, 2014, Na et al.
U.S. Appl. No. 14/565,219, filed Dec. 9, 2014, Na et al.
U.S. Appl. No. 14/581,950, filed Dec. 23, 2014, Na et al.
Habazaki et al., "Preparation of corrosion-resistant amorphous Ni—Cr—P—B bulk alloys containing molybdenum and tantalum," Material Science and Engineering, A304-306, 2001, pp. 696-700.
Zhang et al., "The Corrosion Behavior of Amorphous Ni—Cr—P Alloys in Concentrated Hydrofluoric Acid," Corrosion Science, vol. 33, No. 10, pp. 1519-1528, 1992.
Katagiri et al., "An attempt at preparation of corrosion-resistant bulk amorphous Ni—Cr—Ta—Mo—P—B alloys," Corrsion Science, vol. 43, No. 1, pp. 183-191, 2001.

* cited by examiner

BULK NICKEL-BASED CHROMIUM AND PHOSPHOROUS BEARING METALLIC GLASSES

CROSS-REFERENCE TO RELATED APPLICATION

The present application claims priority to U.S. Provisional Application No. 61/526,153, filed Aug. 22, 2011, the disclosure of which is incorporated herein by reference in its entirety.

FIELD

The present disclosure is directed to Ni-based Cr- and P-bearing metallic glasses containing small alloying additions of Nb and B, and optionally Si, capable of forming bulk glassy rods with diameters as large as 10 mm or more. The inventive bulk metallic glasses also exhibit very high strength and high toughness, and are capable of undergoing extensive macroscopic plastic bending under load without fracturing catastrophically. The inventive bulk glasses also exhibit exceptional corrosion resistance.

BACKGROUND

Amorphous Ni-based Cr- and P-bearing alloys have long been recognized as having enormous commercial potential because of their high corrosion resistance. (Guillinger, U.S. Pat. No. 4,892,628, 1990, the disclosure of which is incorporated herein by reference.) However, the viability of these materials has been limited because conventional Ni-based Cr- and P-bearing systems are typically only capable of forming foil-shaped amorphous articles, having thicknesses on the order of several micrometers (typically below 100 micrometers).

The thickness limitation in conventional Ni-based Cr- and P-bearing alloys is attributed to compositions that require rapid solidification (cooling rates typically on the order of hundreds of thousands of degrees per second) to form an amorphous phase. For example, Japanese Patent JP63-79931 (the disclosure of which is incorporated herein by reference) is broadly directed to Ni—Cr—Nb—P—B—Si corrosion-resistant amorphous alloys. However, the reference only discloses the formation of foils processed by rapid solidification, and does not describe how one would arrive at specific compositions requiring low cooling rates to form glass such that they are capable of forming bulk centimeter-thick glasses, nor does it propose that the formation of such bulk glasses is even possible. Likewise, United States Patent Application US2009/0110955A1 (the disclosure of which is incorporated herein by reference) is also directed broadly to amorphous Ni—Cr—Nb—P—B—Si alloys, but teaches the formation of these alloys into brazing foils processed by rapid solidification. Finally, Japanese Patent JP2001-049407A (the disclosure of which is incorporated herein by reference) does describe the formation of Ni—Cr—Nb—P—B bulk amorphous articles, but falsely advises the addition of Mo to achieve bulk-glass formation. Only two exemplary alloys capable of forming bulk amorphous articles are presented in this prior art, both containing Mo, and the bulk amorphous articles formed by the exemplary alloys are rods with diameters of at most 1 mm. Another two exemplary Ni—Cr—Nb—P—B alloys capable of forming glassy rods 1-mm in diameter are also presented in an article by Hashimoto and coworkers (H. Habazaki, H. Ukai, K. izumiya, K. Hashimoto, Materials Science and Engineering A318, 77-86 (2001), the disclosure of which is incorporated herein by reference).

The engineering applicability of these two-dimensional foil-shaped articles is very limited; applications are typically limited to coating and brazing. The engineering applicability of 1-mm rods is also restricted to very thin engineering components having sub-millimeter thickness. For broad engineering applicability, "bulk" three-dimensional articles with dimensions on the order of several millimeters are typically sought. Specifically, slab-shaped articles 1 mm in thickness, or equivalently (from a cooling rate consideration) rod-shaped articles 3 mm in diameter, are generally regarded as the lower limits in size for broad engineering applicability. Another requirement for broad engineering applicability is the ability of millimeter-thick articles to undergo macroscopic plastic bending under load without fracturing catastrophically. This requires that the bulk metallic glasses have relatively high fracture toughness. Accordingly, a need exists for Ni-rich Cr- and P-bearing alloys capable of forming bulk glasses.

BRIEF SUMMARY

The current disclosure is directed generally to the ternary base system $Ni_{80.5-x}Cr_xP_{19.5}$, where x ranges between 3 and 15. In certain aspects, Cr and P are replaced by small but well-defined amounts of certain alloying elements.

In one embodiment, the disclosure is directed to a metallic glass including an alloy represented by the following formula (subscripts denote atomic percent):

$$Ni_{(69-w-x-y-z)}Cr_{8.5+w}Nb_{3+x}P_{16.5+y}B_{3+z}$$

where w, x, y, and z can be positive or negative, and where, $$0.0494w^2+1.78x^2+4y^2+z^2<1$$

and wherein the largest rod diameter that can be formed with an amorphous phase is at least 5 mm.

In another such embodiment, the invention is directed to a metallic glass including an alloy represented by the following formula (subscripts denote atomic percent):

$$Ni_{(69-w-x-y-z)}Cr_{8.5+w}Nb_{3+x}P_{16.5+y}B_{3+z}$$

where w, x, y, and z can be positive or negative, and where, $$0.033w^2+0.44x^2+2y^2+0.32z^2<1.$$

and wherein the largest rod diameter that can be formed with an amorphous phase is at least 3 mm.

In a preferred embodiment, the disclosure is directed to a metallic glass including an alloy represented by the following formula (subscripts denote atomic percent):

$$Ni_{(68.6-w-x-y-z)}Cr_{8.7+w}Nb_{3.0+x}P_{16.5+y}B_{3.2+z}$$

Here, an refined alloy composition is obtained when the variables w, x, y, and z are all identically 0. The values of w, x, y, and z (expressed in atomic percentages) can be positive or negative and represent the allowed deviation from the refined composition given by:

$$Ni_{68.6}Cr_{8.7}Nb_{3.0}P_{16.5}B_{3.2}$$

and where these deviations (w, x, y, and z) satisfy the condition, $$0.21|w|+0.84|x|+0.96|y|+1.18|z|<1.89$$

with |w|, |x|, etc. being the absolute value of the composition deviations, and wherein the largest rod diameter that can be formed with an amorphous phase is at least 3 mm.

In still yet another such embodiment, the disclosure is directed to a metallic glass including an alloy represented by the following formula (subscripts denote atomic percent):

$$Ni_{(68.6-w-x-y-z)}Cr_{8.7+w}Nb_{3.0+x}P_{16.5+y}B_{3.2+z}$$

where w, x, y, and z can be positive or negative, and where, $$0.21|w|+0.84|x|+0.96|y|+1.18|z|<1.05$$

and wherein the largest rod diameter that can be formed with an amorphous phase is at least 5 mm.

In still yet another such embodiment, the disclosure is directed to a metallic glass including an alloy represented by the following formula (subscripts denote atomic percent):

$$Ni_{(68.6-w-x-y-z)}Cr_{8.7+w}Nb_{3.0+x}P_{16.5+y}B_{3.2+z}$$

where w, x, y, and z can be positive or negative, and where, $$0.21|w|+0.84|x|+0.96|y|+1.18|z|<0.43$$

and wherein the largest rod diameter that can be formed with an amorphous phase is at least 8 mm. In another embodiment, the disclosure is directed to a metallic glass including an alloy represented by the following formula (subscripts denote atomic percent):

$$Ni_{(100-a-b-c-d)}Cr_aNb_bP_cB_d$$

where, a is greater than 3 and less than 15, b is greater than 1.5 and less than 4.5, c is greater than 14.5 and less than 18.5, and d is greater than 1 and less than 5;

and wherein the largest rod diameter that can be formed with an amorphous phase is at least 3 mm.

In another such embodiment, a is greater than 7 and less than 10, and the largest rod diameter that can be formed with an amorphous phase is at least 8 mm.

In another such embodiment, a is greater than 7 and less than 10, and the largest rod diameter that can be formed with an amorphous phase is at least 8 mm.

In still another such embodiment, a is between 3 and 7, and the stress intensity at crack initiation $K_Q$, when measured on a 3 mm diameter rod containing a notch with length between 1 and 2 mm and root radius between 0.1 and 0.15 mm, is at least 60 MPa $m^{1/2}$.

In yet another such embodiment, a is between 3 and 7, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm is at least 60 MPa $m^{1/2}$, and where $\sigma_y$ is the compressive yield strength obtained using the 0.2% proof stress criterion, is greater than 0.2 mm.

In still yet another such embodiment, a is between 3 and 7, and a wire made of such glass having a diameter of 1 mm can undergo macroscopic plastic bending under load without fracturing catastrophically.

In still yet another such embodiment, b is between 2.5 and 4.

In still yet another such embodiment, d is greater than 2 and less than 4, and the maximum rod diameter that can be formed with an amorphous phase is at least 5 mm.

In still yet another such embodiment, c+d is between 19 and 20.

In another preferred embodiment, the disclosure is directed to a metallic glass including an alloy represented by the following formula (subscripts denote atomic percent):

$$Ni_{(100-a-b-c-d)}Cr_aNb_bP_cB_d$$

where, a is greater than 2.5 and less than 15, b is greater than 1.5 and less than 4.5, c is greater than 14.5 and less than 18.5, and d is greater than 1.5 and less than 4.5; and wherein the largest rod diameter that can be formed with an amorphous phase is at least 4 mm.

In another such embodiment, a is greater than 6 and less than 10.5, b is greater than 2.6 and less than 3.2, c is greater than 16 and less than 17, d is greater than 2.7 and less than 3.7, and the largest rod diameter that can be formed with an amorphous phase is at least 8 mm.

In still another such embodiment, a is between 3 and 7, and the stress intensity at crack initiation $K_Q$, when measured on a 3 mm diameter rod containing a notch with length between 1 and 2 mm and root radius between 0.1 and 0.15 mm, is at least 60 MPa $m^{1/2}$.

In still another such embodiment, b is between 1.5 and 3, and the stress intensity at crack initiation $K_Q$, when measured on a 3 mm diameter rod containing a notch with length between 1 and 2 mm and root radius between 0.1 and 0.15 mm, is at least 60 MPa $m^{1/2}$.

In yet another such embodiment, a is between 3 and 7, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

In yet another such embodiment, b is between 1.5 and 3, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

In still yet another such embodiment, a is between 3 and 7, and a wire made of such glass having a diameter of 1 mm can undergo macroscopic plastic bending under load without fracturing catastrophically.

In still yet another such embodiment, b is between 1.5 and 3, and a wire made of such glass having a diameter of 1 mm can undergo macroscopic plastic bending under load without fracturing catastrophically.

In still yet another such embodiment, b is between 2.5 and 3.5, and the maximum rod diameter that can be formed with an amorphous phase is at least 5 mm.

In still yet another such embodiment, d is greater than 2 and less than 4, and the maximum rod diameter that can be formed with an amorphous phase is at least 5 mm.

In still yet another such embodiment, c+d is between 18.5 and 20.5, and the maximum rod diameter that can be formed with an amorphous phase is at least 5 mm.

In one embodiment, the disclosure is directed to an alloy represented by the following formula (subscripts denote atomic percent):

$$Ni_{(100-a-b-c-d-e)}Cr_aNb_bP_cB_dSi_e$$

where, a is between 5 and 12, b is between 1.5 and 4.5, c is between 12.5 and 17.5, d is between 1 and 5, and e is up to 2;

and wherein the largest rod diameter that can be formed with an amorphous phase is at least 3 mm.

In one such embodiment, a is greater than 7 and less than 10, and the stress intensity at crack initiation when measured on a 3 mm diameter rod containing a notch with length between 1 and 2 mm and root radius between 0.1 and 0.15 mm is at least 60 MPa $m^{1/2}$.

In another such embodiment, a is greater than 7 and less than 10, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

In still another such embodiment, a is greater than 7 and less than 10, and a wire made of such glass having a diameter of 1 mm can undergo macroscopic plastic bending under load without fracturing catastrophically.

In yet another such embodiment, b is between 2.5 and 4.

In still yet another such embodiment, d is between 2 and 4.

In still yet another such embodiment, e is up to 1.

In still yet another such embodiment, c+d+e is between 19 and 20.

In another preferred embodiment, the disclosure is directed to an alloy represented by the following formula (subscripts denote atomic percent):

$$Ni_{(100-a-b-c-d-e)}Cr_aNb_bP_cB_dSi_e$$

where, a is between 4 and 14, b is between 1.8 and 4.3, c is between 13.5 and 17.5, d is between 2.3 and 3.9, and e is up to 2; and wherein the largest rod diameter that can be formed with an amorphous phase is at least 3 mm.

In one such embodiment, a is greater than 7 and less than 10, and the stress intensity at crack initiation when measured on a 3 mm diameter rod containing a notch with length between 1 and 2 mm and root radius between 0.1 and 0.15 mm is at least 60 MPa $m^{1/2}$.

In one such embodiment, b is greater than 1.5 and less than 3, and the stress intensity at crack initiation when measured on a 3 mm diameter rod containing a notch with length between 1 and 2 mm and root radius between 0.1 and 0.15 mm is at least 60 MPa $m^{1/2}$.

In another such embodiment, a is greater than 7 and less than 10, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

In another such embodiment, b is greater than 1.5 and less than 3, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

In still another such embodiment, a is greater than 7 and less than 10, and a wire made of such glass having a diameter of 1 mm can undergo macroscopic plastic bending under load without fracturing catastrophically.

In still another such embodiment, b is greater than 1.5 and less than 3, and a wire made of such glass having a diameter of 1 mm can undergo macroscopic plastic bending under load without fracturing catastrophically.

In yet another such embodiment, b is between 2.5 and 3.5, and the maximum rod diameter that can be formed with an amorphous phase is at least 4 mm In still yet another such embodiment, d is between 2.9 and 3.5, and the maximum rod diameter that can be formed with an amorphous phase is at least 4 mm.

In still yet another such embodiment, e is up to 1.5, and the maximum rod diameter that can be formed with an amorphous phase is at least 4 mm.

In still yet another such embodiment, c+d+e is between 18.5 and 20.5, and the maximum rod diameter that can be formed with an amorphous phase is at least 4 mm.

In still yet another such embodiment, up to 1.5 atomic % of Nb is substituted by Ta, V, or combinations thereof.

In still yet another such embodiment, up to 2 atomic % of Cr is substituted by Fe, Co, Mn, W, Mo, Ru, Re, Cu, Pd, Pt, Ti, Zr, Hf, or combinations thereof.

In still yet another such embodiment, up to 2 atomic % of Ni is substituted by Fe, Co, Mn, W, Mo, Ru, Re, Cu, Pd, Pt, Ti, Zr, Hf, or combinations thereof.

In still yet another such embodiment, a rod having a diameter of at least 0.5 mm can undergo macroscopic plastic bending under load without fracturing catastrophically.

In still yet another such embodiment, the compressive yield strength, $\sigma_y$, obtained using the 0.2% proof stress criterion is greater than 2000 MPa.

In still yet another such embodiment, the temperature of the molten alloy is raised to 1100° C. or higher prior to quenching below the glass transition to form a glass.

In still yet another such embodiment, the Poisson's ratio is at least 0.35.

In still yet another such embodiment, the corrosion rate in 6M HCl is not more than 0.01 mm/year.

In one embodiment, the invention is directed to an alloy selected from the group consisting of: $Ni_{69}Cr_{8.5}Nb_3P_{17}B_{2.5}$, $Ni_{69}Cr_{8.5}Nb_3P_{16.75}B_{2.75}$, $Ni_{69}Cr_{8.5}Nb_3P_{16.5}B_3$, $Ni_{69}Cr_{8.5}Nb_3P_{16}B_{3.5}$, $Ni_{69}Cr_{8.5}Nb_3P_{15.75}B_{3.75}$, $Ni_{69}Cr_8Nb_{3.5}P_{16.5}B_3$, $Ni_{69}Cr_{7.5}Nb_4P_{16.5}B_3$, $Ni_{72.5}Cr_5Nb_3P_{16.5}B_3$, $Ni_{71.5}Cr_6Nb_3P_{16.5}B_3$, $Ni_{70.5}Cr_7Nb_3P_{16.5}B_3$, $Ni_{69.5}Cr_8Nb_3P_{16.5}B_3$, $Ni_{68.5}Cr_9Nb_3P_{16.5}B_3$, $Ni_{68}Cr_{9.5}Nb_3P_{16.5}B_3$, $Ni_{67.5}Cr_{10}Nb_3P_{16.5}B_3$, $Ni_{66.5}Cr_{11}Nb_3P_{16.5}B_3$, $Ni_{65.5}Cr_{12}Nb_3P_{16.5}B_3$, $Ni_{68.5}Cr_9Nb_3P_{16}B_3Si_{0.5}$, $Ni_{68.5}Cr_9Nb_3P_{15.5}B_3Si_1$, $Ni_{69}Cr_{8.5}Nb_3P_{16}B_3Si_{0.5}$, $Ni_{69}Cr_{8.5}Nb_3P_{15.5}B_3Si_1$, $Ni_{69}Cr_{8.5}Nb_{2.5}Ta_{0.5}P_{15.5}B_3Si_1$, and $Ni_{69.5}Cr_{8.5}Nb_{2.5}Ta_{0.5}P_{15.5}B_3Si_1$.

In another embodiment, the invention is directed to an alloy selected from the group consisting of: $Ni_{72.5}Cr_5Nb_3P_{16.5}B_3$, $Ni_{71.5}Cr_6Nb_3P_{16.5}B_3$, $Ni_{70.5}Cr_7Nb_3P_{16.5}B_3$, $Ni_{69.5}Cr_8Nb_3P_{16.5}B_3$, $Ni_{68.5}Cr_9Nb_3P_{16.5}B_3$, $Ni_{68}Cr_{9.5}Nb_3P_{16.5}B_3$, $Ni_{67.5}Cr_{10}Nb_3P_{16.5}B_3$, $Ni_{66.5}Cr_{11}Nb_3P_{16.5}B_3$, $Ni_{65.5}Cr_{12}Nb_3P_{16.5}B_3$, $Ni_{68.5}Cr_9Nb_3P_{16}B_3Si_{0.5}$, $Ni_{68.5}Cr_9Nb_3P_{15.5}B_3Si_1$, $Ni_{69}Cr_{8.5}Nb_3P_{16}B_3Si_{0.5}$, and $Ni_{69}Cr_{8.5}Nb_3P_{15.5}B_3Si_1$.

In a preferred embodiment, the disclosure is directed to an alloy selected from the group consisting of: $Ni_{69}Cr_{8.5}Nb_3P_{17}B_{2.5}$, $Ni_{69}Cr_{8.5}Nb_3P_{16.75}B_{2.75}$, $Ni_{69}Cr_{8.5}Nb_3P_{16.5}B_3$, $Ni_{69}Cr_{8.5}Nb_3P_{16}B_{3.5}$, $Ni_{69}Cr_{8.5}Nb_3P_{15.75}B_{3.75}$, $Ni_{69}Cr_9Nb_{2.5}P_{16.5}B_3$, $Ni_{69}Cr_{8.75}Nb_{2.75}P_{16.5}B_3$, $Ni_{69}Cr_{8.25}Nb_{3.25}P_{16.5}B_3$, $Ni_{69}Cr_8Nb_{3.5}P_{16.5}B_3$, $Ni_{69}Cr_{7.5}Nb_4P_{16.5}B_3$, $Ni_{72.5}Cr_5Nb_3P_{16.5}B_3$, $Ni_{71.5}Cr_6Nb_3P_{16.5}B_3$, $Ni_{70.5}Cr_7Nb_3P_{16.5}B_3$, $Ni_{69.5}Cr_8Nb_3P_{16.5}B_3$, $Ni_{68.5}Cr_9Nb_3P_{16.5}B_3$, $Ni_{68}Cr_{9.5}Nb_3P_{16.5}B_3$, $Ni_{67.5}Cr_{10}Nb_3P_{16.5}B_3$, $Ni_{66.5}Cr_{11}Nb_3P_{16.5}B_3$, $Ni_{65.5}Cr_{12}Nb_3P_{16.5}B_3$, $Ni_{68.5}Cr_9Nb_3P_{16}B_3Si_{0.5}$, $Ni_{68.5}Cr_9Nb_3P_{15.5}B_3Si_1$, $Ni_{69}Cr_{8.5}Nb_3P_{16}B_3Si_{0.5}$, $Ni_{69.45}Cr_{8.81}Nb_{3.04}P_{15.66}B_{3.04}$, $Ni_{69.03}Cr_{8.75}Nb_{3.02}P_{16.08}B_{3.12}$, $Ni_{68.17}Cr_{8.65}Nb_{2.98}P_{16.92}B_{3.28}$, $Ni_{67.75}Cr_{8.59}Nb_{2.96}P_{17.34}B_{3.36}$, $Ni_{69}Cr_{8.5}Nb_3P_{15.5}B_3Si_1$, $Ni_{69}Cr_{8.5}Nb_{2.5}Ta_{0.5}P_{15.5}B_3Si_1$, and $Ni_{69.5}Cr_{8.7}Nb_{2.5}Ta_{0.5}P_{15.5}B_3Si_1$.

In another such embodiment, the disclosure is directed to one of the following alloys: $Ni_{68.6}Cr_{8.7}Nb_3P_{16.5}B_{3.2}$ or $Ni_{68.6}Cr_{8.7}Nb_3P_{16}B_{3.2}Si_{0.5}$.

BRIEF DESCRIPTION OF THE DRAWINGS

Various examples of the present disclosure will be discussed with reference to the appended figures and data results, wherein.

DETAILED DISCLOSURE

Figure 1:
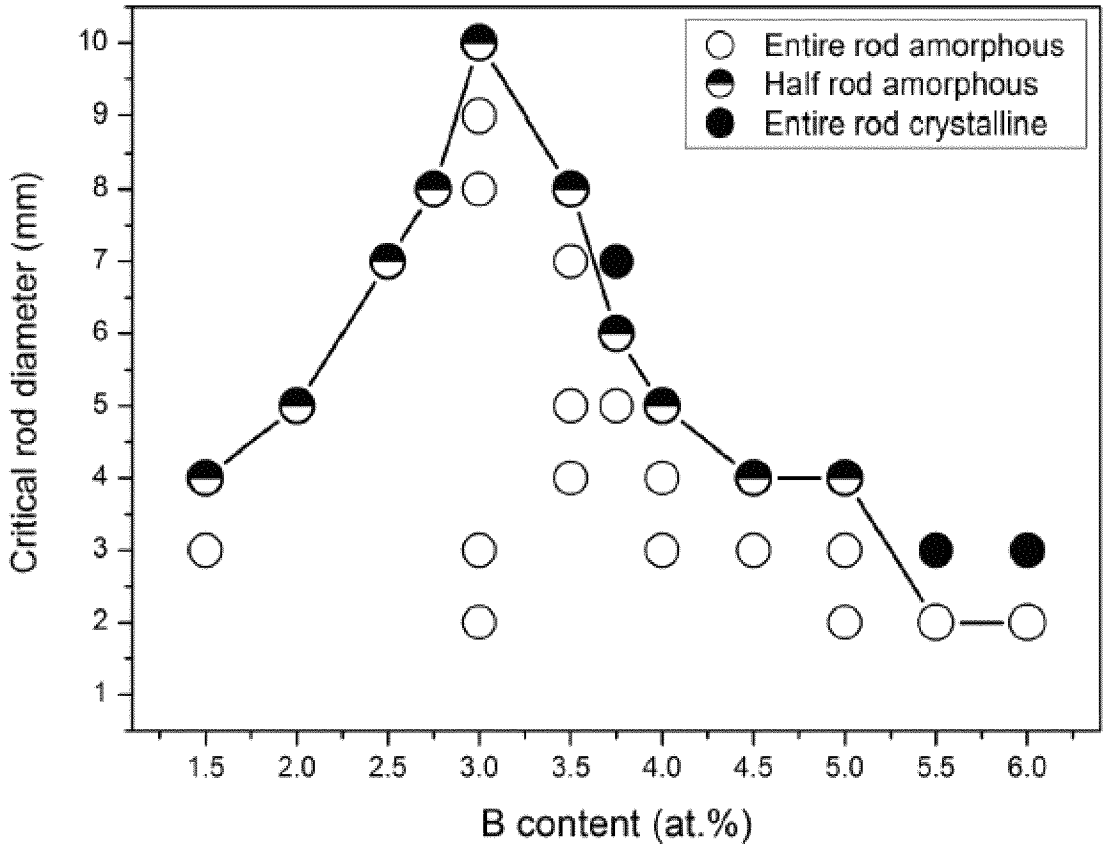
FIG. 1 provides a data plot showing the effect of increasing B atomic concentration at the expense of P on the glass forming ability of exemplary amorphous alloys $Ni_{69}Cr_{8.5}Nb_3P_{19.5-x}B_x$ for $1.5 \le x < 4$ and $Ni_{68.5}Cr_{8.5}Nb_3P_{20-x}B_x$ for $4 \le x \le 6$ (Compositions are listed in Table 1).

Amorphous Ni-rich alloys bearing Cr and P were recognized as highly corrosion resistant materials more than twenty years ago (Guillinger, U.S. Pat. No. 4,892,628, 1990, cited above). However, conventional ternary Ni—Cr—P alloys were able to form an amorphous phase only in very thin sections (<100 μm) by processes involving either atom by atom deposition, like for example electro-deposition, or rapid quenching at extremely high cooling rates, like for example melt spinning or splat quenching. In the present disclosure, a Ni-rich Cr- and P-bearing alloy system having a well-defined compositional range has been identified that requires very low cooling rates to form glass thereby allowing for bulk-glass formation to thicknesses greater than 10 mm. In particular, it has been discovered that by minutely controlling the relative concentrations of Ni, Cr and P, and by incorporating minority additions of Nb and B as substitutions for Cr and P respectively, the amorphous phase of these alloys can be formed in sections thicker than 3 mm, and as thick as 1 cm or more. What is more, the mechanical and chemical properties of these alloys, including toughness, elasticity, corrosion resistance, etc. now become accessible and measurable, and therefore an engineering database for these alloys can be generated.

Accordingly, in some embodiments the metallic glass of the present disclosure comprises the following:

at least Ni, Cr, P, Nb, and B;

where Cr can vary in the range of 3 to 15 atomic percent, where Nb can vary in the range of 1.5 to 4.5 atomic percent, where P can vary in the range of 14.5 to 18.5 atomic percent, and where B can vary in the range of 1 to 5 atomic percent.

In various embodiments, the metallic glass is capable of forming an amorphous phase in sections at least 3 mm thick, and up to 10 mm or greater. In various alternative embodiments, the atomic percent of B in the alloys of the present disclosure is between about 2 and 4. In further embodiments, the combined fraction of P and B is between about 19 and 20 atomic percent. The atomic percent of Cr can be between 5 and 10 and of Nb between 2.5 and 4.

In some preferred embodiments, the metallic glass of the instant disclosure comprises the following:

- at least Ni, Cr, P, Nb, B and optionally Si;
- where Cr can vary in the range of 2.5 to 15 atomic percent,
- where P can vary in the range of 14.5 to 18.5 atomic percent,
- where Nb can vary in the range of 1.5 to 5 atomic percent,
- where B can vary in the range of 1 to 5 atomic percent, and
- where the combined fraction of P and B and optionally Si can vary in the range of 18 to 21.5, and
- where Si is optionally added up to 2 atomic percent as replacement for P.

A detailed examination of the importance of the above ranges is developed in the following sections of text.

Glass Forming Ability (GFA) Characterization

As described above, the alloys of the instant disclosure are directed to five component or more Ni-based metallic glass forming alloys comprising some combination of at least Ni, Cr, Nb, P, and B. The 5-component system can be conveniently described by the formula:

$$Ni_{1-w-x-y-z}Cr_wNb_xP_yB_z$$

where the variables w, x, y, z are the concentrations of the respective elements in atomic percent. In conventional practice, alloys of this family are thought to have relatively poor glass-forming ability with a critical casting thickness of 1 mm or less. (See, e.g., JP 63-79931, JP-2001-049407A and US Pat. Pub. 2009/0110955A1, cited above.) However, it has now been discovered that by precisely refining the compositional variables within a fairly narrow range, an alloy of exceptional glass forming ability may be obtained. Such exceptional glass forming ability was neither taught nor anticipated in any of the prior art.

Figure 2:
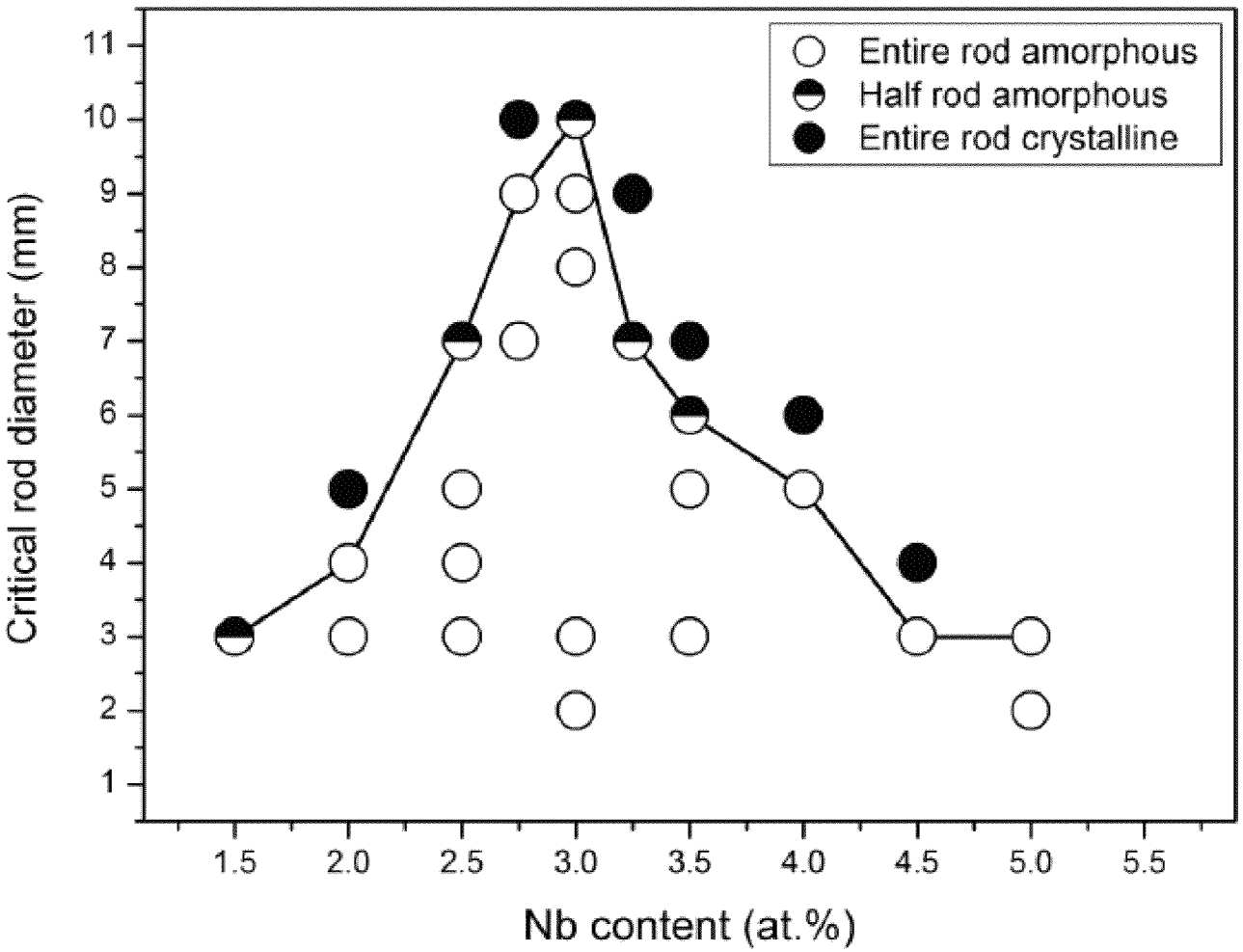
FIG. 2 provides a data plot showing the effect of increasing Nb atomic concentration at the expense of Cr on the glass forming ability of exemplary amorphous alloys $Ni_{69}Cr_{11.5-x}Nb_xP_{16.5}B_3$ for $1.5 \le x \le 5$ (Compositions are listed in Table 2).
Figure 3:
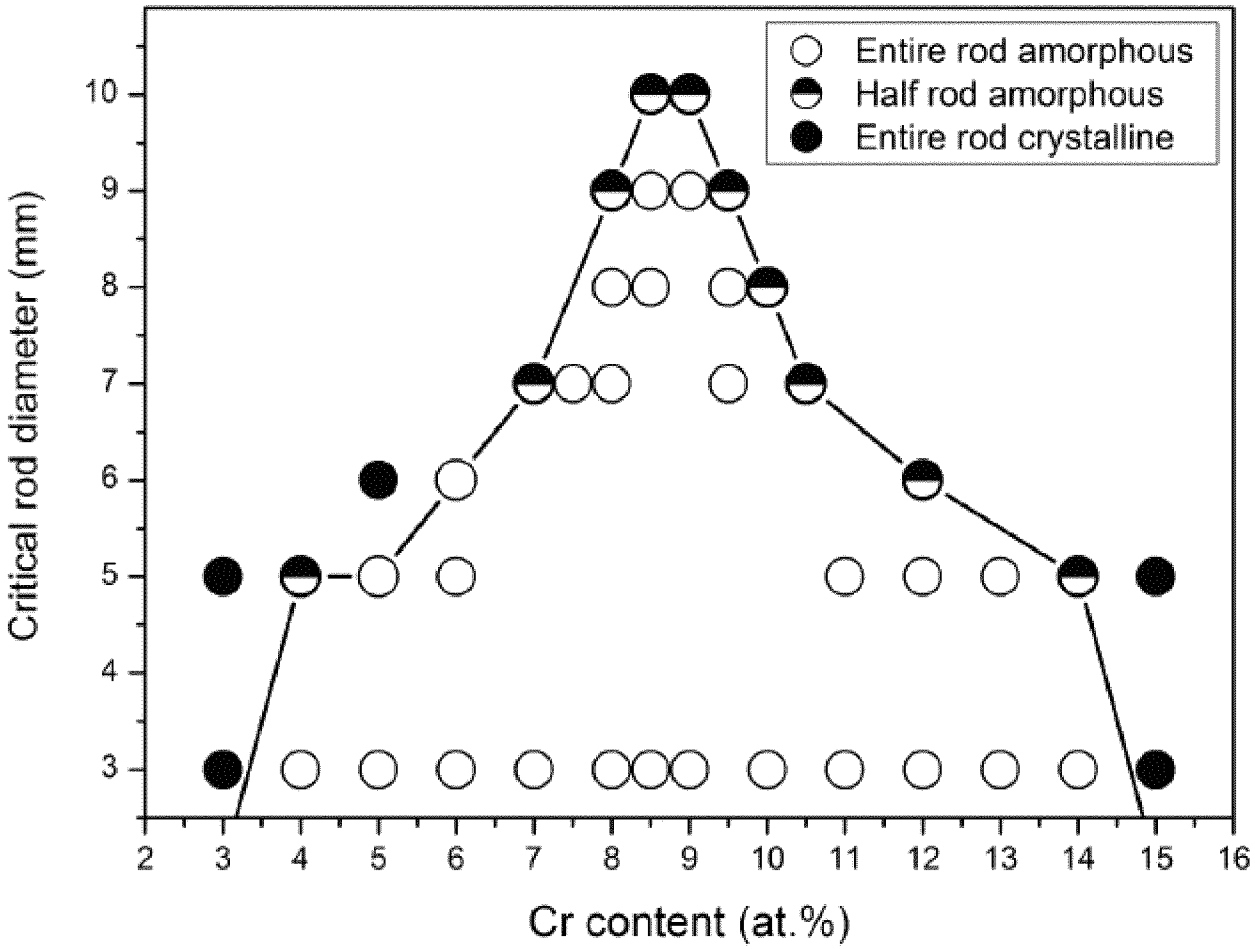
FIG. 3 provides a data plot showing the effect of increasing Cr atomic concentration at the expense of Ni on the glass forming ability of exemplary amorphous alloys $Ni_{77.5-x}Cr_xNb_3P_{16.5}B_3$ for $3 \le x \le 15$ (Compositions are listed in Table 3).
Figure 4:
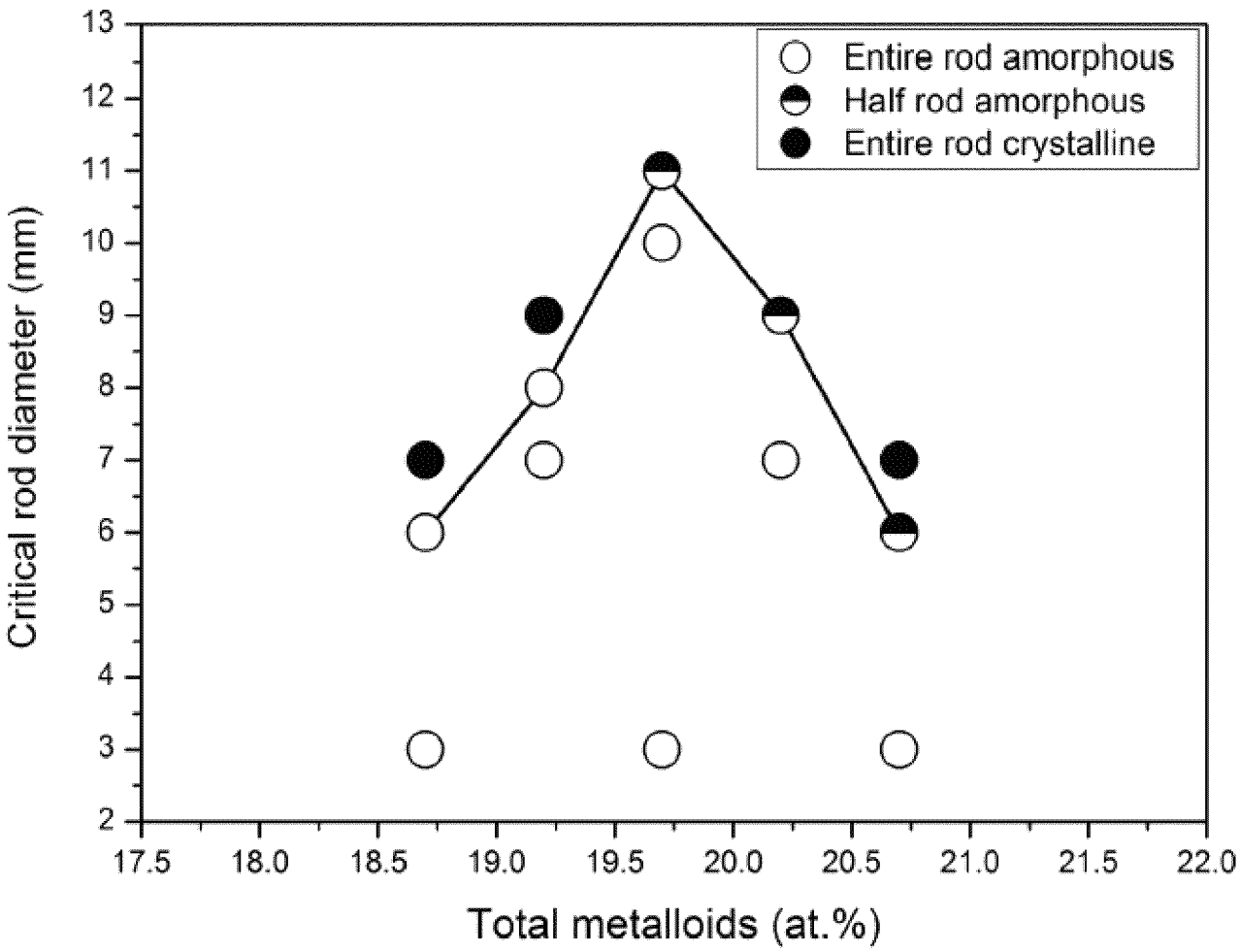
FIG. 4 provides a data plot showing the effect of increasing the atomic concentration of metalloids at the expense of metals on the glass forming ability of exemplary amorphous alloys $(Ni_{0.8541}Cr_{0.1085}Nb_{0.0374})_{100-x}(P_{0.8376}B_{0.1624})_x$ (Compositions are listed in Table 4).
Figure 5:
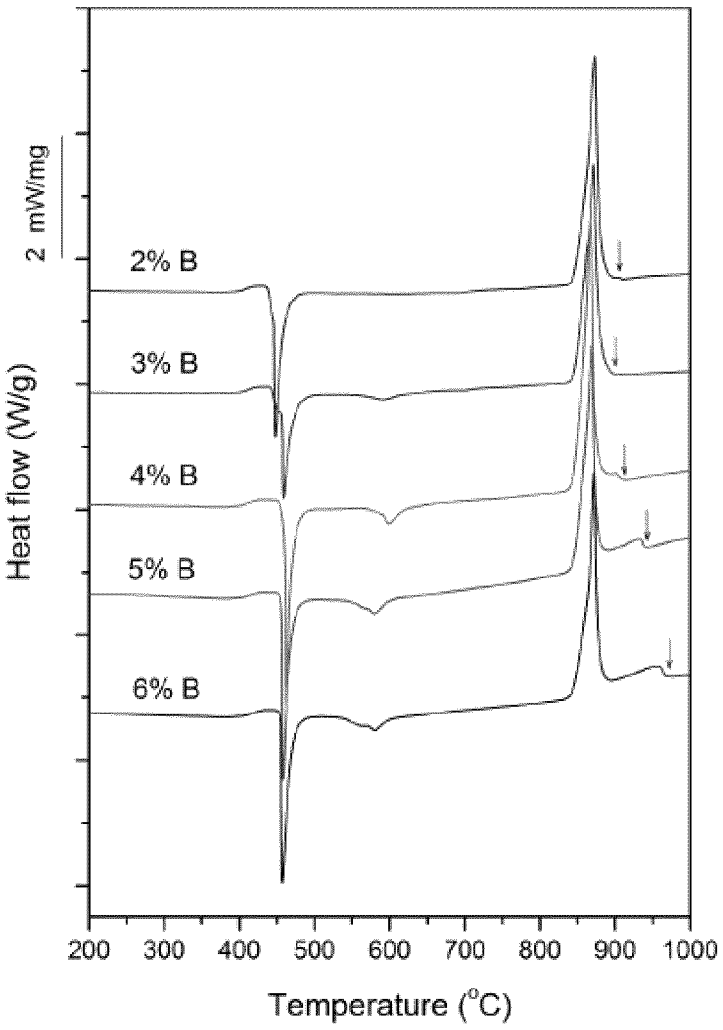
FIG. 5 provides calorimetry scans for exemplary amorphous alloys $Ni_{69}Cr_{8.5}Nb_3P_{19.5-x}B_x$ for $2 \le x < 4$ and $Ni_{68.5}Cr_{8.5}Nb_3P_{20-x}B_x$ for $4 \le x \le 6$. (Compositions are listed in Table 1; and arrows in plot designate the liquidus temperatures).
Figure 6:
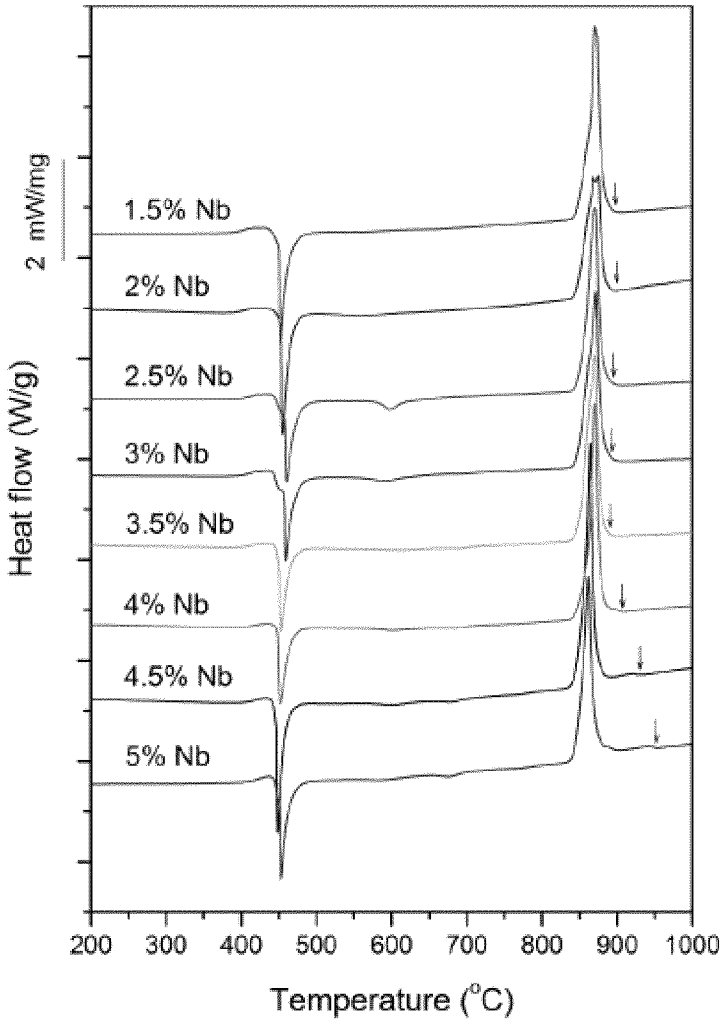
FIG. 6 provides calorimetry scans for exemplary amorphous alloys $Ni_{69}Cr_{11.5-x}Nb_xP_{16.5}B_3$ for $1.5 \le x \le 5$. (Compositions are listed in Table 2; and arrows in plot designate the liquidus temperatures).
Figure 7:
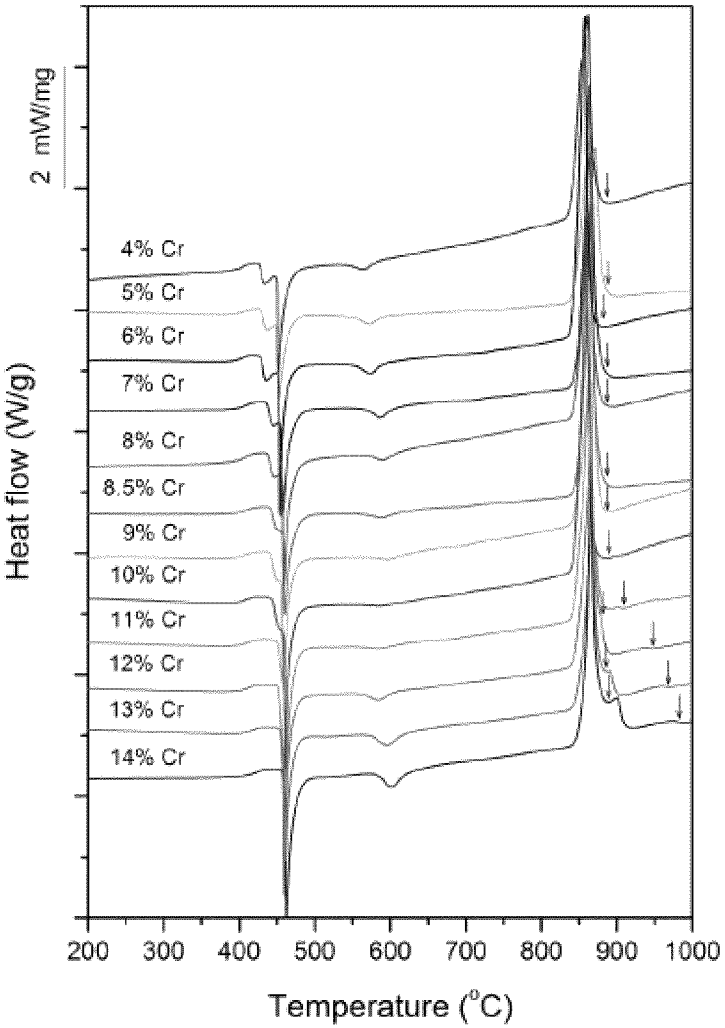
FIG. 7 provides calorimetry scans for exemplary amorphous alloys $Ni_{77.5-x}Cr_xNb_3P_{16.5}B_3$ for $4 \le x \le 14$. (Compositions are listed in Table 3; and arrows in plot designate the liquidus temperatures).
Figure 8:
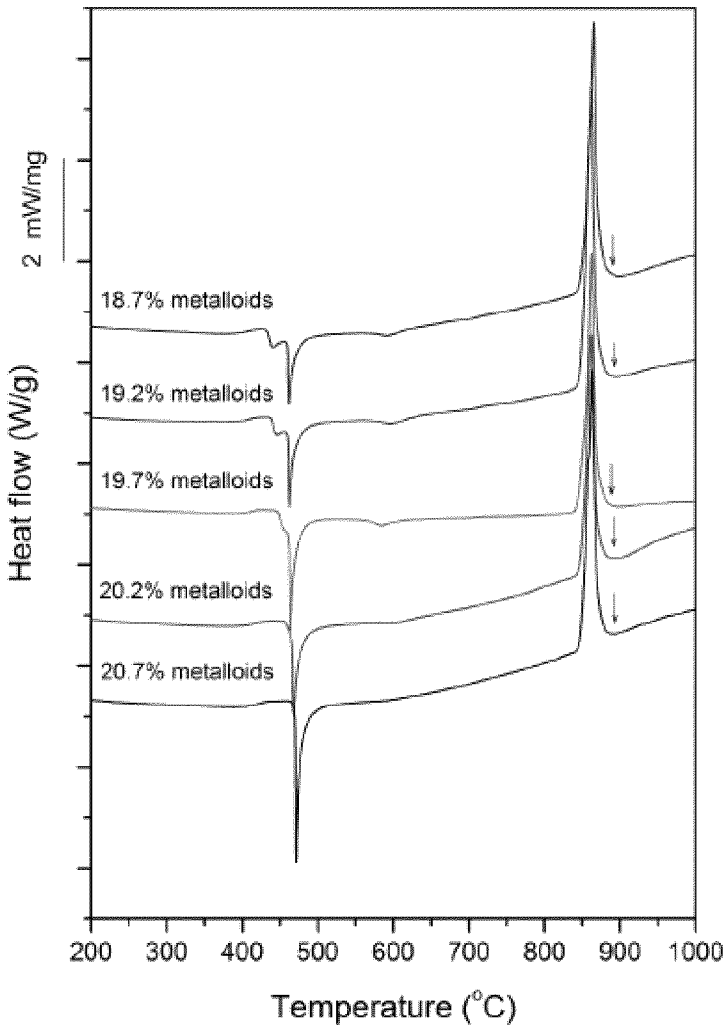
FIG. 8 provides calorimetry scans for exemplary amorphous alloys $(Ni_{0.841}Cr_{0.1085}Nb_{0.0374})_{100-x}(P_{0.8376}B_{0.4624})_x$ (Compositions are listed in Table 4; and arrows in plot designate the liquidus temperatures).
Figure 9:
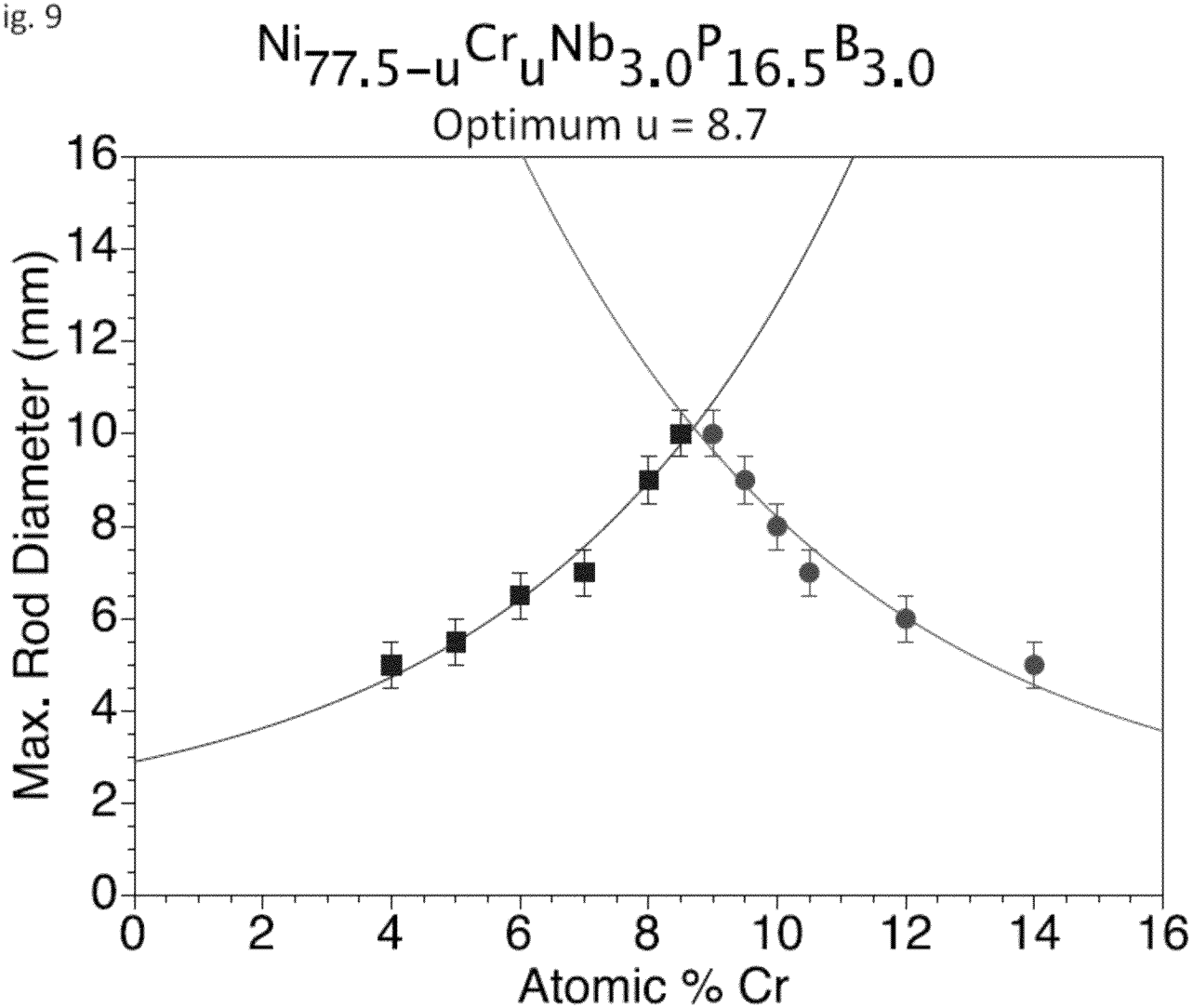
FIG. 9 provides the results of experimental fitting data for varying Cr concentration at the expense of Ni, according to the formula $Ni_{77.5-u}Cr_uNb_3P_{16.5}B_3$. The preferred u is found to be 8.7. The fitting of the maximum rod diameter data follows the function $1.5+8.5\exp[20.85\ (u-8.7)]$ for $u<8.7$, and $1.5+8.5\exp[-19.56(u-8.7)]$ for $u>8.7$.
Figure 10:
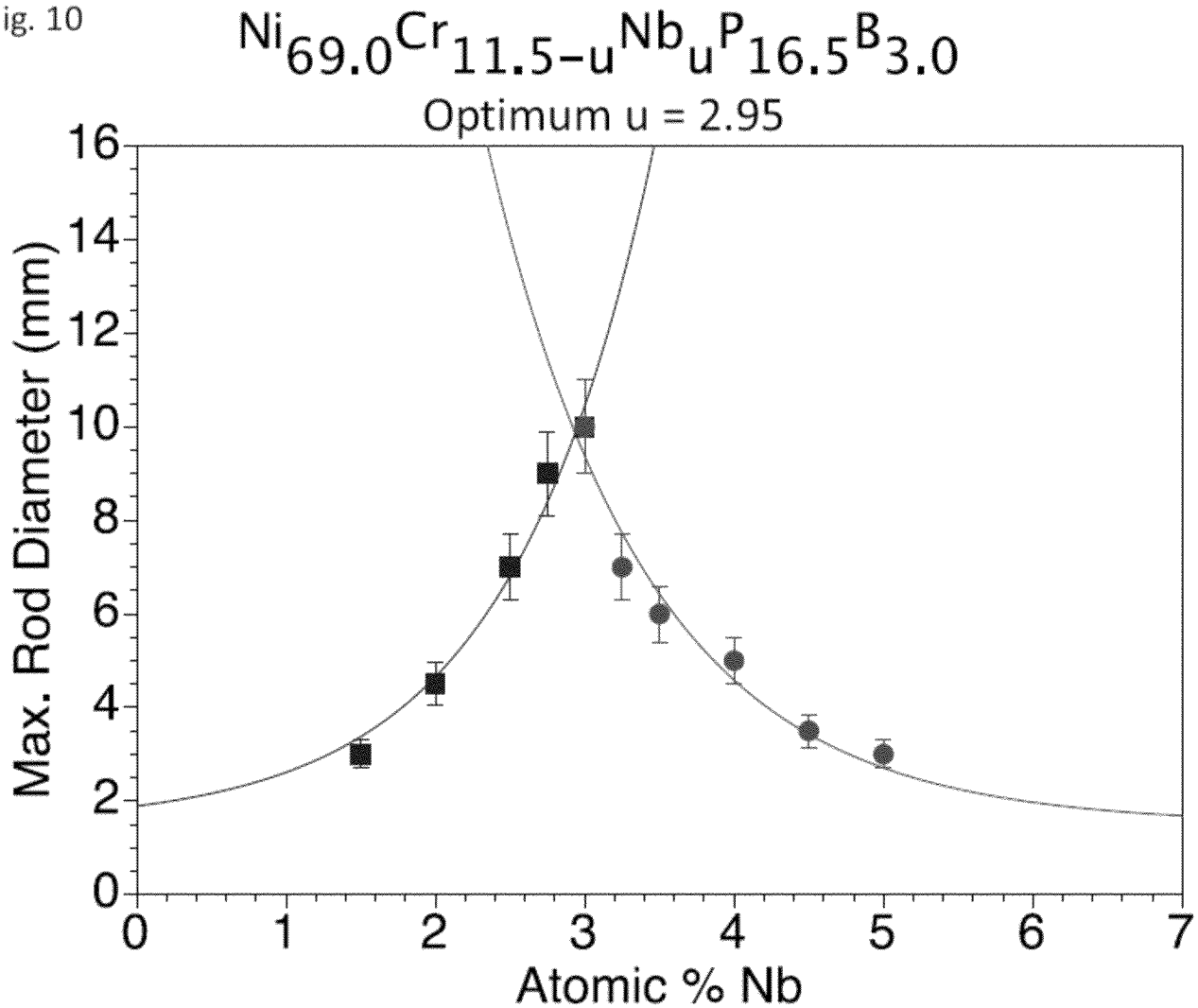
FIG. 10 provides the results of experimental fitting data for varying Nb concentration at the expense of Cr, according to the formula $Ni_{69}Cr_{11.5-u}Nb_uP_{16.5}B_3$. The preferred u is found to be 2.95. The fitting of the maximum rod diameter data follows the function $1.5+8.5\exp[1.042(u-2.95)]$ for $u<2.95$, and $1.5+8.5\exp[-0.938(u-2.95)]$ for $u>2.95$.
Figure 11:
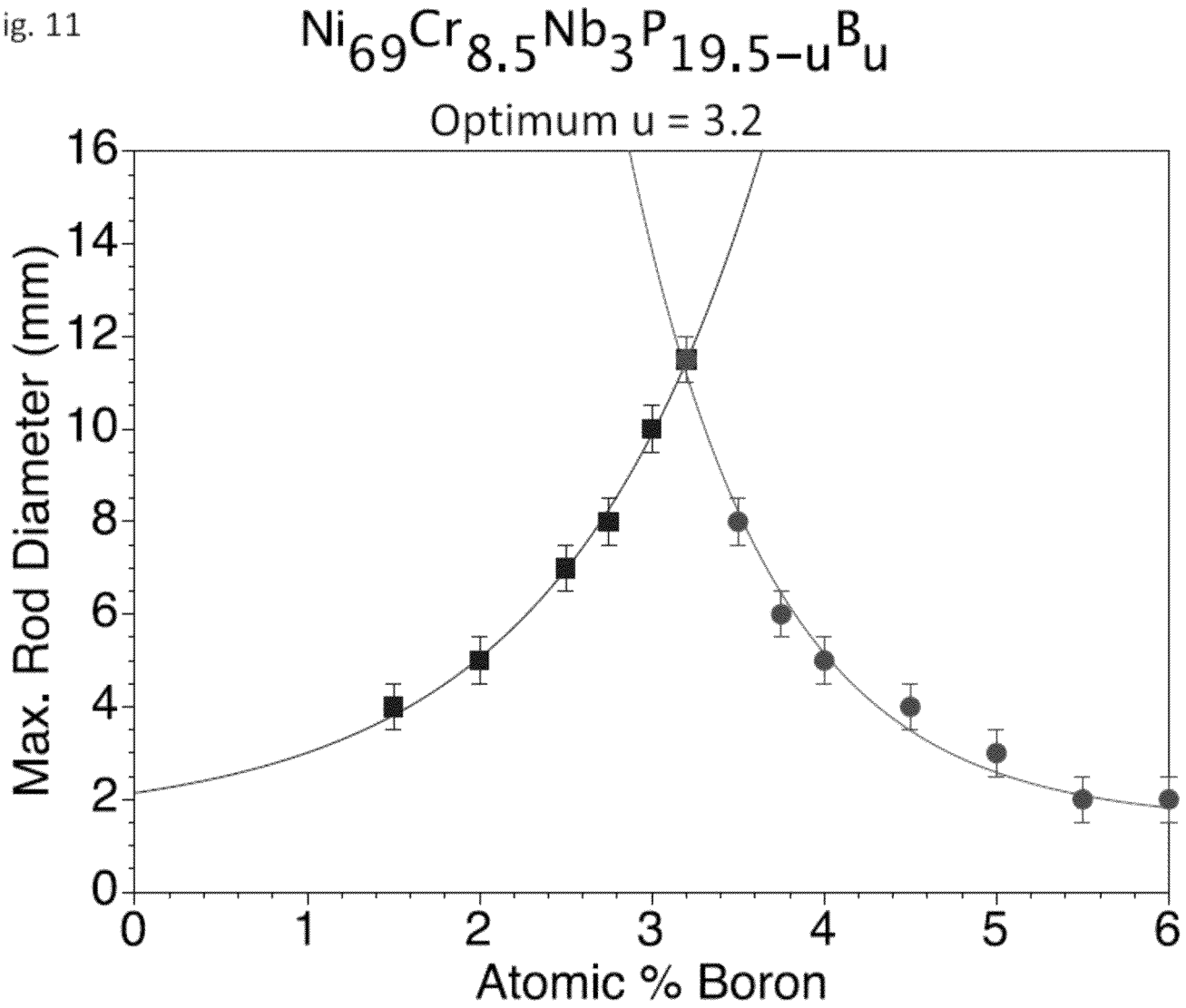
FIG. 11 provides the results of experimental fitting data for varying B concentration at the expense of P, according to the formula $Ni_{69}Cr_{8.5}Nb_3P_{19.5-u}B_u$. The preferred u is found to be 3.2. The fitting of the maximum rod diameter data follows the function $1.5+9.83\exp[0.8578(u-3.2)]$ for $u<3.2$, and $1.5+9.83\exp[-1.2189(u-3.2)]$ for $u>3.2$.
Figure 12:
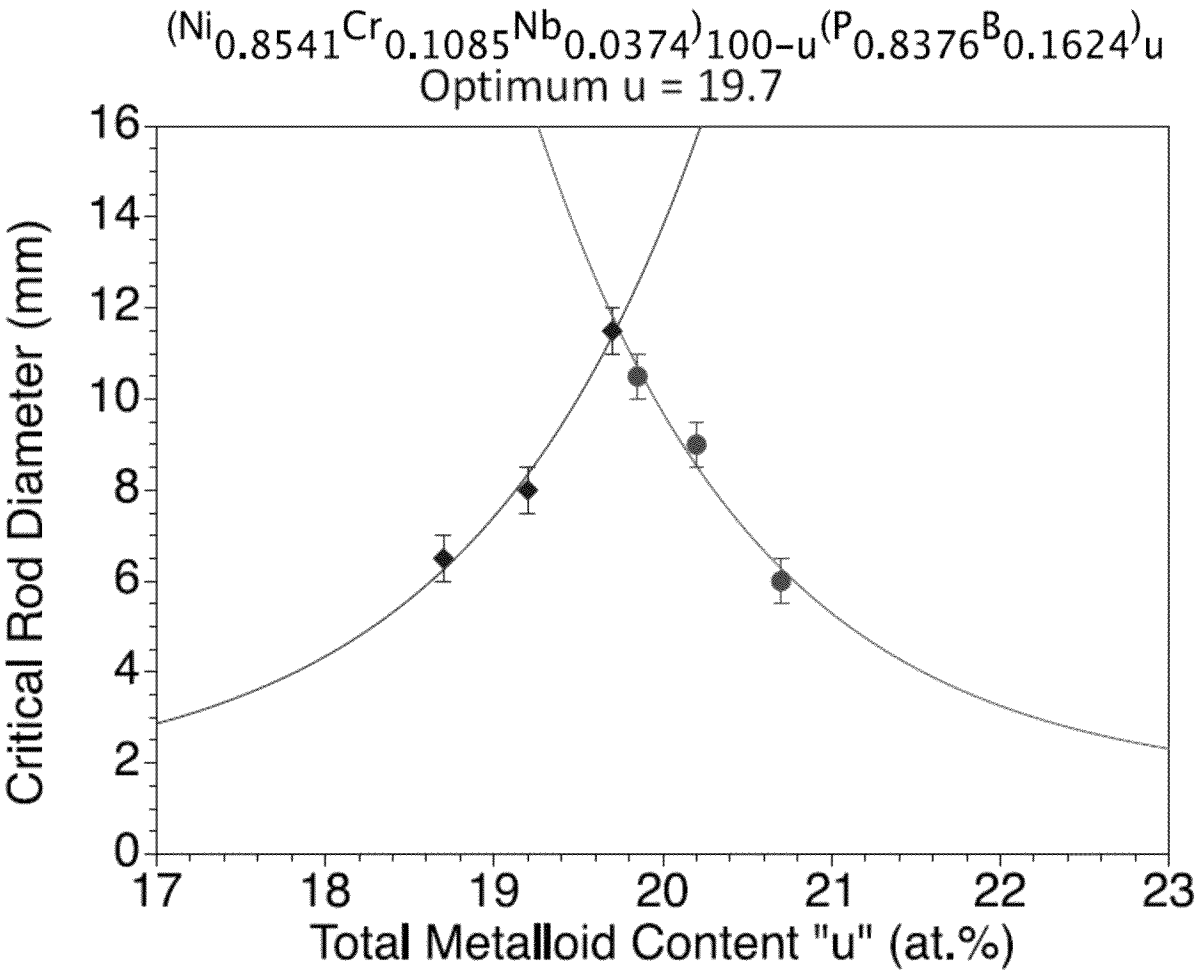
FIG. 12 provides the results of experimental fitting data for varying metalloid concentration at the expense of metals, according to the formula $(Ni_{0.8541}Cr_{0.1085}Nb_{0.0374})_{100-u}(P_{0.8376}B_{0.1624})_u$. The preferred u is found to be 19.7. The fitting of the maximum rod diameter data follows the function $1.5+9.9\exp[0.7326(u-19.7)]$ for $u<19.7$, and $1.5+9.9\exp[-0.7708(u-19.7)]$ for $u>19.7$.

In particular, the present disclosure demonstrates that simultaneous substitutions of about 2 to 4 atomic percent P with B (Table 1 below, and FIG. 1) and about 2 to 4 atomic percent Cr with Nb (Table 2 below, and FIG. 2) in the $Ni_{69}Cr_{11.5}P_{19.5}$ system, where the total atomic concentration of Cr and Nb is about 11.5% (Table 3 below, and FIG. 3), and the total metalloid (P and B) atomic concentration is about 19.5% (Table 4 below, and FIG. 4), drastically improves bulk-glass formation. More specifically, it has been determined that there is a very sharp unexpected "cusp-like" peak in glass forming ability within these compositional ranges that would never have been anticipated or considered possible based on conventional view of metallic glass formation. This sharp peak is illustrated by variation in glass forming ability shown in Tables 1-4.

TABLE 1

Exemplary amorphous alloys demonstrating the effect of increasing the B atomic concentration at the expense of P on the glass forming ability of the Ni—Cr—Nb—P—B system.

| Example | Composition | Critical Rod Diameter [mm] |
|---|---|---|
| 1 | $Ni_{69}Cr_{8.5}Nb_3P_{18}B_{1.5}$ | 4 |
| 2 | $Ni_{69}Cr_{8.5}Nb_3P_{17.5}B_2$ | 5 |
| 3 | $Ni_{69}Cr_{8.5}Nb_3P_{17}B_{2.5}$ | 7 |
| 4 | $Ni_{69}Cr_{8.5}Nb_3P_{16.75}B_{2.75}$ | 8 |

TABLE 1-continued

Exemplary amorphous alloys demonstrating the effect of increasing the B atomic concentration at the expense of P on the glass forming ability of the Ni—Cr—Nb—P—B system.

| Example | Composition | Critical Rod Diameter [mm] |
|---|---|---|
| 5 | $Ni_{69}Cr_{8.5}Nb_3P_{16.5}B_3$ | 10 |
| 6 | $Ni_{69}Cr_{8.5}Nb_3P_{16}B_{3.5}$ | 8 |
| 7 | $Ni_{69}Cr_{8.5}Nb_3P_{15.75}B_{3.75}$ | 6 |
| 8 | $Ni_{68.5}Cr_{8.5}Nb_3P_{16}B_4$ | 5 |
| 9 | $Ni_{68.5}Cr_{8.5}Nb_3P_{15.5}B_{4.5}$ | 4 |
| 10 | $Ni_{68.5}Cr_{8.5}Nb_3P_{15}B_5$ | 4 |
| 11 | $Ni_{68.5}Cr_{8.5}Nb_3P_{14.5}B_{5.5}$ | 2 |
| 12 | $Ni_{68.5}Cr_{8.5}Nb_3P_{14}B_6$ | 2 |

TABLE 2

Exemplary amorphous alloys demonstrating the effect of increasing the Nb atomic concentration at the expense of Cr on the glass forming ability of the Ni—Cr—Nb—P—B system.

| Example | Composition | Critical Rod Diameter [mm] |
|---|---|---|
| 13 | $Ni_{69}Cr_{10}Nb_{1.5}P_{16.5}B_3$ | 3 |
| 14 | $Ni_{69}Cr_{9.5}Nb_2P_{16.5}B_3$ | 4 |
| 15 | $Ni_{69}Cr_9Nb_{2.5}P_{16.5}B_3$ | 7 |
| 16 | $Ni_{69}Cr_{8.75}Nb_{2.75}P_{16.5}B_3$ | 9 |
| 5 | $Ni_{69}Cr_{8.5}Nb_3P_{16.5}B_3$ | 10 |
| 17 | $Ni_{69}Cr_{8.25}Nb_{3.25}P_{16.5}B_3$ | 7 |
| 18 | $Ni_{69}Cr_8Nb_{3.5}P_{16.5}B_3$ | 6 |
| 19 | $Ni_{69}Cr_{7.5}Nb_4P_{16.5}B_3$ | 5 |
| 20 | $Ni_{69}Cr_7Nb_{4.5}P_{16.5}B_3$ | 3 |
| 21 | $Ni_{69}Cr_{6.5}Nb_5P_{16.5}B_3$ | 3 |

TABLE 3

Exemplary amorphous alloys demonstrating the effect of increasing the Cr atomic concentration at the expense of Ni on the glass forming ability of the Ni—Cr—Nb—P—B system.

| Example | Composition | Critical Rod Diameter [mm] |
|---|---|---|
| 22 | $Ni_{73.5}Cr_4Nb_3P_{16.5}B_3$ | 5 |
| 23 | $Ni_{72.5}Cr_5Nb_3P_{16.5}B_3$ | 5 |
| 24 | $Ni_{71.5}Cr_6Nb_3P_{16.5}B_3$ | 6 |
| 25 | $Ni_{70.5}Cr_7Nb_3P_{16.5}B_3$ | 7 |
| 26 | $Ni_{69.5}Cr_8Nb_3P_{16.5}B_3$ | 9 |
| 5 | $Ni_{69}Cr_{8.5}Nb_3P_{16.5}B_3$ | 10 |
| 27 | $Ni_{68.5}Cr_9Nb_3P_{16.5}B_3$ | 10 |
| 28 | $Ni_{68}Cr_{9.5}Nb_3P_{16.5}B_3$ | 9 |
| 29 | $Ni_{67.5}Cr_{10}Nb_3P_{16.5}B_3$ | 8 |
| 30 | $Ni_{66.5}Cr_{11}Nb_3P_{16.5}B_3$ | 6 |
| 31 | $Ni_{65.5}Cr_{12}Nb_3P_{16.5}B_3$ | 6 |
| 32 | $Ni_{64.5}Cr_{13}Nb_3P_{16.5}B_3$ | 5 |
| 33 | $Ni_{63.5}Cr_{14}Nb_3P_{16.5}B_3$ | 5 |

TABLE 4

Exemplary amorphous alloys demonstrating the effect of increasing the total metalloid concentration at the expense of metals on the glass forming ability of the Ni—Cr—Nb—P—B system.

| Example | Composition | Critical Rod Diameter [mm] |
|---|---|---|
| 34 | $Ni_{69.45}Cr_{8.81}Nb_{3.04}P_{15.66}B_{3.04}$ | 6 |
| 35 | $Ni_{69.03}Cr_{8.75}Nb_{3.02}P_{16.08}B_{3.12}$ | 8 |
| 36 | $Ni_{68.6}Cr_{8.7}Nb_3P_{16.5}B_{3.2}$ | 11 |
| 37 | $Ni_{68.17}Cr_{8.65}Nb_{2.98}P_{16.92}B_{3.28}$ | 9 |
| 38 | $Ni_{67.75}Cr_{8.59}Nb_{2.96}P_{17.34}B_{3.36}$ | 6 |

More importantly, it has been discovered that outside of the inventive ranges, the ability to produce the amorphous phase in bulk dimensions drastically diminishes. Moreover, the glass forming ability is shown to peak when Cr atomic concentration is between 8.5 and 9%, when the Nb atomic concentration is about 3%, when the P atomic concentration is about 16.5%, and when the B atomic concentration is between 3 and 3.5%, whereby fully amorphous bulk rods 10 mm in diameter or more are produced. Calorimetry scans to determine the effects of increasing B at the expense of P, Nb at the expense of Cr, and Cr at the expense of Ni on the glass transition, crystallization, solidus, and liquidus temperatures were also performed (FIGS. 5 to 8). The calorimetry scans show that as the preferred composition is approached, the solidus and liquidus temperatures pass through a minimum while coming closer together, which suggest that in various embodiments the preferred composition is associated with a five-component eutectic.

Refining Ni-Metallic Glasses and Ni-Metallic Glass Formation

In one embodiment, the inventive Ni-alloy composition can be described by a 4-dimensional composition space in which bulk amorphous alloy compositions with maximum rod diameter of 5 mm or larger will be included. In such an embodiment, a description of the alloy (based on the glass-forming ability vs. composition plots provided herein) would be an ellipsoid in a 4-dimensional composition space as described hereafter.

To form bulk amorphous alloys with maximum rod diameter of at least 5 mm, the alloys composition would satisfy the following formula (subscripts denote atomic percent):

$$Ni_{(69-w-x-y-z)}Cr_{8.5+w}Nb_{3+x}P_{16.5+y}B_{3+z}$$

where w, x, y, and z are the deviation from an "ideal composition", are in atomic percent and can be positive or negative. In such an embodiment, for alloys capable of producing amorphous rods with diameter of at least 5 mm, the equation of the 4-dimensional ellipsoid would be given as follows:

$$(w/4.5)^2+(x/0.75)^2+(y/0.5)^2+(z/1)^2<1$$

or $$0.0494w^2+1.78x^2+4y^2+z^2<1$$

If, for example, only w is considered (let x=y=z=0), the condition for 5 mm maximum rod diameter given by the "glass-forming ability vs. Cr content" plot of $-4.5<w<4.5$ is reached. In turn, if only x is considered (let w=y=z=0), the condition for 5 mm maximum rod diameter given by the "glass-forming ability vs. Nb content" plot of $-0.75<x<0.75$ is reached, etc. Accordingly, in this embodiment of the composition, the formula provides a preferred "5 mm" maximum rod diameter region since it treats the deviations as having a cumulative effect on degrading glass-forming ability.

In turn, the region that contains bulk amorphous alloys with maximum rod diameter of at least 3 mm can be obtained by adjusting the "size" of the ellipsoid. It is possible to obtain a formula for an alloy that can form amorphous rods at least 3 mm in diameter. This is given by an ellipsoid of the following formula (subscripts denote atomic percent):

$$Ni_{(69-w-x-y-z)}Cr_{8.5+w}Nb_{3+x}P_{16.5+y}B_{3+z}$$

where w, x, y, and z are the deviation from an "ideal composition", are in atomic percent and can be positive or negative. In such an embodiment, for alloys capable of producing amorphous rods with diameter of at least 3 mm, the equation of the 4-dimensional ellipsoid would be given as follows:

$$0.033w^2+0.44x^2+2y^2+0.32z^2<1.$$

In effect, the two formulae above provide a direct description of preferred embodiments of the inventive composition adjusted for the critical casting diameter desired.

In another embodiment, the present disclosure is also directed to Ni-based systems that further contain minority additions of Si. Specifically, substitution of up to 2 atomic percent P with Si in the inventive alloys is found to retain significant glass forming ability. As such, the Ni-based inventive alloys in this embodiment contain Cr in the range of 5 to 12 atomic percent, Nb in the range of 1.5 to 4.5 atomic percent, P in the range of 12.5 to 17.5 atomic percent, and B in the range of 1 to 5 atomic percent, and are capable of forming an amorphous phase in sections at least 3 mm thick, and up to 10 mm or greater. Preferably, the atomic percent of B in the alloys of the present disclosure is between about 2 and 4, and the combined fraction of P, B, and Si is between about 19 and 20 atomic percent. Also, the atomic percent of Cr is preferably between 7 and 10 and of Nb between 2.5 and 4.

Exemplary embodiments demonstrate that substitutions of up to about 2 atomic percent P with Si in the $Ni_{68.5}Cr_9Nb_3P_{16.5}B_3$ system does not drastically degrade bulk metallic glass formation.

Accordingly, in some embodiments, the inventive Ni-alloy composition can be described by a 4-dimensional composition space in which bulk amorphous alloy compositions with maximum rod diameter of 3 mm or larger will be included. In such an embodiment, a description of the alloy (based on the glass-forming ability vs. composition plots provided herein) would be 4-dimensional "diamond shaped" region within a 4-dimensional composition space represented by the composition vector c=(w, x, y, z). As will be described below in detail, the refinement of the composition variables, based on an analysis of our experimental data on glass forming ability, yields a single precise alloy composition with maximum glass forming ability in the 5-component Ni—Cr—Nb—P—B system. This alloy can be formed into fully amorphous cylindrical rods of diameter of 11.5±0.5 mm (almost ½ inch) when melted at 1150° C. or higher in quartz tubes with 0.5 mm thick wall and subsequently quenched in a water bath. This precise refined composition is given by:

$$Ni_{1-w-x-y-z}Cr_wNb_xP_yB_z$$

where the variables (w, x, y, z) are the concentrations of the respective elements in atomic percent, and where the refined composition variables are $w_0$=8.7 (at. % Cr), $x_0$=3.0 (at. % Nb), $y_0$=16.5 (at. % P), $z_0$=3.2 (at. % B), and the balance of the alloy being 68.6 at. % Ni.

In the refinement of this alloy, the composition space along 4 independent experimental directions defined by 4 alloy "series" can be sampled as follows:

$Ni_{77.5-u}Cr_uNb_{3.0}P_{16.5}B_{3.0}$ (Series 1)

$Ni_{69}Cr_{11.5-u}Nb_uP_{16.5}B_{3.0}$ (Series 2)

$Ni_{69}Cr_{8.5}Nb_3P_{19.5-u}B_u$ (Series 3)

$(Ni_{0.8541}Cr_{0.1085}Nb_{0.0374})_{100-u}(P_{0.8376}B_{0.1624})$, (Series 4)

These alloy series represent one-dimensional lines in the 4-dimensional composition space. The lines are oriented in 4 independent directions. Therefore any alloy composition in the vicinity of the refined composition can be formed by combining alloys belonging to the 4 alloy series. By demonstrating a sharp peak in glass forming ability in each separate alloy series, it can be inferred that there exists a single unique peak in the four-dimensional space, associated with one unique alloy composition which refines glass forming ability for the 5-component system.

The critical rod diameter data from FIGS. 1-4 are also plotted in FIGS. 9 to 12. It was found that the critical rod diameter plotted vs. composition, u, consists of two separate curves, one for low u values where the critical rod diameter rapidly increases with u up to a maximum, and one for higher u values which rapidly falls with u beyond an optimum value of u. The two "branches" of the plots can be associated with a change in crystallization mechanism of the liquid alloy as one passes through an optimum composition. More specifically, the crystalline phase which forms most readily during cooling the liquid changes abruptly as one passes through the optimum value of u. It was found that the two branches of the curves (the low u and high u branches) are well described as exponential functions of the composition variable u. The two branches of the curves are found to first increase exponentially with u (low u branch) and then decrease exponentially (high u) as one exceeds the optimum value of u. The exponential fits for each of the 4 alloy series are shown in FIGS. 9-12 along with the experimental critical rod diameter data. The intersection of the two branches defines the refined value of the u variable for each of the 4 alloy series. These fits were used to develop a mathematical description of glass-forming ability in the 4-dimensional composition space.

Following Iterative Refinement of each variable as described above, it is possible to identify the refined alloy composition and derive a general formula for any alloy in the neighborhood of the refined alloy composition. In accordance, it can be determined that refined alloy to be:

$$Ni_{68.6}Cr_{8.7}Nb_{3.0}P_{16.5}B_{3.2}$$

In turn, the 4 experimental alloy series can be defined by the composition "shift" vectors around the refined composition:

$\Delta u_1 = u\times[1, 0, 0, 0]$ (Cr replaces Ni)

$\Delta u_2 = u\times[-1, 1, 0, 0]$ (Nb replaces Cr)

$\Delta u_3 = u\times[0, 0, -1, 1]$ (B replaces P)

$\Delta u_4 = u\times[-0.1085, -0.0374, 0.8376, 0.1624]$ (metalloids replace metals)

where u is the composition displacement in at. % along the specified alloy series.

Using the "standard' composition variables (w, x, y, z) in the standard alloy formula $Ni_{1-w-x-y-z}Cr_wNb_xP_yB_z$, the four composition shift vectors (associated with displacements w, x, y, and z, are given by:

$\Delta w = w\times[1, 0, 0, 0]$, $\Delta x = x\times[0, 1, 0, 0]$, $\Delta y = y\times[0, 0, 1, 0]$, and $\Delta z = z\times[0, 0, 0, 1]$.

These can be expressed in terms of the Δu's as:

$\Delta w = \Delta u_1$, $\Delta x = 0.7071\Delta u_1 + 0.7071\Delta u_2$, $\Delta y = 0.1423\Delta u_1 + 0.0365\Delta u_2 - 0.1586\Delta u_3 + 0.9764\Delta u_4$, and $\Delta z = 0.1110\Delta u_1 + 0.0285\Delta u_2 + 0.6379\Delta u_3 + 0.7616\Delta u_4$.

Collecting these "fitting parameters", the fit of the critical rod diameter data for the 4 alloy series gives two exponential "decay" parameters for each of the displacements $\Delta u_2$, $\Delta u_3$, and $\Delta u_4$ where the $\lambda_{i,\pm}$ parameters are in "inverse decay" lengths (decay lengths in at. %) for positive (+ sign) and negative (− sign) deviations of composition from the refined values of each $\Delta u_i$. Glass-forming ability (GFA) is described along each series (i=1, 2, 3, and 4) by the formula:

$$GFA = D_0 + D_i \exp[-\lambda_(\pm,i)\Delta u_i] \quad \text{(EQ. 1)}$$

where the $\lambda_{+,i}$ and $\lambda_{-,i}$ parameters are determined from the fits presented in the charts for the series 1-4 shown in FIGS. 9 to 12. (These values have been collected in Table 5, below.) $D_0$ in EQ. 1 plays the role of a "background" GFA for alloys having large deviations in composition from the optimum. The $D_i$'s are the "height" of the cusps is each series. These approach a maximum of 9-10 mm as composition is iteratively refined while, $D_0$=1.5 mm for all i. In other words, for the purposes of this disclosure, glass forming of less than 1.5 mm is considered "background" or "baseline" glass forming, and is outside the bounds of the proposed inventive compositions.

TABLE 5

| GFA Parameters | | | | | | |
|---|---|---|---|---|---|---|
| Displacements (from preferred u) | $\lambda_-$ | $\lambda_+$ | w | x | y | z |
| $\Delta u_1$ | 0.2085 | 0.1956 | 1 | 0.7071 | 0.1423 | 0.1110 |
| $\Delta u_2$ | 1.0420 | 0.9380 | 0 | 0.7071 | 0.0365 | 0.0285 |
| $\Delta u_3$ | 0.8578 | 1.2189 | 0 | 0 | −0.1586 | 0.6379 |
| $\Delta u_4$ | 0.7326 | 0.7708 | 0 | 0 | 0.9764 | 0.7616 |
| Δw (Cr) | 0.2085 | 0.1956 | | | | |
| Δx (Nb) | 0.8842 | 0.8016 | | | | |
| Δy (P) | 0.9725 | 0.9507 | | | | |
| Δz (B) | 1.1580 | 1.3937 | | | | |

Using these parameters and fits it is now possible to write a general formula for GFA in (w, x, y, z) coordinates. From the fitting it was found that using $D_0$=1.5 mm for all of the u coordinates provided and excellent fit to the data. The values of the A, parameters in Table 5 were obtained with this value of $D_0$. It was also found that the preferred value of $D_i$=9.9 mm provided an excellent description of all of the data. This is the appropriate value of $D_i$ for all u coordinates (and therefore w, x, y, z coordinates) since all series must yield the same peak value of GFA. To an excellent approximation, GFA in the "standard coordinates" is:

$$GFA = D_0 + D_i \exp[-\lambda_{\pm,w}(w-w_0) - \lambda_{\pm,x}(x-x_0) - \lambda_{\pm,y}(y-y_0) - \lambda_{\pm,z}(z-z_0)] \quad \text{(EQ.2)}$$

where the $\lambda_\pm$ (for each coordinate) is chosen according to the sign of the displacements $\Delta w = w - w_0$, $\Delta x = x - x_0$, etc., and $w_0$, $x_0$, etc. refer to the refined composition variables. The values of the λ's are given in Table 5. The value of the "background GFA" is taken to be $D_0$=1.5 mm while $D_i$=9.9 mm is the best overall value which fits all data. This formula can be shown to provide an excellent description of the GFA of all experimental alloys studied in the Ni—Cr—Nb—P—B quinary glass system. The formula accurately predicts the GFA of any quinary alloy in the neighborhood with an accuracy of ±1 mm (maximum diameter for obtaining a fully amorphous rod). It should be noted that:

$$\ln[[(GFA - D_0)/D_i] = -\lambda_{\pm,w}(w-w_0) - \lambda_{\pm,x}(x-x_0) - \lambda_{\pm,y}(y-y_0) - \lambda_{\pm,z}(z-z_0) \quad \text{(EQ. 3)}$$

where D=9.9 mm. In other words, the reduction ln [(GFA−$D_0$)/D] associated with composition errors are additive.

As such, according to the GFA equation and the additivity of logarithmic errors, it is possible to construct 4-dimensional composition maps for achieving a desired GFA. To illustrate this, simple 2-dimensional maps (projections from the 4-dimensional map) based on variations in two of the four independent variables (assuming the remaining variables are fixed at the refined values) are provided in FIGS. 13 to 16. Most important, for the control of alloy glass forming ability are the most "sensitive" variables, i.e., those with greatest λ's. From Table 5, these are clearly x, y and z (i.e., Nb, P, and B content). In the 2-dimensional GFA maps, to obtain an amorphous rod 8 mm in diameter, the composition (of the two variables) must lie within the central "diamond" on all plots. The middle "diamond" in each plot illustrates ranges in which 5 mm critical rod diameter is obtained for the two subject variables (assuming the other variable assume refined values). Beyond the "inner two diamonds" (corresponding to critical rod diameters of 5 mm and 8 mm) an "outer diamond" depicts alloys that only demonstrate 3 mm critical rod diameter. Beyond the "3 mm diamond" glass forming ability rapidly decays to the "background GFA" (taken to be 1.5 mm in the GFA model). In fact, the GFA model is consistent with the prior art (Inoue patent and Hashimoto article) where critical rod diameter of 1 mm was reported for alloys in the general neighborhood of the inventive compositions. As can be seen from the four binary GFA maps shown, it is the case that large variations in Cr content (the w-coordinate) can be tolerated without serious degradation of GFA, while variations in P content (y-coordinate) produce GFA degradation which is intermediate. Small deviation from the preferred compositions (deviations of a fraction of 1 at. % from the preferred composition) for the "critical" elements Nb and B (x and z coordinate) leads to rapid degradation of GFA from 11.5 mm to the 1 mm level. This striking behavior has not been anticipated in any prior art in the metallic glass field.

Accordingly, to form bulk amorphous alloys with maximum rod diameter of at least 8 mm or at least 5 mm, the deviations from refined alloy compositions must satisfy the following formula (subscripts denote atomic percent):

$$Ni_{(68.6-w-x-y-z)}Cr_{8.7+w}Nb_{3.0+x}P_{16.5+y}B_{3.2+z}$$

where w, x, y, and z are now taken to be the deviation from an "ideal composition", are in atomic percent, and can be positive or negative, as shown in Table 6, below.

TABLE 6

Maximum Composition Errors for achieving a specific critical rod diameter

| | 8 mm | 8 mm | 5 mm | 5 mm |
|---|---|---|---|---|
| Maximum Allowed Error | Δ < 0 (too low) [at. %] | Δ > 0 (too high) [at. %] | Δ < 0 [at. %] | Δ > 0 [at. %] |
| Cr Error (w) | −2.0 | +2.1 | −5 | +5.2 |
| Nb Error (x) | −0.4 | +0.4 | −1.1 | +1.1 |
| P Error (y) | −0.4 | +0.3 | −1.1 | +0.9 |
| B Error (z) | −0.3 | +0.2 | −0.7 | +0.5 |

In such embodiments, for example, alloys capable of producing amorphous rods with diameter of at least 8 mm, the equation of the 4-dimensional "diamonds" would be given as follows:

$$0.21|w|+0.84|x|+0.96|y|+1.18|z|<0.43$$

with |w|, |x|, etc. being the absolute value of the composition deviations as above. If, for example, only w is considered (letting x=y=z=0), the condition for 8 mm critical rod diameter given by the "critical rod diameter vs. Cr content" plot (FIG. 3) a deviation from preferred values of −2.0<w<2.1 is reached. In turn, if only x is considered (let w=y=z=0), the condition for 8 mm maximum rod diameter given by the "critical rod diameter vs. Nb content" plot (FIG. 2) of −0.4<x<0.4 is reached, etc. Accordingly, in this embodiment of the composition, the formula provides a "8 mm" critical rod diameter region since it treats the deviations as having a cumulative effect (as predicted by the GFA formula) on degrading glass-forming ability.

In turn, the region that contains bulk amorphous alloys with maximum rod diameter of at least 5 mm can be obtained by adjusting the "size" of the 4-dimensional diamond. Using the data from FIGS. 13 to 16, it is possible to obtain a formula for an alloy that can form amorphous rods at least 5 mm in diameter. This is given by the following formula (subscripts denote atomic percent):

$$Ni_{(68.6-w-x-y-z)}Cr_{8.7+w}Nb_{3+x}P_{16.5+y}B_{3.2+z}$$

where w, x, y, and z are the deviation from an "ideal composition", are in atomic percent and can be positive or negative. In such an embodiment, for alloys capable of producing amorphous rods with diameter of at least 5 mm, the equation of the 4-dimensional "diamond" would be given as follows:

$$0.21|w|+0.84|x|+0.96|y|+1.18|z|<1.05$$

Likewise, the region that contains bulk amorphous alloys with maximum rod diameter of at least 3 mm can be obtained by adjusting the "size" of the 4-dimensional diamond. Based on using the data from FIGS. 13 to 16, it is possible to obtain a formula for an alloy that can form amorphous rods at least 3 mm in diameter. This is given by the following formula (subscripts denote atomic percent):

$$Ni_{(68.6-w-x-y-z)}Cr_{8.7+w}Nb_{3+x}P_{16.5+y}B_{3.2+z}$$

where w, x, y, and z are the deviation from an "ideal composition", are in atomic percent and can be positive or negative. In such an embodiment, for alloys capable of producing amorphous rods with diameter of at least 3 mm, the equation of the 4-dimensional "diamond" would be given as follows:

$$0.21|w|+0.84|x|+0.96|y|+1.18|z|<1.89$$

In effect, the two formulae above provide a direct and precise description of certain embodiments of the composition adjusted for the critical casting diameter desired. Such a description of the glass forming ability of multi-component alloys has heretofore never been proposed or discussed in any prior art. Accordingly, such a precise and quantitative description of the "inventive" composition region for formation for bulk metallic formation has never before been possible.

Figure 13:
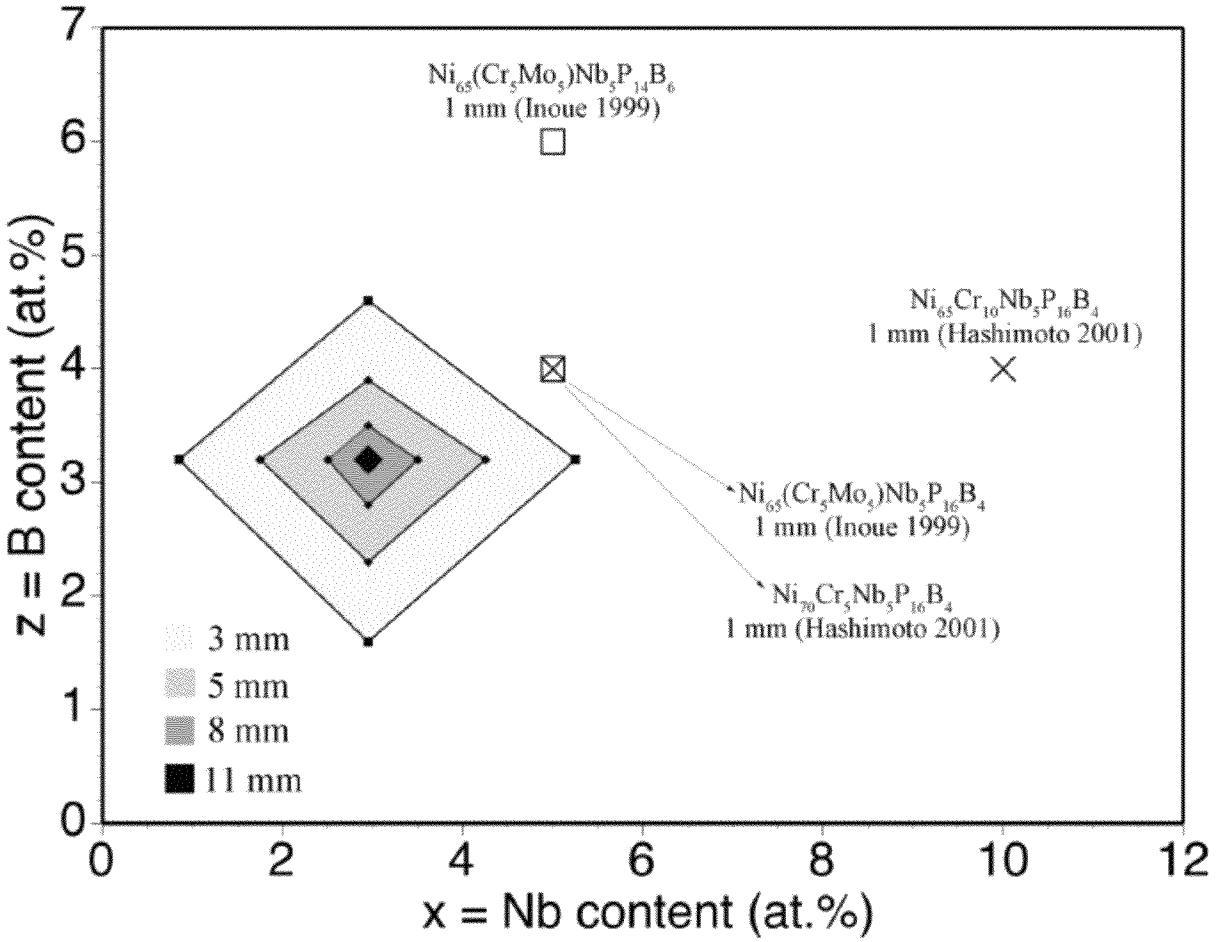
FIG. 13 provides a map of glass forming ability according to the results of experimental fitting data where Nb and B are varied in the composition. Data of the prior art (Inoue patent and Hashimoto article), in which 1-mm rods have been reported, are also superimposed in the map.
Figure 14:
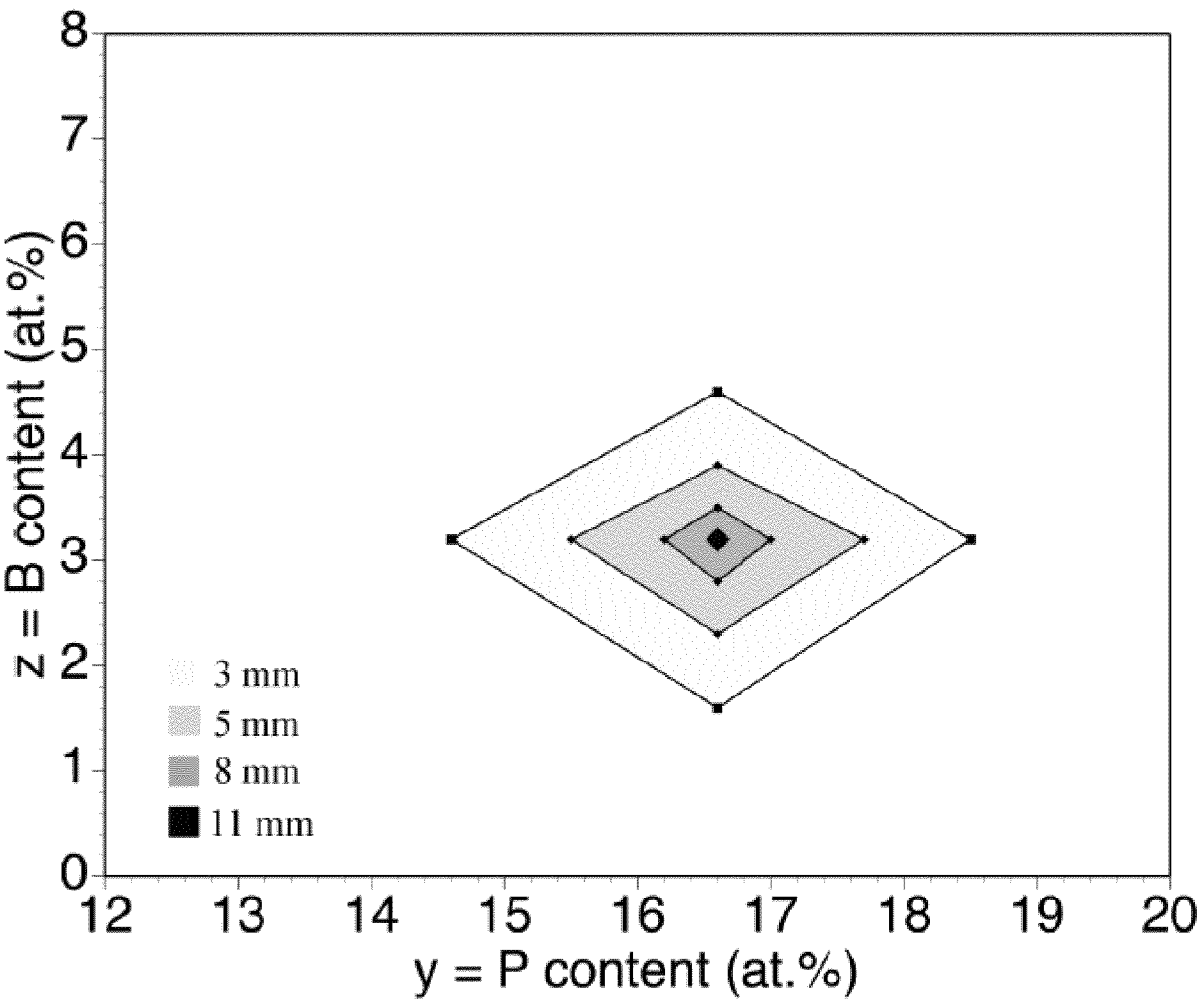
FIG. 14 provides a map of glass forming ability according to the results of experimental fitting data where P and B are varied in the composition.
Figure 15:
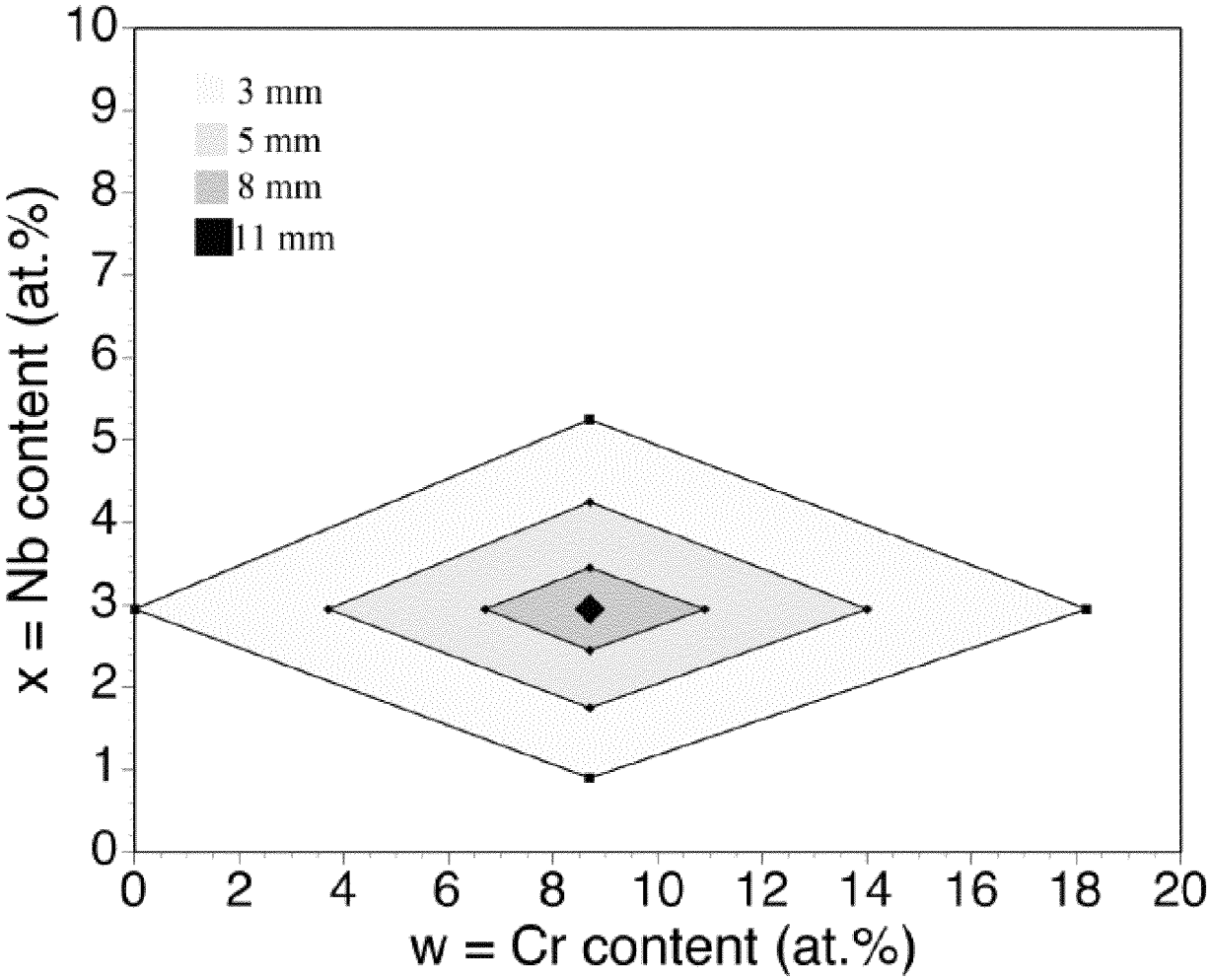
FIG. 15 provides a map of glass forming ability according to the results of experimental fitting data where Nb and Cr are varied in the composition.
Figure 16:
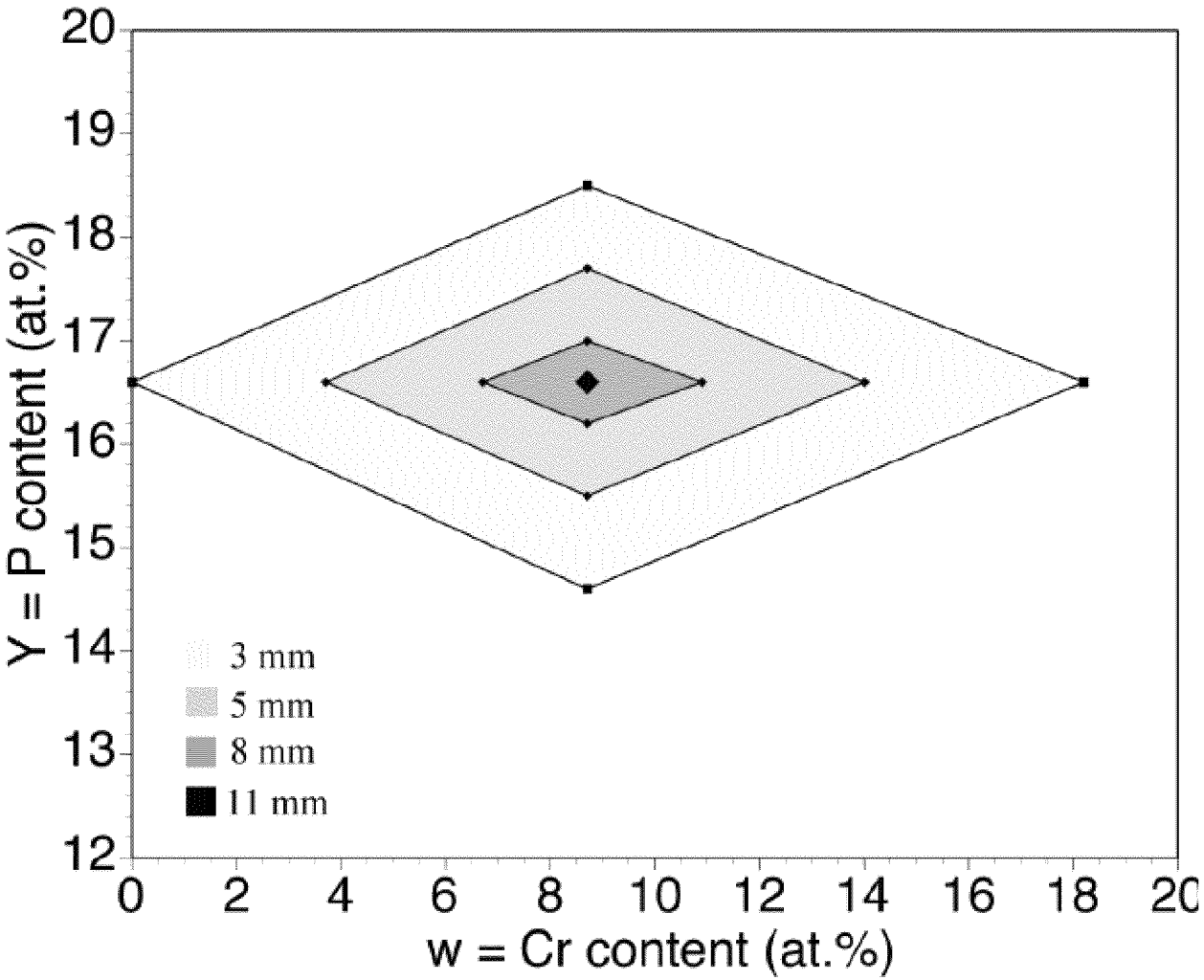
FIG. 16 provides a map of glass forming ability according to the results of experimental fitting data where Cr and P are varied in the composition.

For the purpose of comparison, FIG. 13 identifies alloy compositions in the prior art lying closest to the present inventive composition region for which bulk glass formation has been reported. Prior alloys reported by Inoue et al. (Jap. Pat. No. 2001-049407A, the disclosure of which is incorporated herein by reference) and Hashimoto et al. (H. Habazaki, H. Ukai, K. izumiya, K. Hashimoto, Materials Science and Engineering A318, 77-86 (2001), the disclosure of which is incorporated herein by reference) are shown in FIG. 13. These researchers reported bulk glass formation in 1 mm rods of the compositions shown. The alloy compositions for these reports lie outside the least restrictive area (3 mm diameter glass formation region) of the present disclosure in FIG. 13. In fact, this 2-dimensional map only depicts the prior art with respect to the compositions of B and Nb. Both previous researchers made only alloys of Cr content w=5 and 10 at. %. FIG. 13 depicts GFA of the present disclosure when Cr is refined (w=8.7 at. %). When the Cr concentration is not refined (i.e. for Cr concentrations of 5 at. % or 10 at. %), the diamonds describing the present disclosure would be significantly contracted and the prior art would lie further outside the present inventive compositions. Further, the prior reports of Inoue involved a 6 component alloy containing 5 at. % of Mo. The effect of Mo on the present inventive alloys has also been studied (as described below). In fact the addition of only 1 at. % of Mo to the refined alloy of the present disclosure results in lowering the critical rod diameter from 11.5 mm to 4 mm, while addition of 2 at. % of Mo lowers the critical rod diameter to below 1 mm. As such, addition of Mo is found to be extremely detrimental leading to severe degradation of GFA in the present disclosure.

Mechanical Property Characterization

The mechanical properties of the inventive alloys were investigated across the entire compositional range disclosed in this disclosure. The mechanical properties of interest are the yield strength, $\sigma_y$, which is the measure of the material's ability to resist non-elastic yielding, and the notch toughness, $K_Q$, which is the measure of the material's ability to resist fracture in the presence of blunt notch. Specifically, the yield strength is the stress at which the material yields plastically, and notch toughness is a measure of the work required to propagate a crack originating from a blunt notch. Another property of interest is the bending ductility of the material, $\epsilon_p$, which is the plastic strain attained by bending around a fixed bent radius. The bending ductility is a measure of the material's ability to resist fracture in bending in the absence of a notch or a pre-crack. To a large extent, these three properties determine the material mechanical performance under stress. A high $\sigma_y$ ensures that the material will be strong and hard; a high $K_Q$ ensures that the material will be tough in the presence of relatively large defects, and a high $\epsilon_p$ ensures that the material will be ductile in the absence of large defects. The plastic zone radius, $\epsilon_p$, defined as $(1/\pi)(K_Q/\sigma_y)^2$, is a measure of the critical flaw size at which catastrophic fracture is promoted. Essentially, the plastic zone radius determines the sensitivity of the material to flaws; a high $r_p$ designates a low sensitivity of the material to flaws.

Figure 17:
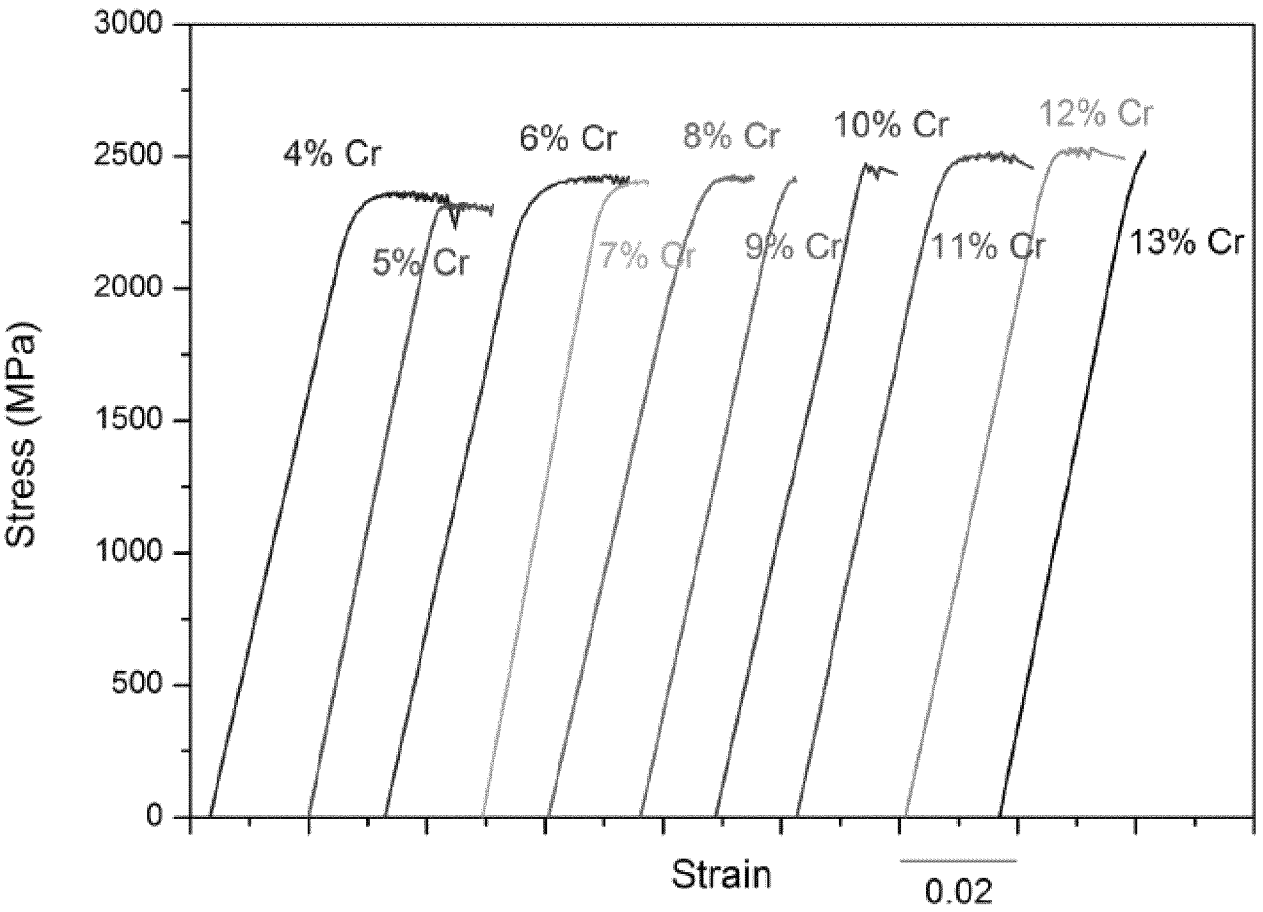
FIG. 17 provides compressive stress-strain responses of exemplary amorphous alloys $Ni_{77.5-x}Cr_xNb_3P_{16.5}B_3$ for $4 \le x \le 13$.
Figure 18:
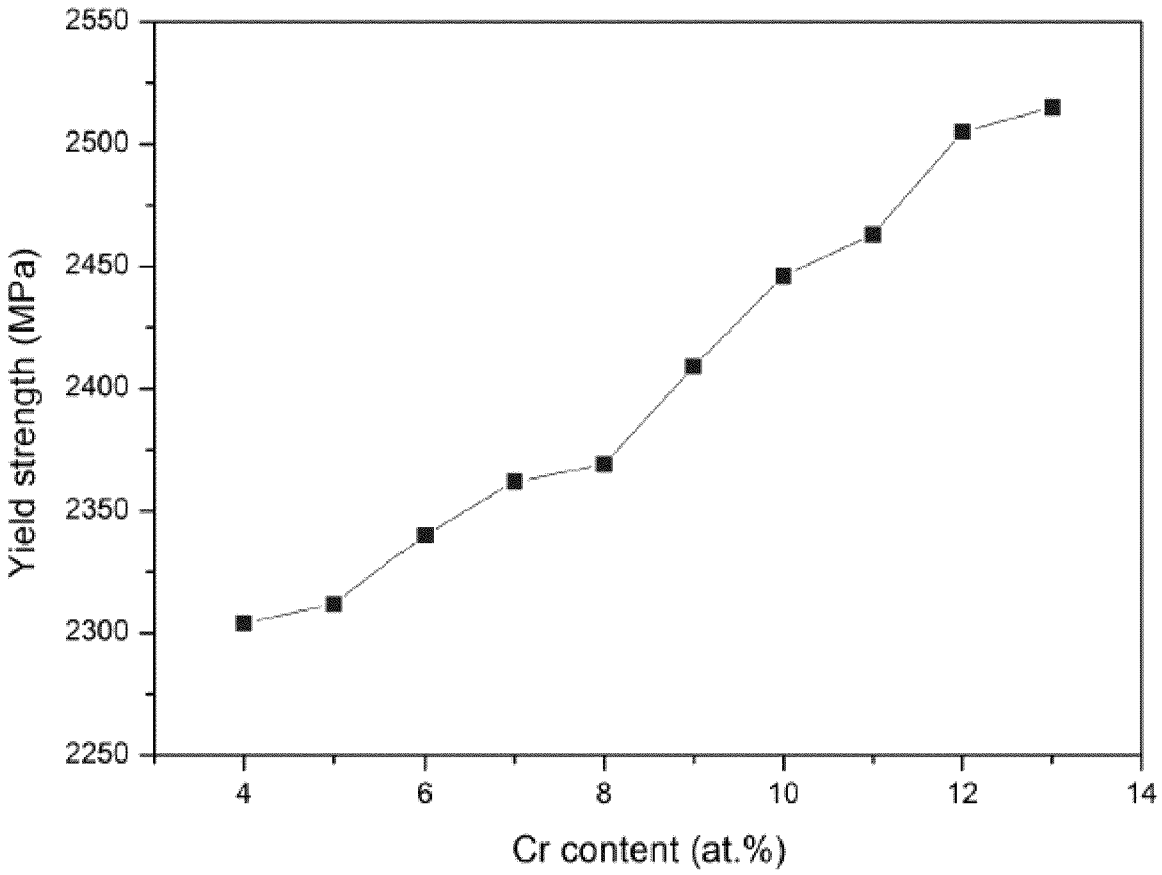
FIG. 18 provides a data plot showing the compressive yield strengths of exemplary amorphous alloys $Ni_{77.5-x}Cr_xNb_3P_{16.5}B_3$ for $4 \le x \le 13$ (Data are listed in Table 7).
Figure 19:
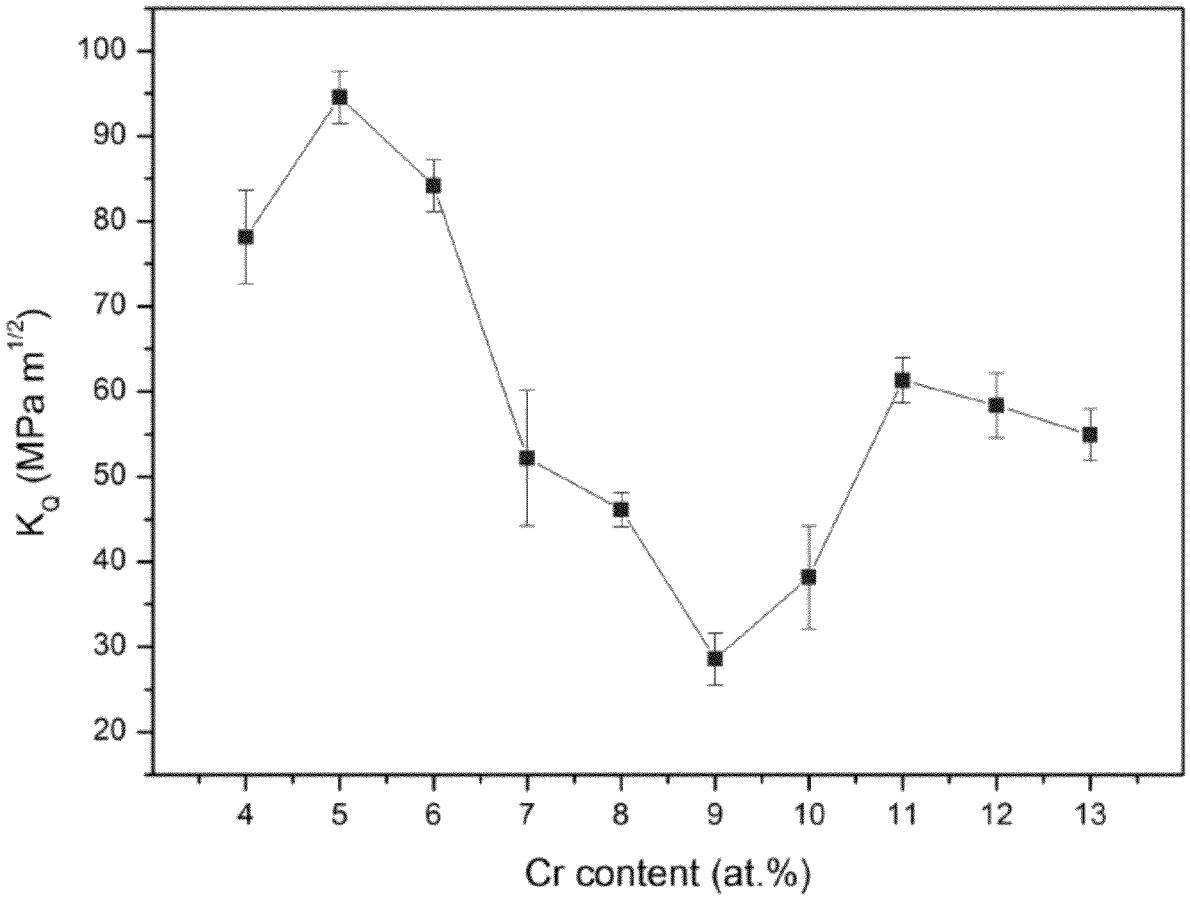
FIG. 19 provides a data plot showing the notched toughness of exemplary amorphous alloys $Ni_{77.5-x}Cr_xNb_3P_{16.5}B_3$ for $4 \le x \le 13$ (Data are listed in Table 7).
Figure 20:
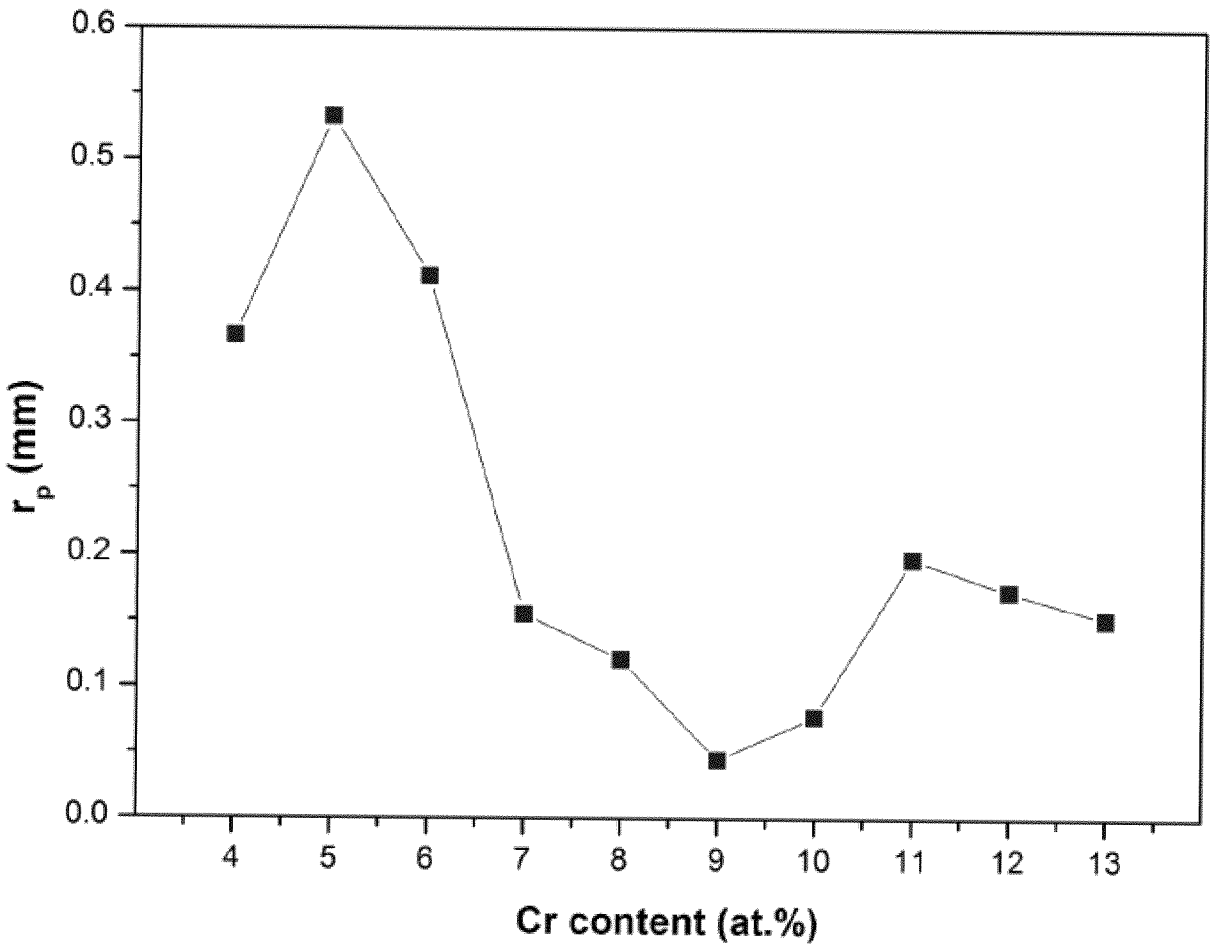
FIG. 20 provides a data plot showing the plastic zone radii of exemplary amorphous alloys $Ni_{77.5-x}Cr_xNb_3P_{16.5}B_3$ for $4 \le x \le 13$ (Data are listed in Table 7).

The compressive strength, notch toughness, and bending ductility of inventive alloys $Ni_{77.5-x}Cr_xNb_3P_{16.5}B_3$, where x is between 4 and 13, were investigated. The compressive strength is found to increase monotonically with increasing Cr content (Table 7 and FIGS. 17 and 18). The notch toughness is found to be very high (between 60 and 100 MPa $m^{1/2}$) for low Cr content (4<x<7), low (between 30 and 50 MPa $m^{1/2}$) for intermediate Cr content (7<x<11), and marginal (between 50 and 60 MPa $m^{1/2}$) for higher Cr content (11<x<13) (Table 7 and FIG. 19). Likewise, the plastic zone radius for low Cr content (4<x<7) is found to be very high (between 0.2 and 0.6 mm), but for higher Cr content (7<x<13) substantially lower (between 0.05 and 0.2 mm) (Table 7 and FIG. 20). The critical bending diameter at which a rod can be bent plastically around a 6.3 mm bent radius and the associated bending ductility are found to decrease monotonically with increasing Cr content (Table 7).

TABLE 7

Effect of increasing the Cr atomic concentration at the expense of Ni on the yield strength, notch toughness, plastic zone radius, critical bending diameter and bending ductility of the Ni—Cr—Nb—P—B system

| Example | Composition | $\sigma_y$ (MPa) | $K_Q$ (MPa $m^{1/2}$) | $r_p$ (mm) | $d_{cr}$ (mm) | $\epsilon_p$ |
|---|---|---|---|---|---|---|
| 22 | $Ni_{73.5}Cr_4Nb_3P_{16.5}B_3$ | 2304 | 78.15 ± 5.46 | 0.3665 | — | — |
| 23 | $Ni_{72.5}Cr_5Nb_3P_{16.5}B_3$ | 2312 | 94.58 ± 3.06 | 0.5327 | 1.10 | 0.175 |
| 24 | $Ni_{71.5}Cr_6Nb_3P_{16.5}B_3$ | 2340 | 84.18 ± 3.04 | 0.4119 | — | — |
| 25 | $Ni_{70.5}Cr_7Nb_3P_{16.5}B_3$ | 2362 | 52.18 ± 7.96 | 0.1554 | — | — |
| 26 | $Ni_{69.5}Cr_8Nb_3P_{16.5}B_3$ | 2369 | 46.14 ± 2.02 | 0.1207 | — | — |
| 27 | $Ni_{68.5}Cr_9Nb_3P_{16.5}B_3$ | 2409 | 28.59 ± 3.07 | 0.0448 | 0.85 | 0.135 |
| 29 | $Ni_{67.5}Cr_{10}Nb_3P_{16.5}B_3$ | 2446 | 38.18 ± 6.02 | 0.0775 | — | — |
| 30 | $Ni_{66.5}Cr_{11}Nb_3P_{16.5}B_3$ | 2463 | 61.31 ± 2.65 | 0.1972 | — | — |
| 31 | $Ni_{65.5}Cr_{12}Nb_3P_{16.5}B_3$ | 2505 | 58.37 ± 3.80 | 0.1728 | — | — |
| 32 | $Ni_{64.5}Cr_{13}Nb_3P_{16.5}B_3$ | 2515 | 54.90 ± 3.03 | 0.1517 | 0.65 | 0.103 |

Figure 21:
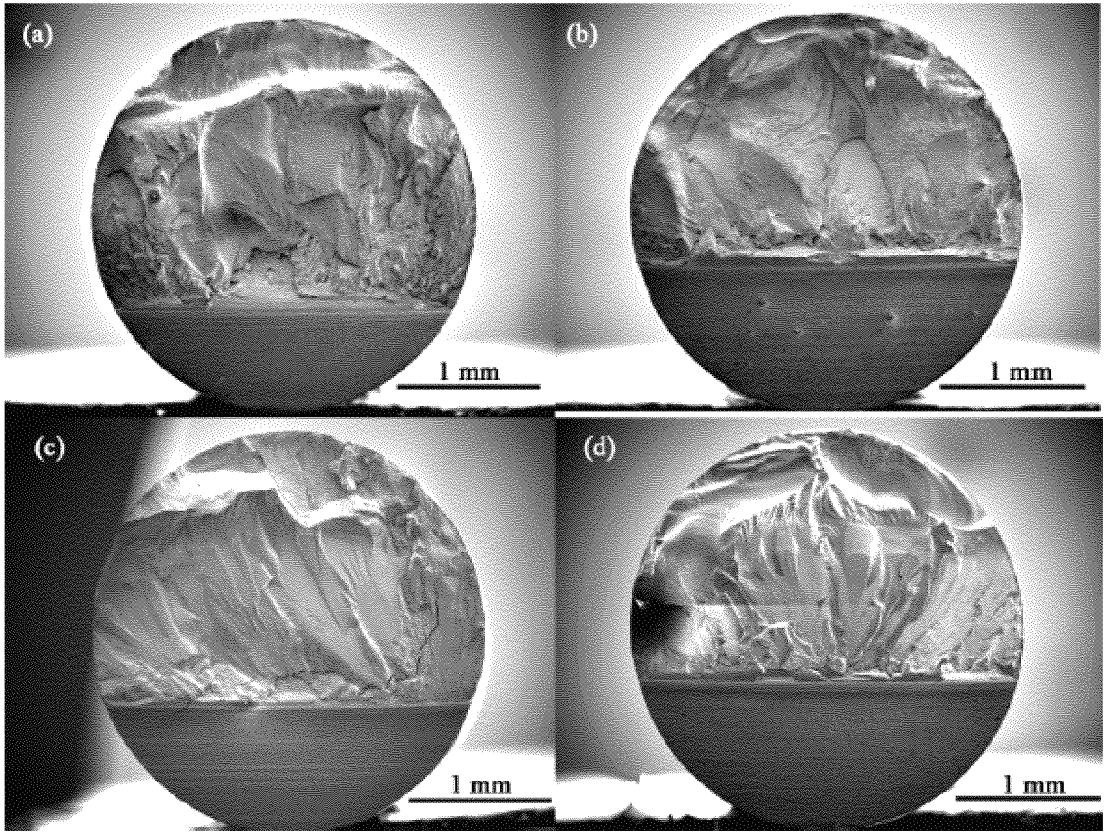
FIG. 21 provides images of fracture surfaces of pre-notched specimens of exemplary amorphous alloys $Ni_{77.5-x}Cr_xNb_3P_{16.5}B_3$: (a) x=5; (b) x=7; (c) x=10; (d) x=13.
Figure 22:
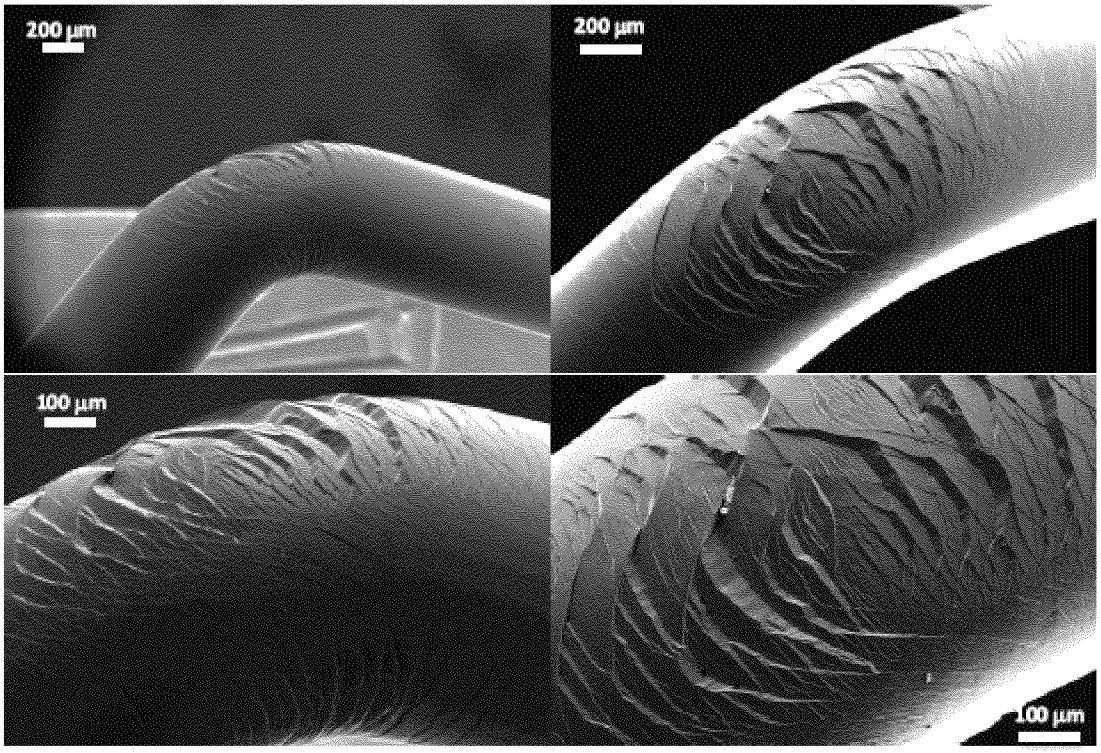
FIG. 22 provides images of a 0.6-mm wire of exemplary amorphous alloy $Ni_{72.5}Cr_5Nb_3P_{16.5}B_3$ bent plastically around a 6.3-mm bent radius.

The higher notch toughness and larger plastic zone radius of the alloys with low Cr atomic fractions is reflected in their fracture surface morphology. As shown in FIG. 21, the fracture surface morphology of alloys with atomic fractions of Cr of less than 10% exhibits "rough" highly jagged features indicating substantial plastic flow prior to fracture. By contrast, the fracture surface morphology of alloys with atomic fractions of Cr of 10% or more exhibits "sharp" cleavage-like features indicating very limited plastic flow prior to fracture. The larger bending ductility of the alloys with low Cr content is reflected in their ability to undergo significant plastic bending by generating dense shear band networks without forming cracks. As shown in FIG. 22, a 0.6 mm diameter wire made of an alloy with atomic fraction of Cr of 5% is capable of undergoing plastic bending around a 6.3 mm bent diameter forming a 90° angle without fracturing. The engineering significance of the higher toughness, larger plastic zone radius, and larger bending ductility is that engineering hardware could fail gracefully by plastic bending rather than fracture catastrophically under an applied stress.

Figure 23:
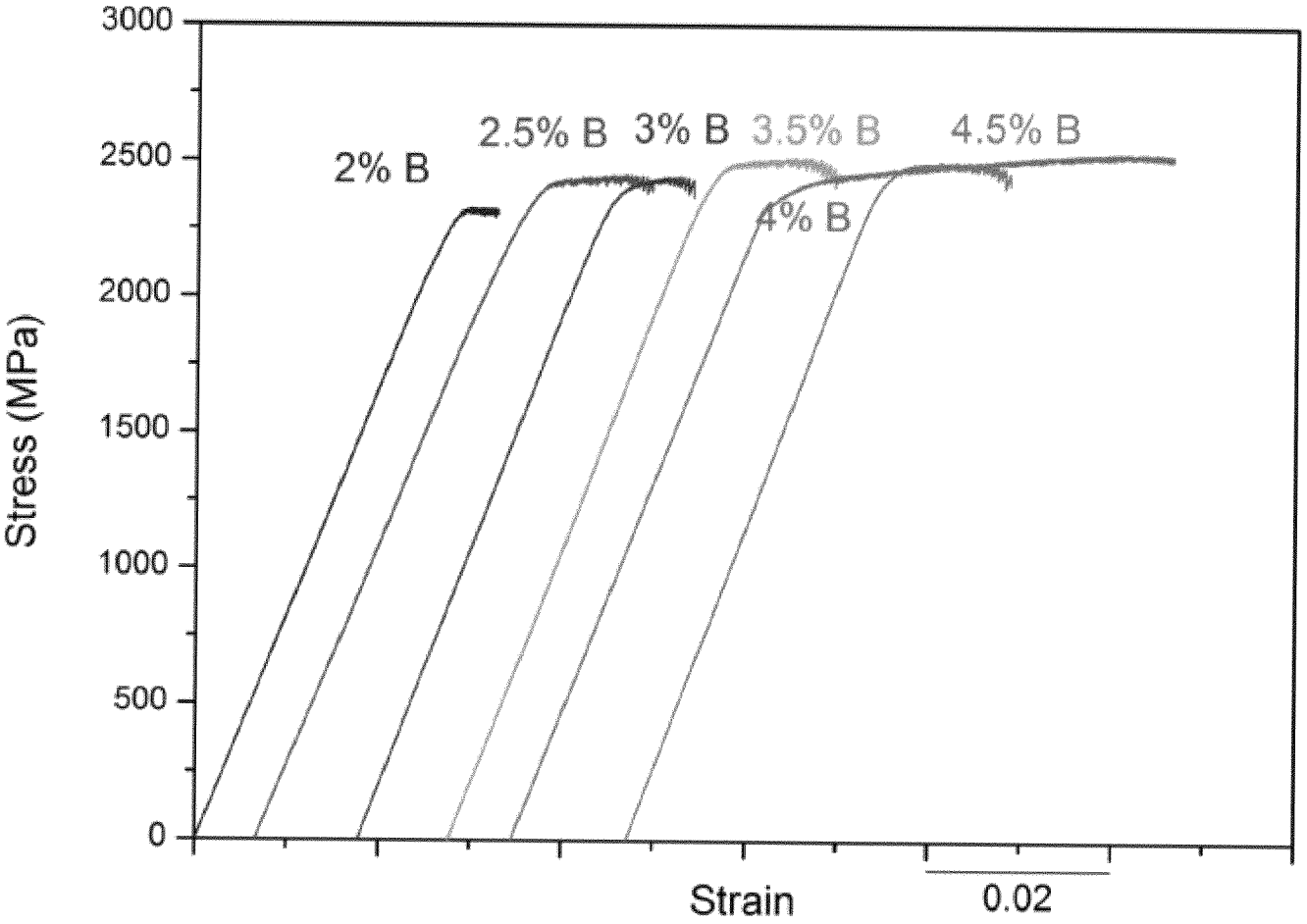
FIG. 23 provides compressive stress-strain responses of exemplary amorphous alloys $Ni_{69}Cr_{8.5}Nb_3P_{19.5-x}B_x$ for $2 \le x \le 4.5$.
Figure 24:
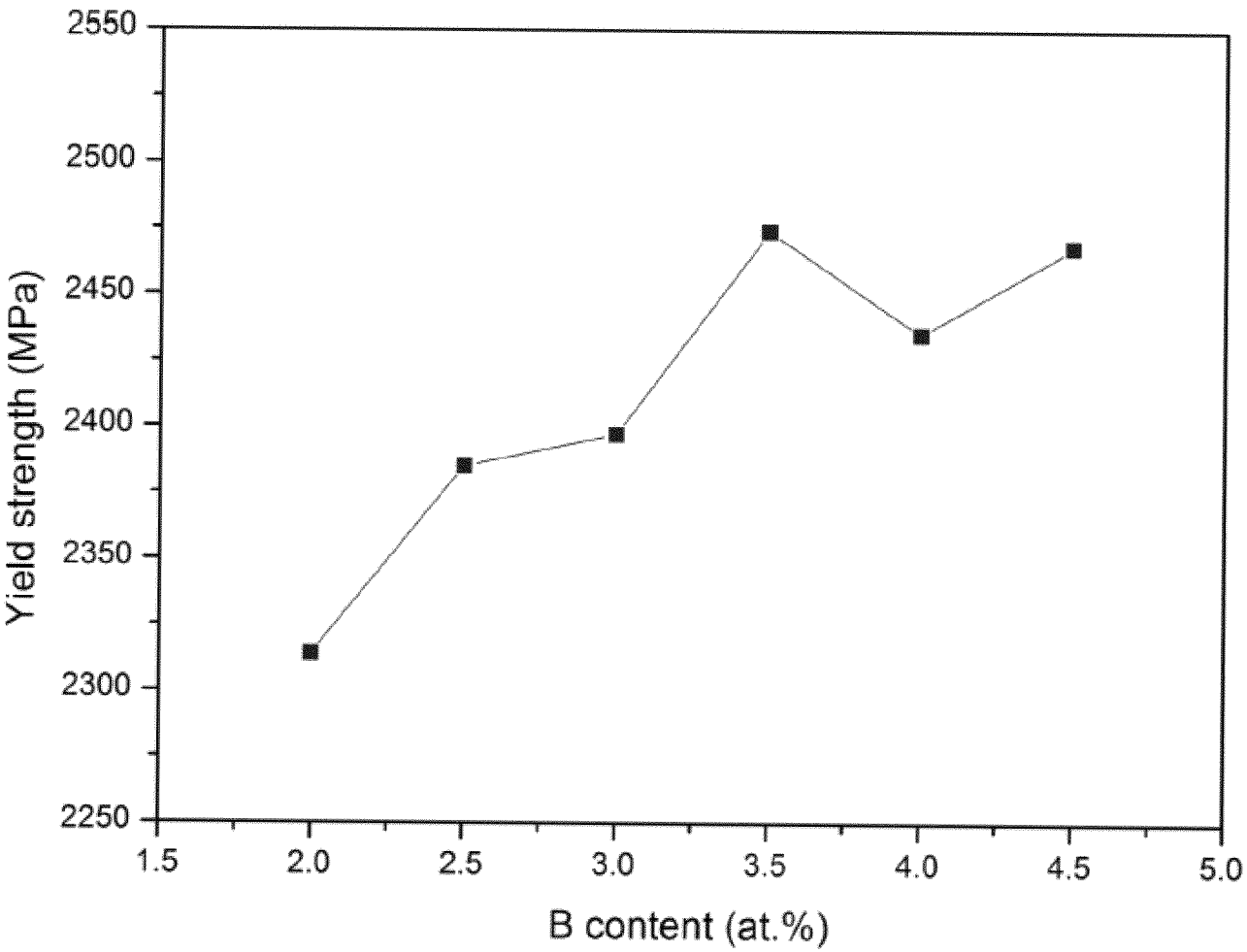
FIG. 24 provides a data plot showing the compressive yield strengths of exemplary amorphous alloys $Ni_{69}Cr_{8.5}Nb_3P_{19.5-x}B_x$ for $2 \le x \le 4.5$ (Data are listed in Table 8).
Figure 25:
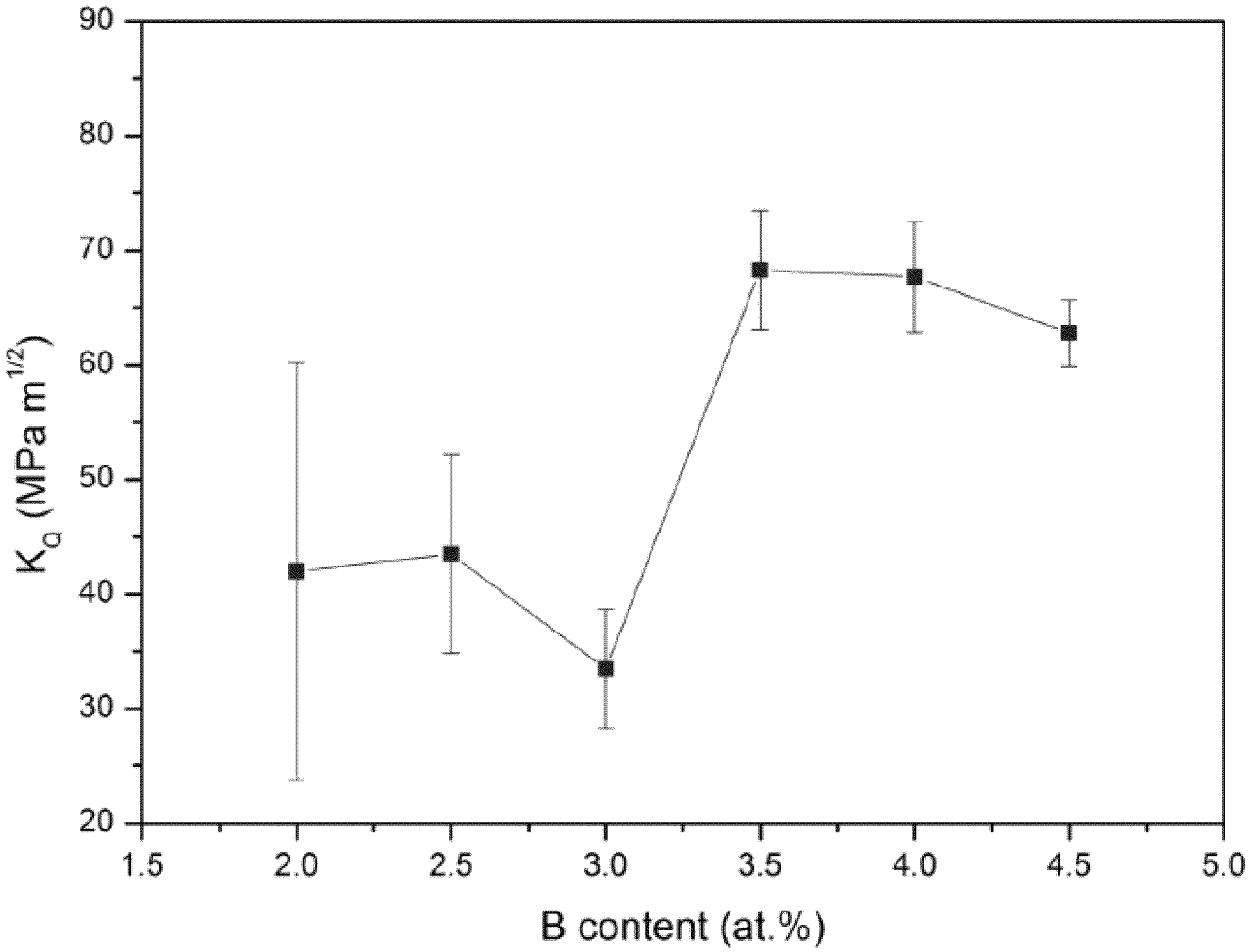
FIG. 25 provides a data plot showing the notched toughness of exemplary amorphous alloys $Ni_{69}Cr_{8.5}Nb_3P_{19.5-x}B_x$ for $2 \le x \le 4.5$ (Data are listed in Table 8).
Figure 26:
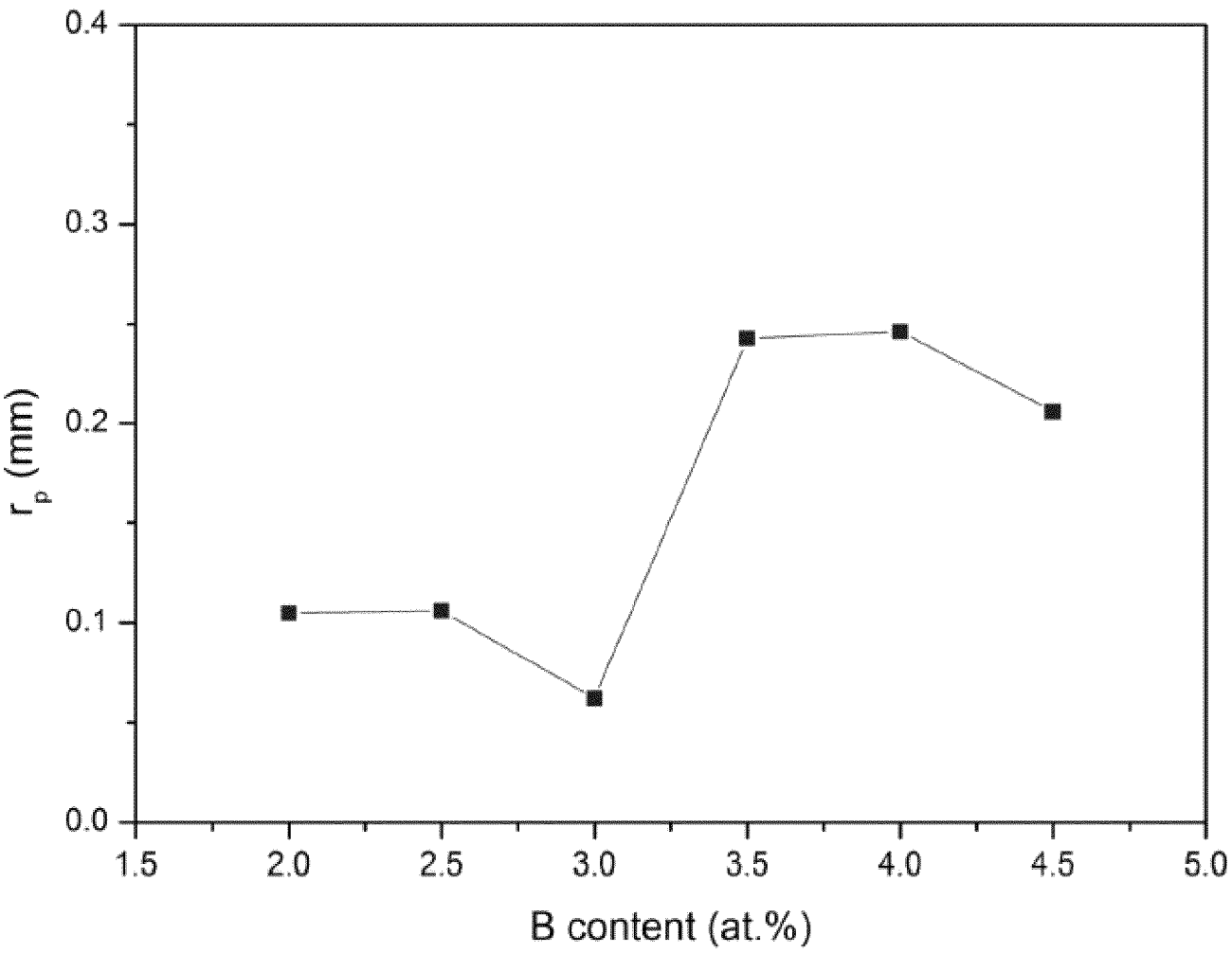
FIG. 26 provides a data plot showing the plastic zone radii of exemplary amorphous alloys $Ni_{69}Cr_{8.5}Nb_3P_{19.5-x}B_x$ for $2 \le x \le 4.5$ (Data are listed in Table 8).

The compressive strength, notch toughness, and bending ductility of inventive alloys $Ni_{69}Cr_{8.5}Nb_3P_{19.5-x}B_x$, where x is between 2 and 4.5, were investigated. The compressive strength is found to increase fairly monotonically with increasing B content (Table 8 and FIGS. 23 and 24). The notch toughness is found to be modest (between 30 and 45 MPa $m^{1/2}$) for low B content (2<x<3), and fairly high (between 60 and 70 MPa m'12) for higher B content (3<x<4.5) (Table 8 and FIG. 25). Likewise, the plastic zone radius for low B content (2<x<3) is found to be relatively low (about 0.1 mm), but for higher B content (3<x<4.5) is substantially higher (between 0.2 and 0.25 mm) (FIG. 26). The critical bending diameter at which a rod can be bent plastically around a 6.3 mm bent radius and the associated bending ductility are found to remain constant with increasing B content (Table 8).

TABLE 8

Effect of increasing B atomic concentration at the expense of P on the yield strength, notch toughness, plastic zone radius, critical bending diameter and bending ductility of the Ni—Cr—Nb—P—B system

| Example | Composition | $\sigma_y$ (MPa) | $K_Q$ (MPa $m^{1/2}$) | $r_p$ (mm) | $d_{cr}$ (mm) | $\epsilon_p$ |
|---|---|---|---|---|---|---|
| 2 | $Ni_{69}Cr_{8.5}Nb_3P_{17.5}B_2$ | 2314 | 42.0 ± 18.2 | 0.1049 | 0.85 | 0.135 |
| 3 | $Ni_{69}Cr_{8.5}Nb_3P_{17}B_{2.5}$ | 2385 | 43.5 ± 8.7 | 0.1059 | — | — |
| 5 | $Ni_{69}Cr_{8.5}Nb_3P_{16.5}B_3$ | 2397 | 33.5 ± 5.2 | 0.0622 | 0.85 | 0.135 |
| 6 | $Ni_{69}Cr_{8.5}Nb_3P_{16}B_{3.5}$ | 2474 | 68.3 ± 5.2 | 0.2426 | — | — |
| 8 | $Ni_{68.5}Cr_{8.5}Nb_3P_{16}B_4$ | 2435 | 67.7 ± 4.8 | 0.2461 | 0.85 | 0.135 |
| 9 | $Ni_{68.5}Cr_{8.5}Nb_3P_{15.5}B_{4.5}$ | 2468 | 62.8 ± 2.9 | 0.2061 | — | — |

Figure 27:
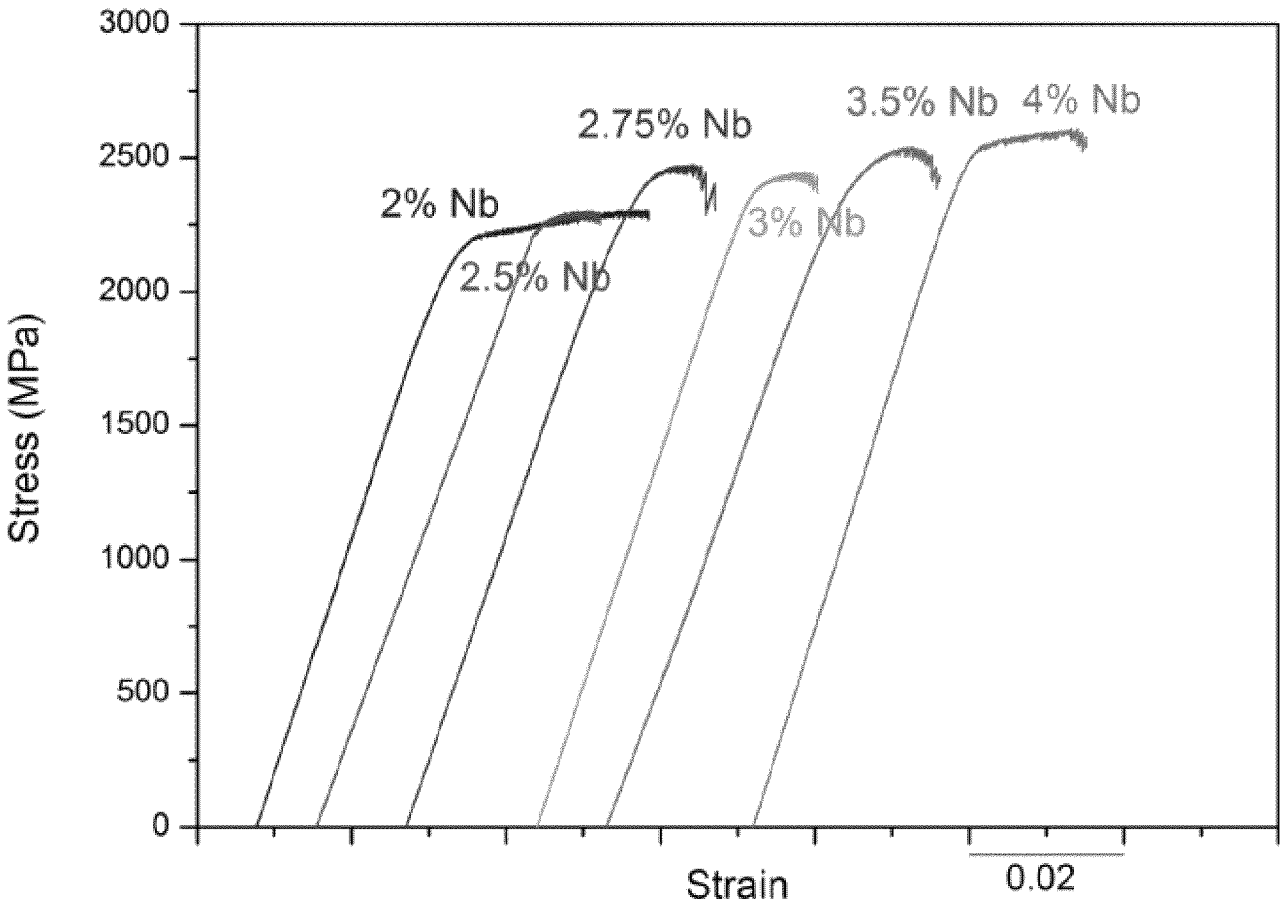
FIG. 27 provides compressive stress-strain responses of exemplary amorphous alloys $Ni_{69}Cr_{11.5-x}Nb_xP_{16.5}B_3$ for $2 \le x \le 4$.
Figure 28:
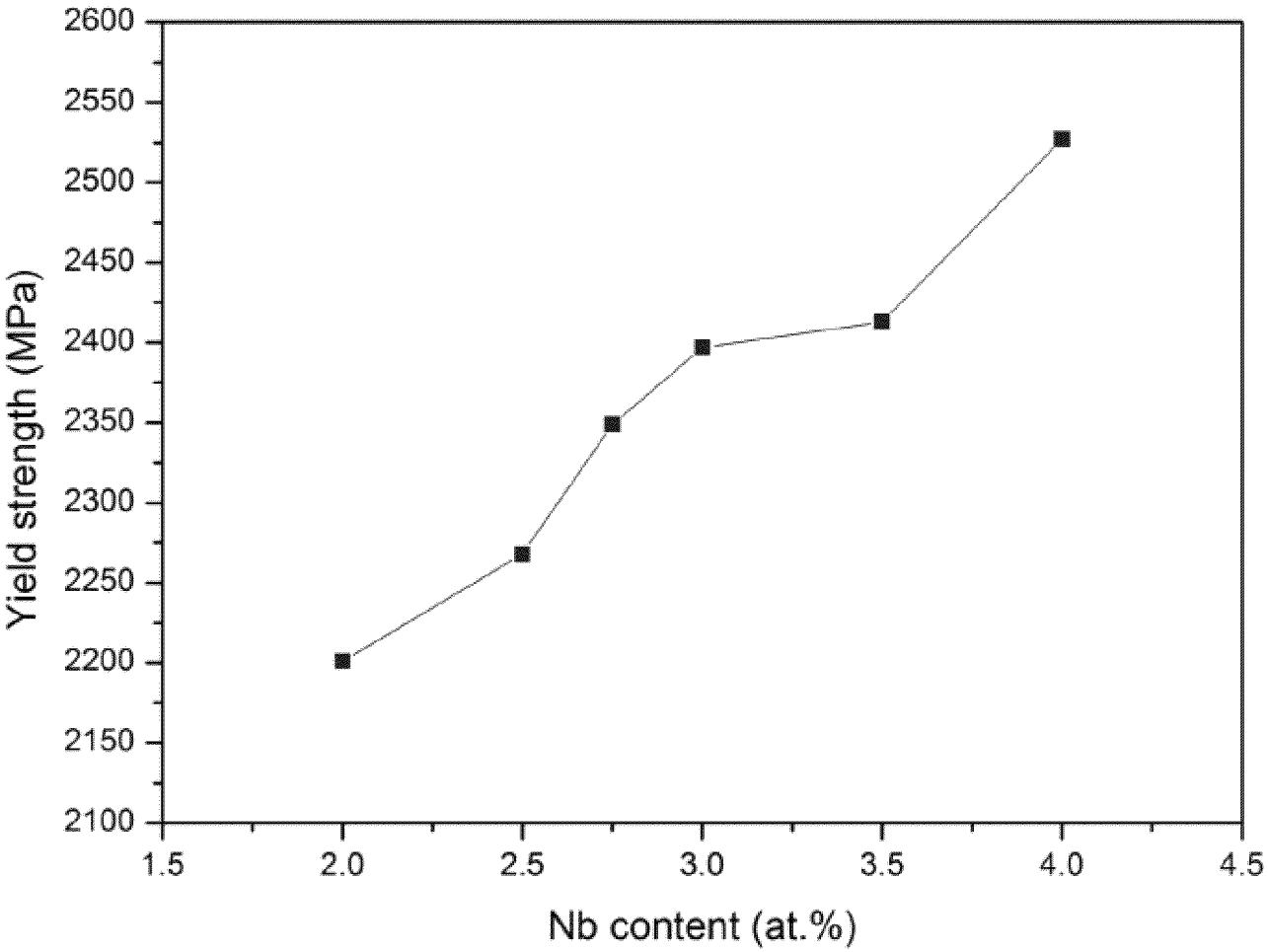
FIG. 28 provides a data plot showing the compressive yield strengths of exemplary amorphous alloys $Ni_{69}Cr_{11.5-x}Nb_xP_{16.5}B_3$ for $2 \le x \le 4$ (Data are listed in Table 9).
Figure 29:
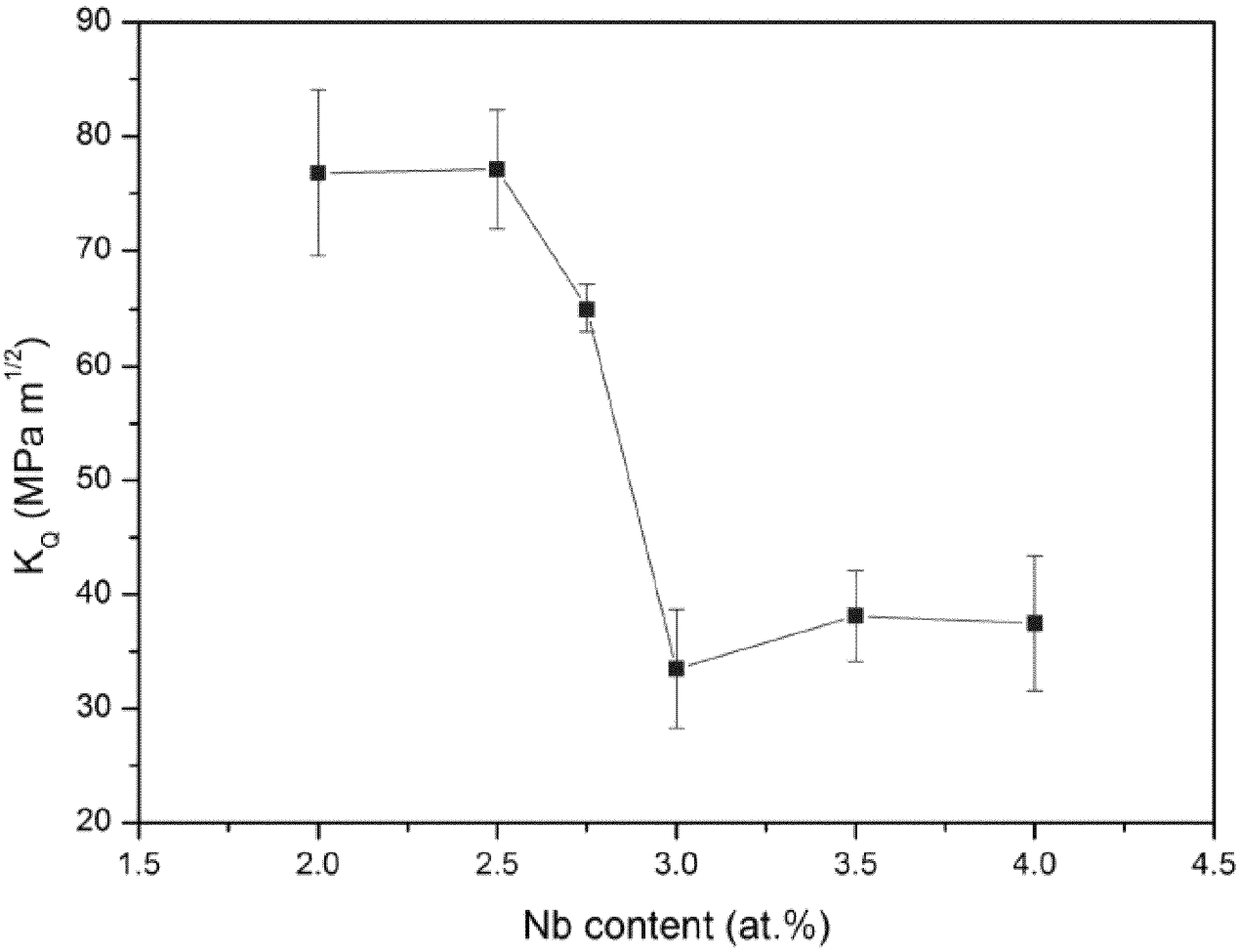
FIG. 29 provides a data plot showing the notched toughness of exemplary amorphous alloys $Ni_{69}Cr_{11.5-x}Nb_xP_{16.5}B_3$ for $2 \le x \le 4$ (Data are listed in Table 9).
Figure 30:
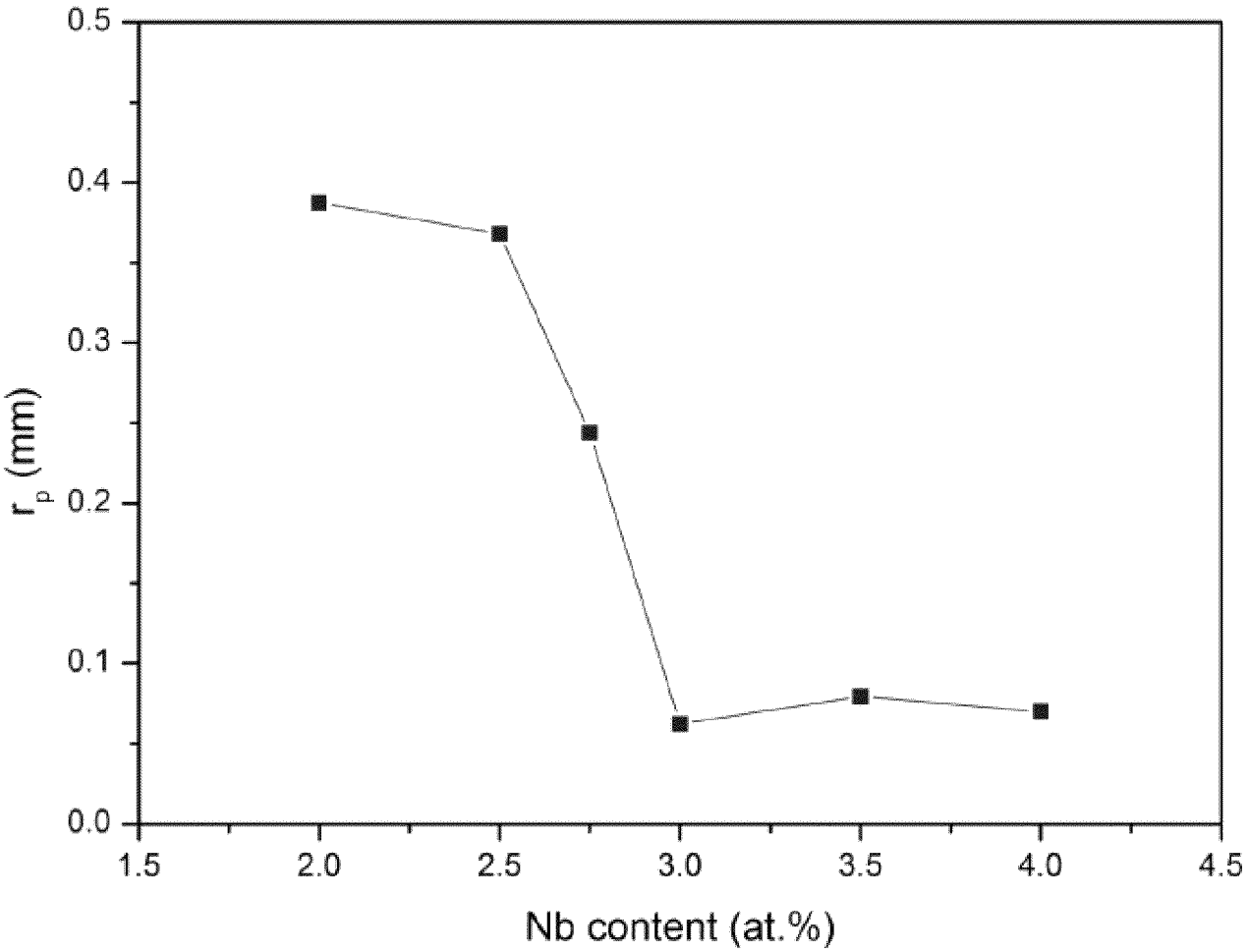
FIG. 30 provides a data plot showing the plastic zone radii of exemplary amorphous alloys $Ni_{69}Cr_{11.5-x}Nb_xP_{16.5}B_3$ for $2 \le x \le 4$ (Data are listed in Table 9).

The compressive strength, notch toughness, and bending ductility of inventive alloys $Ni_{69}Cr_{11.5-x}Nb_xP_{16.5}B_3$, where x is between 2 and 4, were investigated. The compressive strength is found to increase fairly monotonically with increasing Nb content (Table 9 and FIGS. 27 and 28). The notch toughness is found to be very high (between 65 and 80 MPa $m^{1/2}$) for low Nb content (2<x<2.75), but considerably lower (between 30 and 40 MPa $m^{1/2}$) for higher Nb content (3<x<4) (Table 9 and FIG. 29). Likewise, the plastic zone radius for low Nb content (2<x<2.5) is found to be large (about 0.4 mm), but for higher Nb content (3<x<4) is considerably lower (between 0.05 and 0.1 mm) (Table 9 and FIG. 30). The critical bending diameter at which a rod can be bent plastically around a 6.3 mm bent radius and the associated bending ductility are found to decrease monotonically with increasing Nb content (Table 9).

TABLE 9

Effect of increasing Nb atomic concentration at the expense of Cr on the yield strength, notch toughness, plastic zone radius, critical bending diameter and bending ductility of the Ni—Cr—Nb—P—B system

| Example | Composition | $\sigma_y$ (MPa) | $K_Q$ (MPa $m^{1/2}$) | $r_p$ (mm) | $d_{cr}$ (mm) | $\epsilon_p$ |
|---|---|---|---|---|---|---|
| 14 | $Ni_{69}Cr_{9.5}Nb_2P_{16.5}B_3$ | 2201 | 76.8 ± 7.3 | 0.3876 | 1.00 | 0.159 |
| 15 | $Ni_{69}Cr_9Nb_{2.5}P_{16.5}B_3$ | 2268 | 77.1 ± 5.2 | 0.3679 | — | — |
| 16 | $Ni_{69}Cr_{8.75}Nb_{2.75}P_{16.5}B_3$ | 2349 | 65.0 ± 2.0 | 0.2437 | — | — |
| 5 | $Ni_{69}Cr_{8.5}Nb_3P_{16.5}B_3$ | 2397 | 33.5 ± 5.2 | 0.0622 | 0.85 | 0.135 |
| 18 | $Ni_{69}Cr_8Nb_{3.5}P_{16.5}B_3$ | 2413 | 38.1 ± 4.0 | 0.0794 | — | — |
| 19 | $Ni_{69}Cr_{7.5}Nb_4P_{16.5}B_3$ | 2527 | 37.5 ± 5.9 | 0.0701 | 0.70 | 0.111 |

Figure 31:
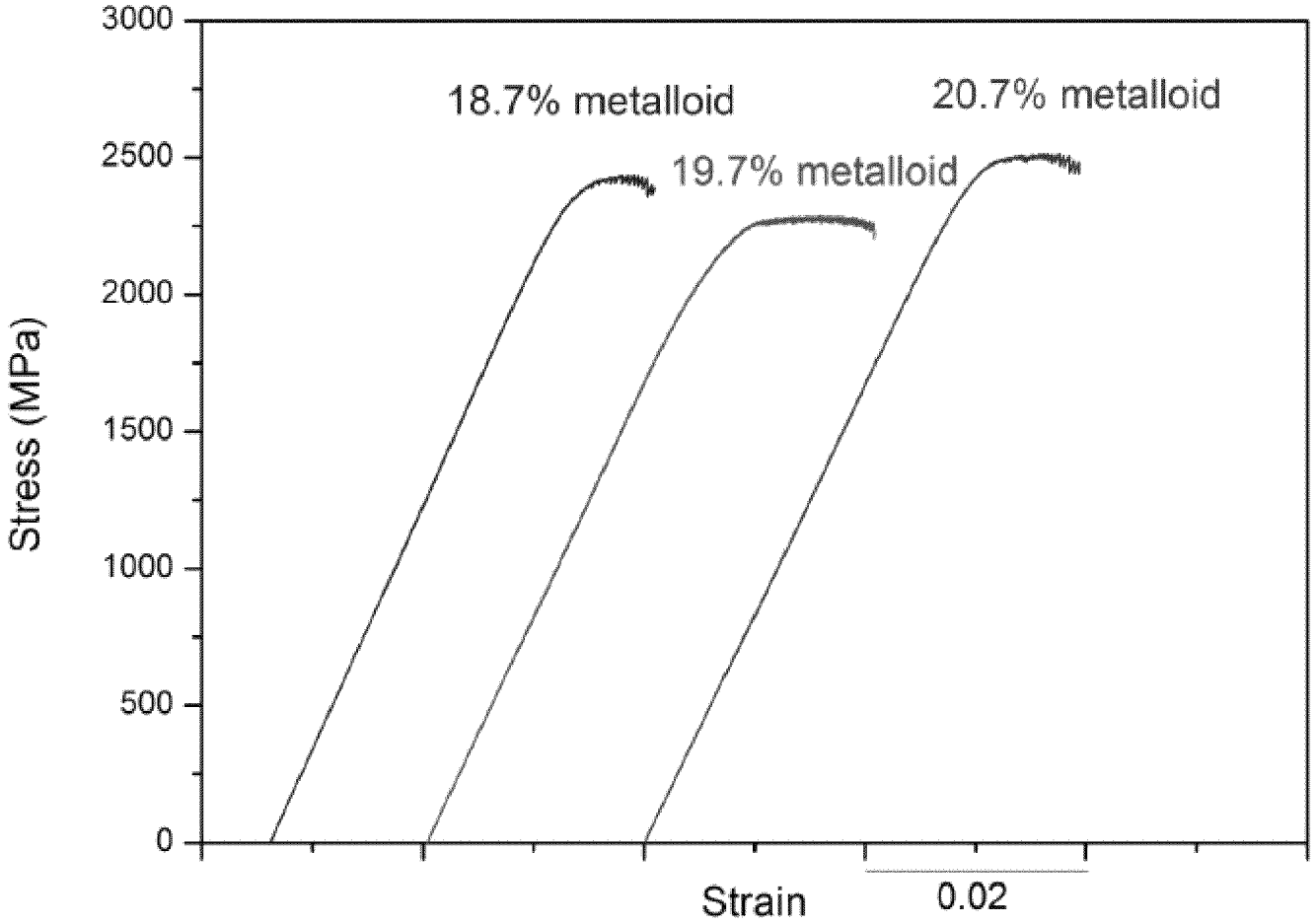
FIG. 31 provides compressive stress-strain responses of exemplary amorphous alloys $(Ni_{0.8541}Cr_{0.1085}Nb_{0.0374})_{100-x}(P_{0.8376}B_{0.1624})_x$ for x between 18.7 and 20.7.
Figure 32:
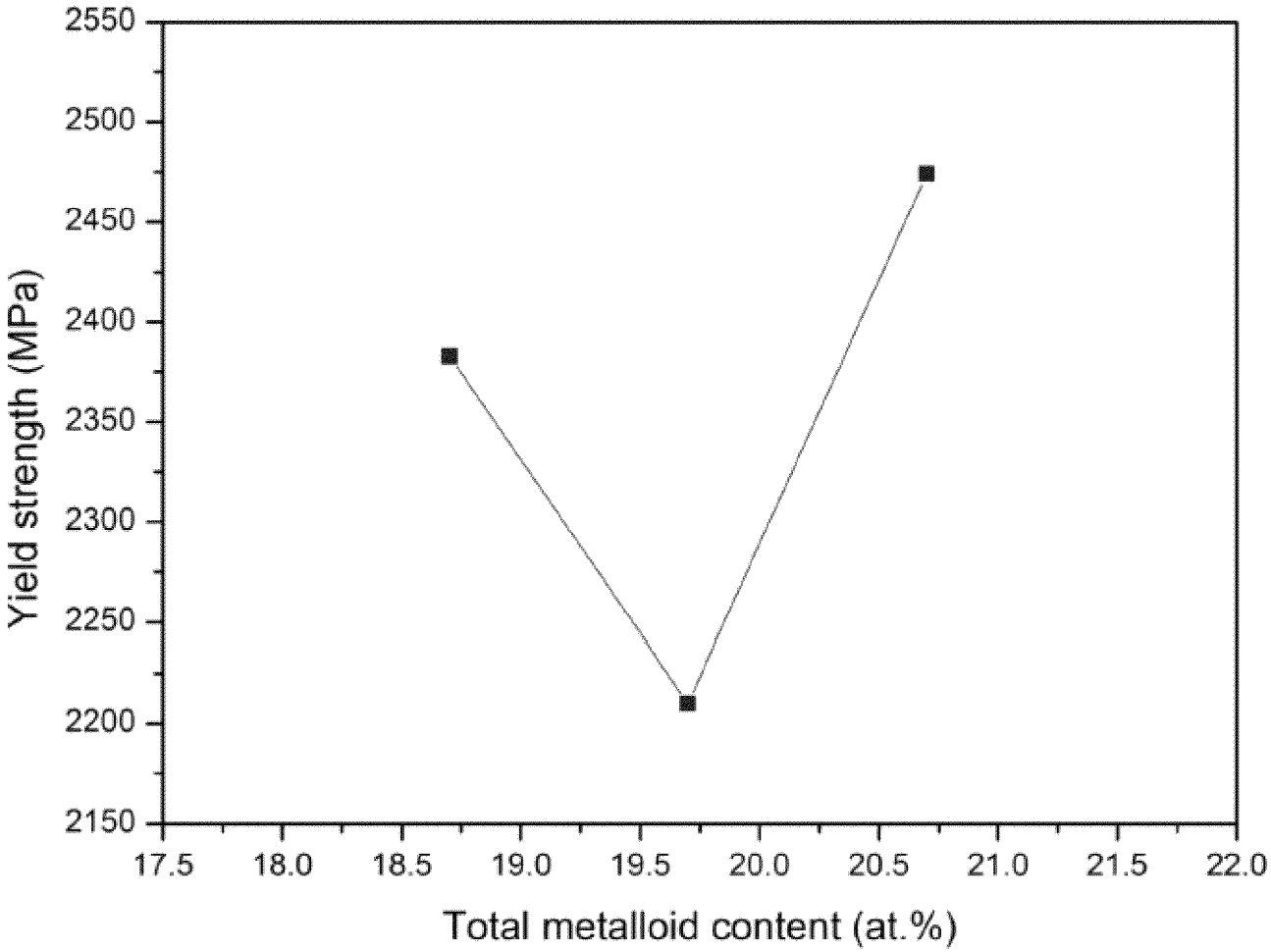
FIG. 32 provides a data plot showing the compressive yield strengths of exemplary amorphous alloys $(Ni_{0.8541}Cr_{0.1085}Nb_{0.0374})_{100-x}(P_{0.8376}B_{0.1624})_x$ for x between 18.7 and 20.7 (Data are listed in Table 10).
Figure 33:
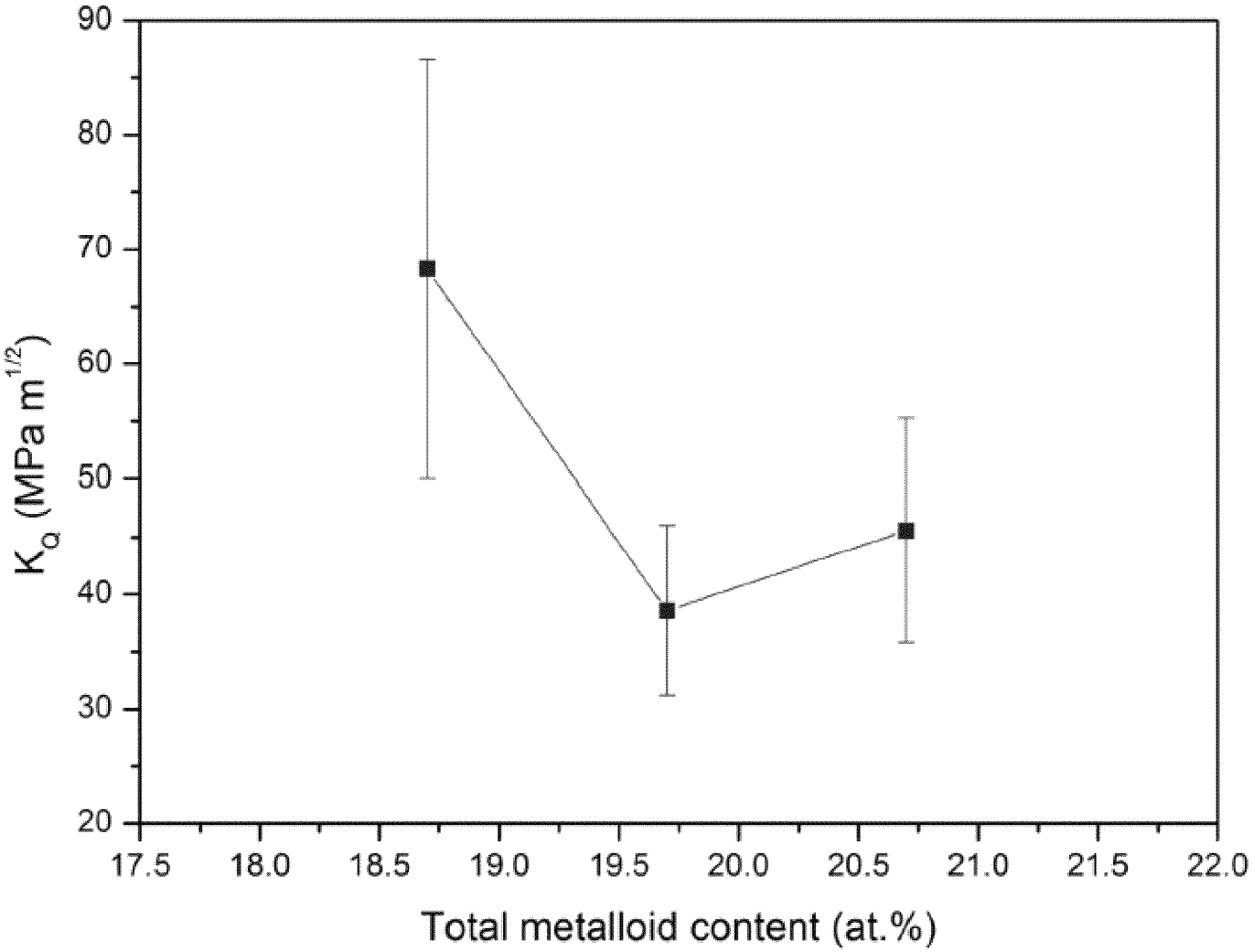
FIG. 33 provides a data plot showing the notched toughness of exemplary amorphous alloys $(Ni_{0.8541}Cr_{0.1085}Nb_{0.0374})_{100-x}(P_{0.8376}B_{0.1624})_x$ for x between 18.7 and 20.7 (Data are listed in Table 10).
Figure 34:
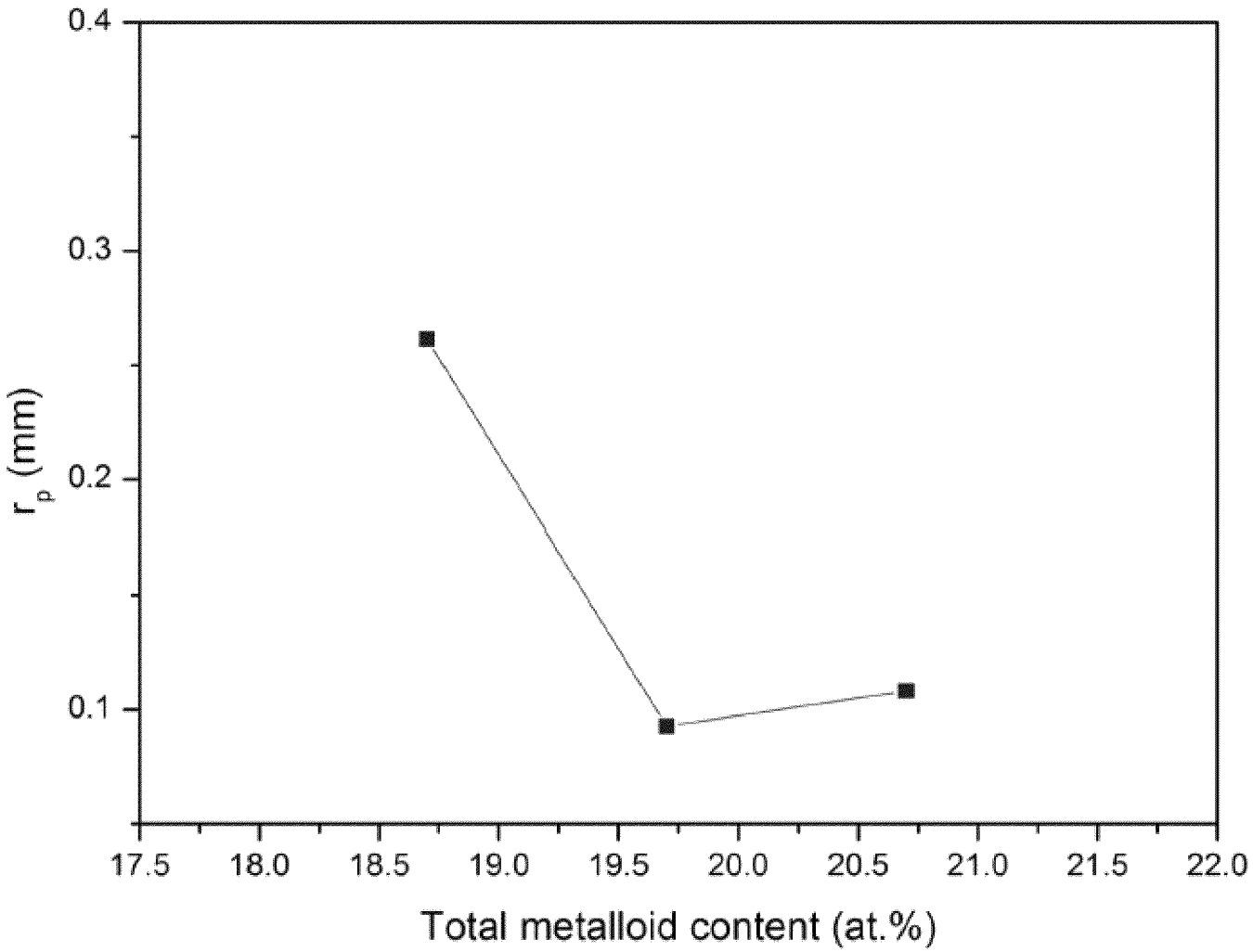
FIG. 34 provides a data plot showing the plastic zone radii of exemplary amorphous alloys $(Ni_{0.8541}Cr_{0.1085}Nb_{0.0374})_{100-x}(P_{0.8376}B_{0.1624})_x$ for x between 18.7 and 20.7 (Data are listed in Table 10).

The compressive strength, notch toughness, and bending ductility of inventive alloys $(Ni_{0.8541}Cr_{0.1085}Nb_{0.0374})_{100-x}(P_{0.8376}B_{0.1624})_x$, where x is between 18.7 and 20.7, were investigated. The compressive strength is found to decrease slightly for the intermediate x of 19.7% (Table 10 and FIGS. 31 and 32). On the other hand, the notch toughness and plastic zone radius are found to decrease slightly with increasing metalloid content (Table 10 and FIGS. 33 and 34). Lastly, the critical bending diameter at which a rod can be bent plastically around a 6.3 mm bent radius and the associated bending ductility are found to remain constant with increasing metalloid content (Table 10).

TABLE 10

Effect of increasing the metalloid concentration at the expense of metals on the yield strength, notch toughness, plastic zone radius, critical bending diameter and bending ductility of the Ni—Cr—Nb—P—B system

| Example | Composition | $\sigma_y$ (MPa) | $K_Q$ (MPa $m^{1/2}$) | $r_p$ (mm) | $d_{cr}$ (mm) | $\epsilon_p$ |
|---|---|---|---|---|---|---|
| 34 | $Ni_{69.45}Cr_{8.81}Nb_{3.04}P_{15.66}B_{3.04}$ | 2383 | 68.3 ± 18.3 | 0.2615 | 0.75 | 0.119 |
| 36 | $Ni_{68.6}Cr_{8.7}Nb_3P_{16.5}B_{3.2}$ | 2210 | 38.6 ± 7.4 | 0.0927 | 0.75 | 0.119 |
| 38 | $Ni_{67.75}Cr_{8.59}Nb_{2.96}P_{17.34}B_{3.36}$ | 2474 | 45.6 ± 9.7 | 0.1081 | 0.75 | 0.119 |

Density and Ultrasonic Measurements

Figure 35:
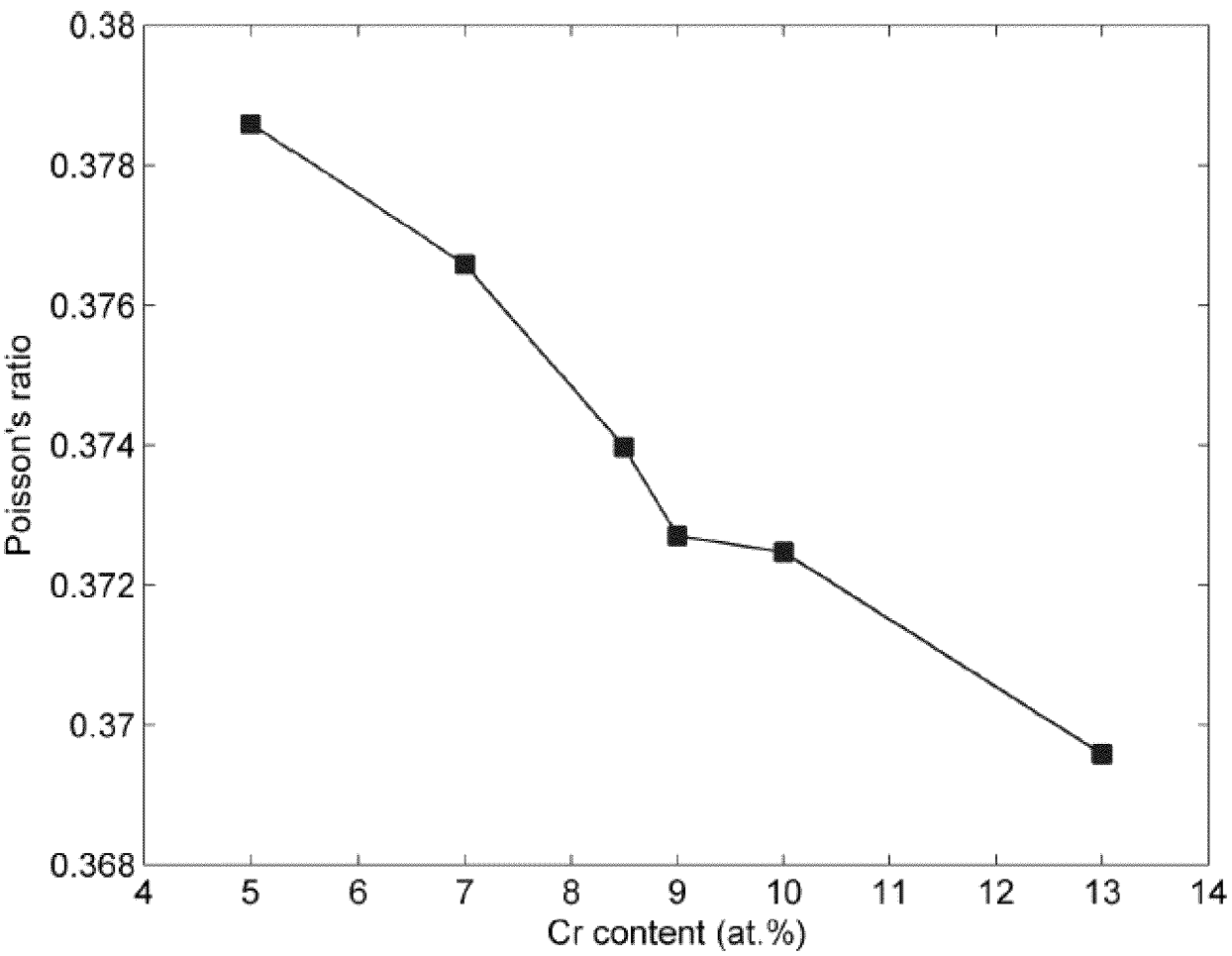
FIG. 35 provides a data plot showing the Poisson's ratio of exemplary amorphous alloys $Ni_{77.5-x}Cr_xNb_3P_{16.5}B_3$ for $4 \le x \le 13$ (Data are listed in Table 11).

The density, shear, bulk, and Young's moduli, and Poisson's ratio of inventive alloys $Ni_{77.5-x}Cr_xNb_3P_{16.5}B_3$, where x is between 5 and 13, were measured (Table 11). The Poisson's ratio is plotted against the Cr content (FIG. 35), and is shown to decrease monotonically and near-linearly with increasing Cr content, consistent with a decreasing toughness and ductility.

TABLE 11

Effect of increasing Cr atomic concentration at the expense of Ni on the shear modulus, bulk modulus, Young's modulus, Poisson's ratio and density of the Ni—Cr—Nb—P—B system

| Example | Composition | G (GPa) | B (GPa) | E (GPa) | Poisson's ratio | Density (g/cc) |
|---|---|---|---|---|---|---|
| 23 | $Ni_{72.5}Cr_5Nb_3P_{16.5}B_3$ | 48.91 | 185.12 | 134.85 | 0.37859 | 8.0122 |
| 25 | $Ni_{70.5}Cr_7Nb_3P_{16.5}B_3$ | 49.80 | 185.64 | 137.14 | 0.37658 | 7.9772 |
| 5 | $Ni_{69}Cr_{8.5}Nb_3P_{16.5}B_3$ | 49.91 | 181.38 | 137.15 | 0.37397 | 7.8566 |
| 27 | $Ni_{68.5}Cr_9Nb_3P_{16.5}B_3$ | 51.01 | 183.35 | 140.04 | 0.37270 | 7.8977 |
| 29 | $Ni_{67.5}Cr_{10}Nb_3P_{16.5}B_3$ | 52.24 | 187.40 | 143.40 | 0.37247 | 8.0480 |
| 32 | $Ni_{64.5}Cr_{13}Nb_3P_{16.5}B_3$ | 52.88 | 185.09 | 144.84 | 0.36958 | 7.9278 |

Figure 36:
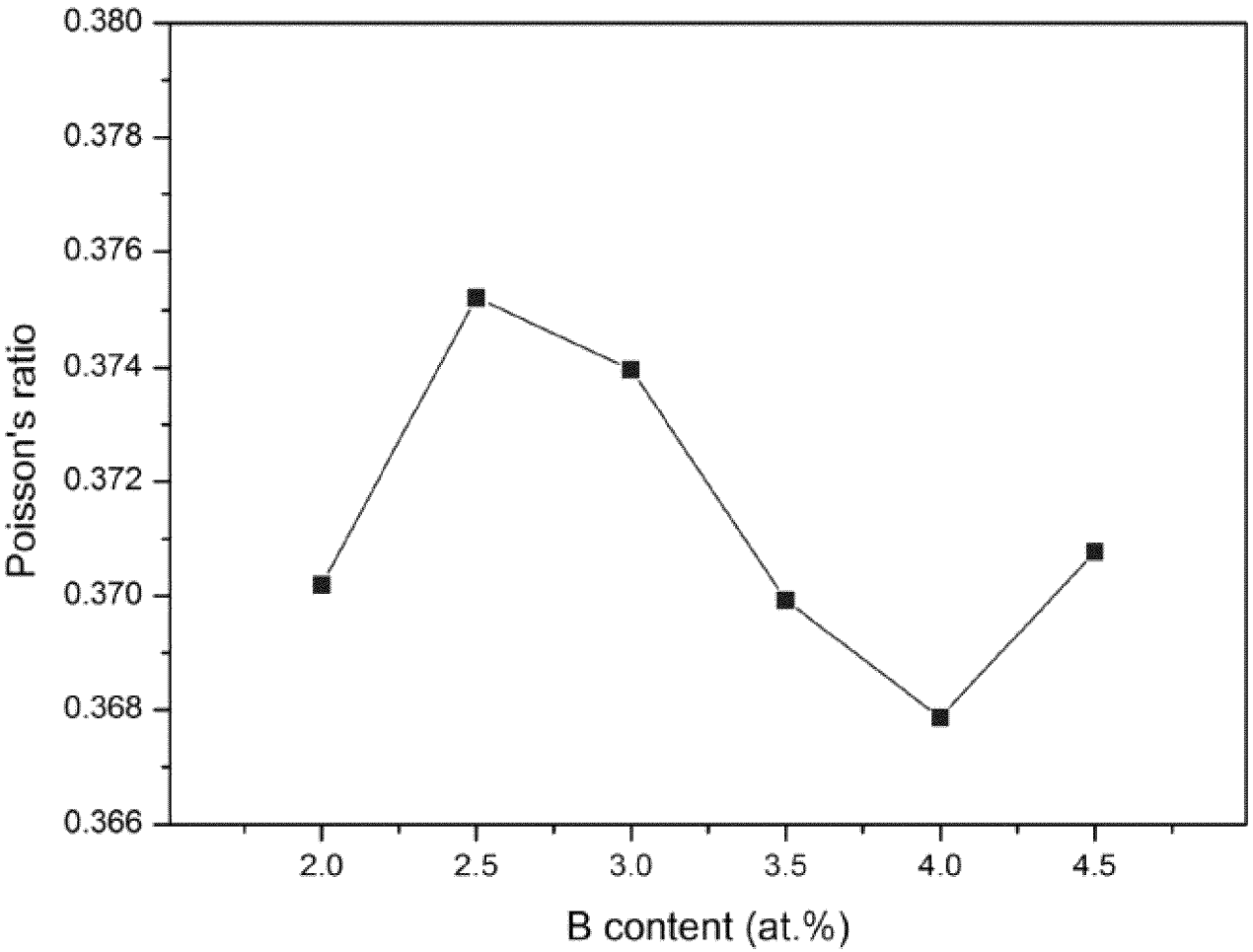
FIG. 36 provides a data plot showing the Poisson's ratio of exemplary amorphous alloys $Ni_{69}Cr_{8.5}Nb_3P_{19.5-x}B_x$ for $2 \le x \le 4.5$ (Data are listed in Table 12).

The density, shear, bulk, and Young's moduli, and Poisson's ratio of inventive alloys $Ni_{69}Cr_{8.5}Nb_3P_{19.5-x}B_x$, where x is between 2 and 4.5, were measured (Table 12). The Poisson's ratio is plotted against the B content (FIG. 36), and is shown to attain a maximum at 2.5% B and a minimum at 4% B.

TABLE 12

Effect of increasing B atomic concentration at the expense of P on the shear modulus, bulk modulus, Young's modulus, Poisson's ratio and density of the Ni—Cr—Nb—P—B system

| Example | Composition | G (GPa) | B (GPa) | E (GPa) | Poisson's ratio | Density (g/cc) |
|---|---|---|---|---|---|---|
| 2 | $Ni_{69}Cr_{8.5}Nb_3P_{17.5}B_2$ | 51.42 | 180.95 | 140.92 | 0.37020 | 7.9292 |
| 3 | $Ni_{69}Cr_{8.5}Nb_3P_{17}B_{2.5}$ | 50.56 | 185.74 | 139.06 | 0.37522 | 7.9580 |
| 5 | $Ni_{69}Cr_{8.5}Nb_3P_{16.5}B_3$ | 49.91 | 181.38 | 137.15 | 0.37397 | 7.8566 |
| 6 | $Ni_{69}Cr_{8.5}Nb_3P_{16}B_{3.5}$ | 52.38 | 183.91 | 143.53 | 0.36993 | 8.0357 |
| 8 | $Ni_{68.5}Cr_{8.5}Nb_3P_{16}B_4$ | 52.08 | 179.72 | 142.48 | 0.36786 | 7.9011 |
| 9 | $Ni_{68.5}Cr_{8.5}Nb_3P_{15.5}B_{4.5}$ | 52.88 | 186.97 | 144.97 | 0.37077 | 7.9764 |

Figure 37:
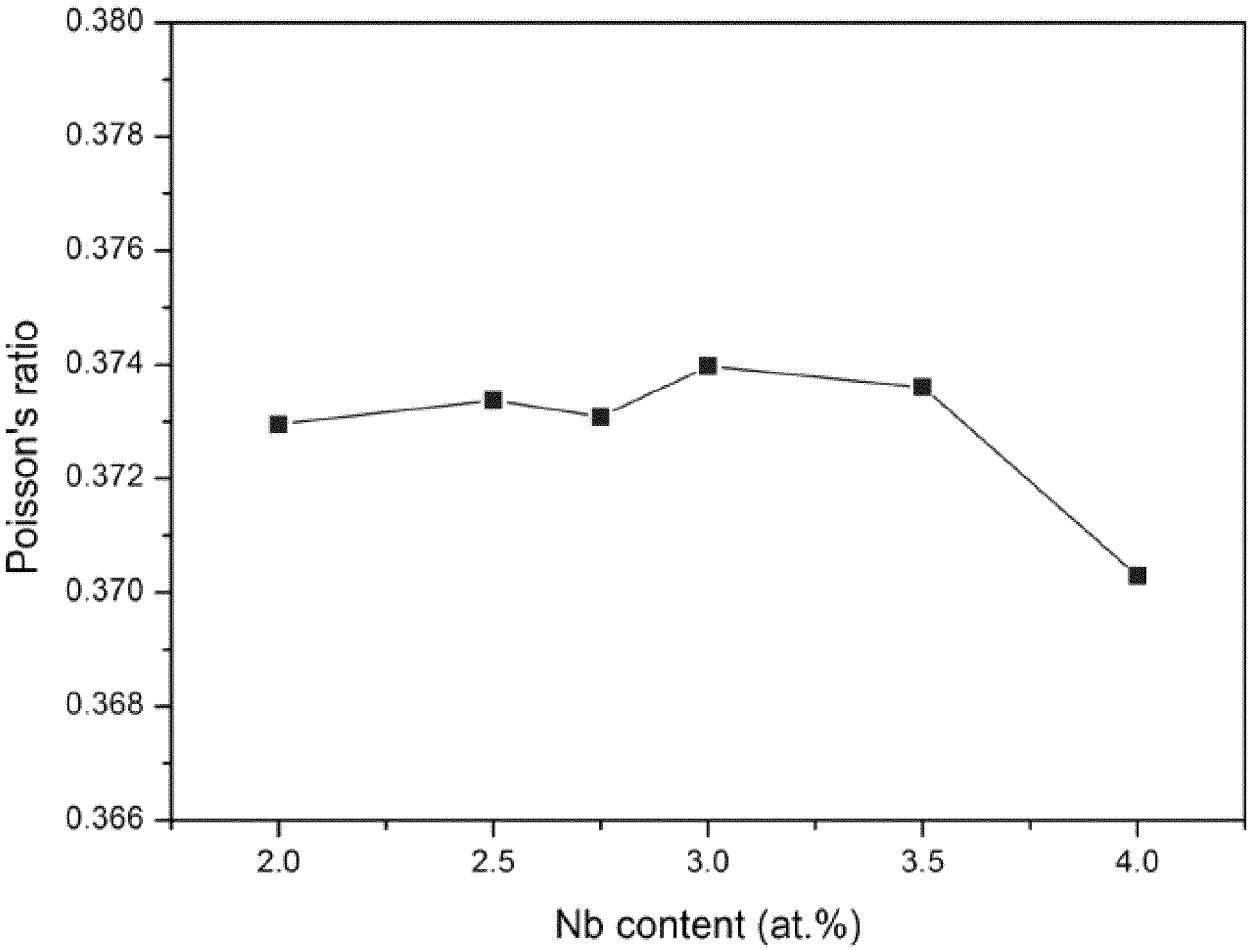
FIG. 37 provides a data plot showing the Poisson's ratio of exemplary amorphous alloys $Ni_{69}Cr_{11.5-x}Nb_xP_{16.5}B_3$ for $2 \le x \le 4$ (Data are listed in Table 13).

The density, shear, bulk, and Young's moduli, and Poisson's ratio of inventive alloys $Ni_{69}Cr_{11.5-x}Nb_xP_{16.5}B_3$, where x is between 2 and 4, were measured (Table 13). The Poisson's ratio is plotted against the Nb content (FIG. 37), and is shown to remain relatively high for Nb content of less than about 3-3.5%, and to drop sharply for higher Nb contents.

TABLE 13

Effect of increasing Nb atomic concentration at the expense of Cr on the shear modulus, bulk modulus, Young's modulus, Poisson's ratio and density of the Ni—Cr—Nb—P—B system

| Example | Composition | G (GPa) | B (GPa) | E (GPa) | Poisson's ratio | Density (g/cc) |
|---|---|---|---|---|---|---|
| 14 | $Ni_{69}Cr_{9.5}Nb_2P_{16.5}B_3$ | 51.53 | 185.59 | 141.50 | 0.37295 | 7.7341 |
| 15 | $Ni_{69}Cr_9Nb_{2.5}P_{16.5}B_3$ | 50.96 | 184.20 | 139.96 | 0.37337 | 7.9677 |
| 16 | $Ni_{69}Cr_{8.75}Nb_{2.75}P_{16.5}B_3$ | 50.52 | 182.19 | 138.74 | 0.37308 | 7.8539 |
| 5 | $Ni_{69}Cr_{8.5}Nb_3P_{16.5}B_3$ | 49.91 | 181.38 | 137.15 | 0.37397 | 7.8566 |
| 18 | $Ni_{69}Cr_8Nb_{3.5}P_{16.5}B_3$ | 51.27 | 185.73 | 140.86 | 0.37360 | 7.8868 |
| 19 | $Ni_{69}Cr_{7.5}Nb_4P_{16.5}B_3$ | 52.14 | 183.63 | 142.90 | 0.37029 | 7.8826 |

Figure 38:
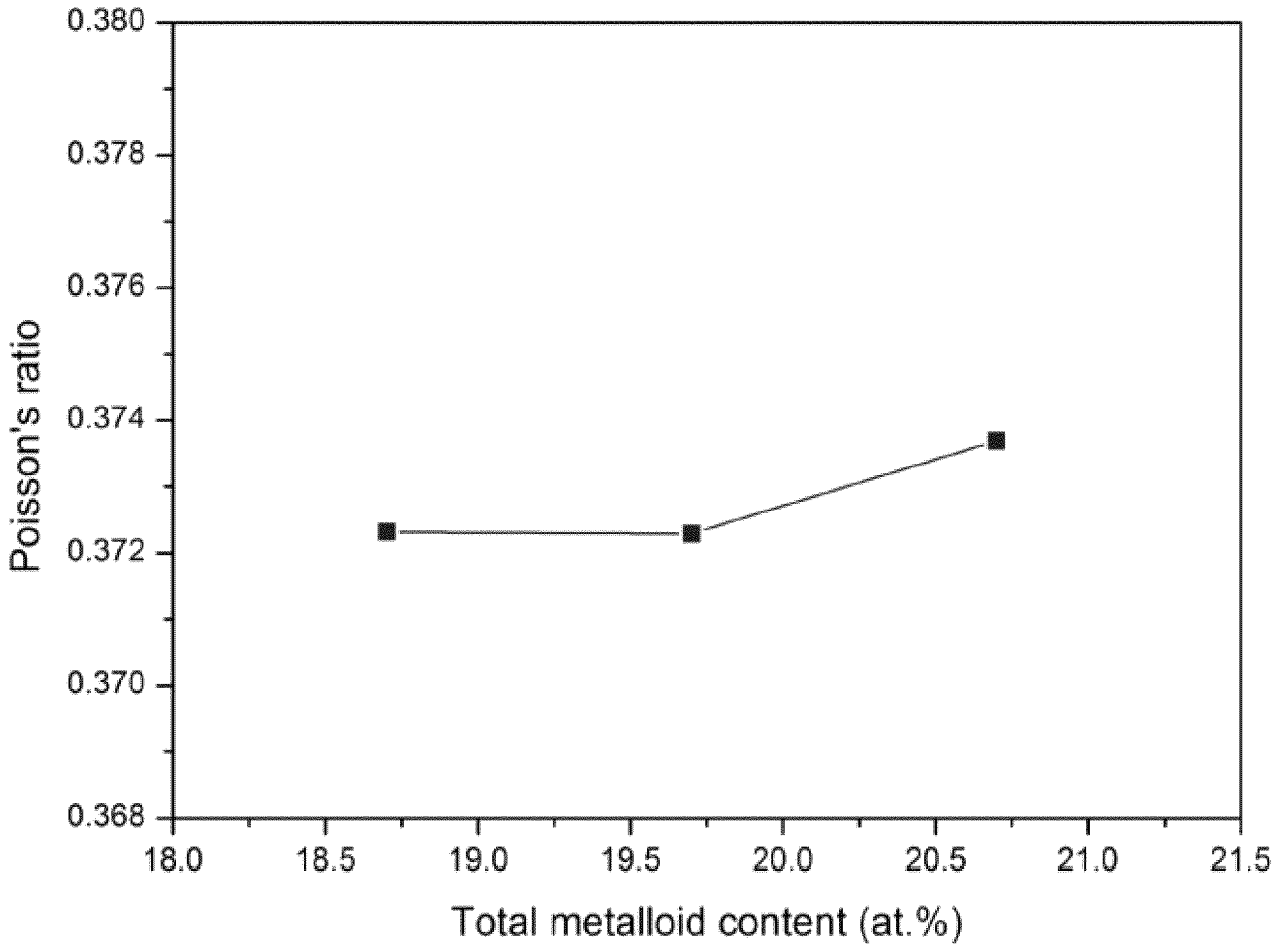
FIG. 38 provides a data plot showing the Poisson's ratio of exemplary amorphous alloys $(Ni_{0.8541}Cr_{0.1085}Nb_{0.0374})_{100-x}(P_{0.8376}B_{0.1624})_x$ for x between 18.7 and 20.7 (Data are listed in Table 14).

The density, shear, bulk, and Young's moduli, and Poisson's ratio of inventive alloys $(Ni_{0.8541}Cr_{0.185}Nb_{0.0374})_{100-x}(P_{0.8376}B_{0.1624})_x$, where x is between 18.7 and 20.7, were measured (Table 14). The Poisson's ratio is plotted against the metalloid content (FIG. 38), and is shown to remain fairly constant with increasing metalloid content.

TABLE 14

Effect of increasing metalloid concentration at the expense of metals on the shear modulus, bulk modulus, Young's modulus, Poisson's ratio and density of the Ni—Cr—Nb—P—B system

| Example | Composition | G (GPa) | B (GPa) | E (GPa) | Poisson's ratio | Density (g/cc) |
|---|---|---|---|---|---|---|
| 34 | $Ni_{69.45}Cr_{8.81}Nb_{3.04}P_{15.66}B_{3.04}$ | 51.45 | 184.30 | 141.20 | 0.37231 | 8.0959 |
| 36 | $Ni_{68.6}Cr_{8.7}Nb_3P_{16.5}B_{3.2}$ | 51.60 | 184.83 | 141.62 | 0.37229 | 7.8897 |
| 38 | $Ni_{67.75}Cr_{8.59}Nb_{2.96}P_{17.34}B_{3.36}$ | 51.95 | 188.34 | 142.73 | 0.37369 | 8.0356 |

Effect of Minority Additions

In other embodiments, the present disclosure is also directed to Ni—Cr—Nb—P—B systems that further contain minority additions of Si. Specifically, substitution of up to 2 atomic percent P with Si in the inventive alloys is found to retain significant glass forming ability. As such, the Ni-based inventive alloys in this embodiment contain Cr in the range of 4 to 14 atomic percent, Nb in the range of 1.8 to 4.3 atomic percent, P in the range of 13.5 to 17.5 atomic percent, and B in the range of 2.3 to 3.9 atomic percent, and are capable of forming an amorphous phase in sections at least 3 mm thick, and up to 10 mm or greater. Preferably, the atomic percent of B in the alloys of the present disclosure is between about 2 and 4, and the combined fraction of P, B, and Si is between about 19 and 20 atomic percent. Also, the atomic percent of Cr is preferably between 7 and 10 and of Nb between 2.5 and 4.

Figure 39:
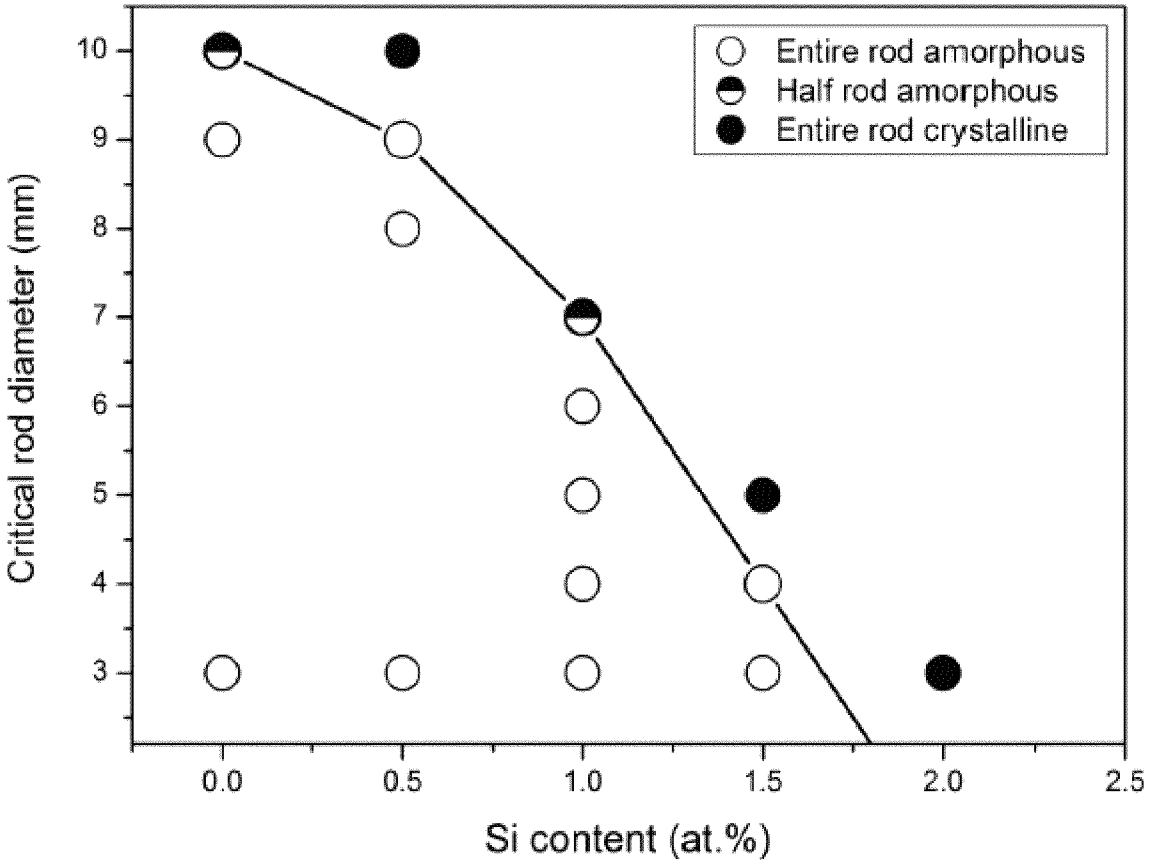
FIG. 39 provides a data plot showing the effect of Si atomic concentration on the glass forming ability of exemplary amorphous alloys $Ni_{68.5}Cr_9Nb_3P_{16.5-x}B_3Si_x$ for $0 \le x \le 2$ (Compositions are listed in Table 15)

Exemplary embodiments demonstrate that substitutions of up to about 2 atomic percent P with Si in the $Ni_{68.5}Cr_9Nb_3P_{16.5}B_3$ system does not drastically degrade bulk metallic glass formation (Table 15 below, and FIG. 39).

TABLE 15

Exemplary amorphous alloys demonstrating the effect of increasing Si atomic concentration at the expense of P on the glass forming ability of the Ni—Cr—Nb—P—B—Si system.

| Example | Composition | Critical Rod Diameter [mm] |
|---|---|---|
| 27 | $Ni_{68.5}Cr_9Nb_3P_{16.5}B_3$ | 10 |
| 39 | $Ni_{68.5}Cr_9Nb_3P_{16}B_3Si_{0.5}$ | 9 |
| 40 | $Ni_{68.5}Cr_9Nb_3P_{15.5}B_3Si_1$ | 7 |
| 41 | $Ni_{68.5}Cr_9Nb_3P_{15}B_3Si_{1.5}$ | 4 |

In a slightly modified composition, minority addition of Si was found to actually improve metallic glass formation (Table 16 below).

TABLE 16

Exemplary amorphous alloys demonstrating the effect of increasing Si atomic concentration at the expense of P increasing on the glass forming ability of the Ni—Cr—Nb—P—B—Si system.

| Example | Composition | Critical Rod Diameter [mm] |
|---|---|---|
| 36 | $Ni_{68.6}Cr_{8.7}Nb_3P_{16.5}B_{3.2}$ | 11 |
| 42 | $Ni_{68.6}Cr_{8.7}Nb_3P_{16}B_{3.2}Si_{0.5}$ | >11 |

Figure 40:
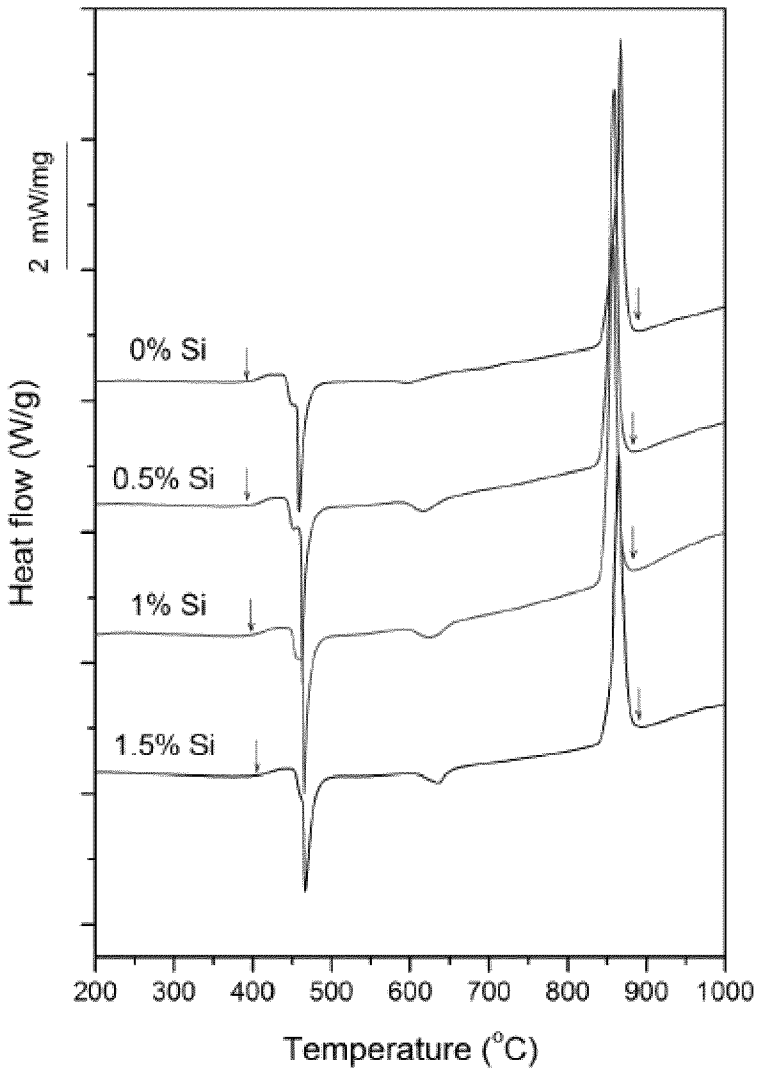
FIG. 40 provides calorimetry scans for exemplary amorphous alloys $Ni_{68.5}Cr_9Nb_3P_{16.5-x}B_3Si_x$ for $0 \le x \le 1.5$. (Compositions are listed in Table 15 and arrows in plot designate the glass-transition and liquidus temperatures).
Figure 41:
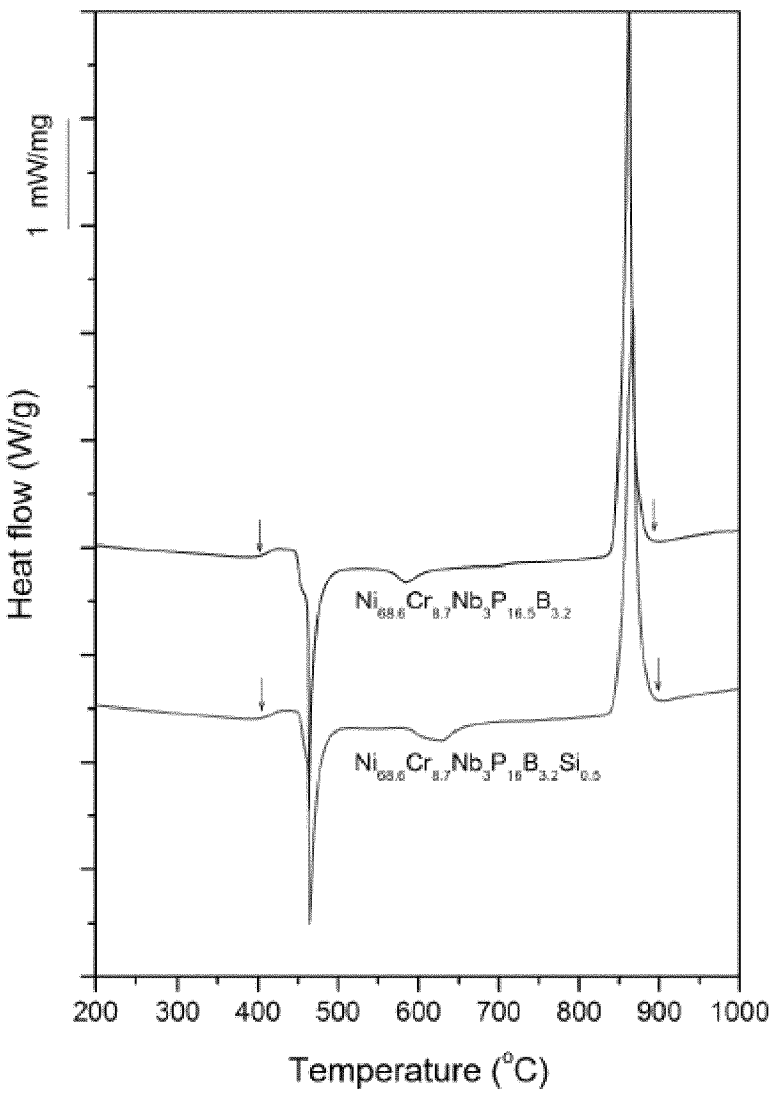
FIG. 41 provides calorimetry scans for exemplary amorphous alloys $Ni_{68.6}Cr_{8.7}Nb_3P_{16.5}B_{3.2}$ and $Ni_{68.6}Cr_{8.7}Nb_3P_{16}B_{3.2}Si_{0.5}$. (Arrows designate the glass-transition and liquidus temperatures).

Specifically, it was discovered that the glass-forming ability is to a large extent retained or, in some cases, slightly improved by substituting up to about 1 percent of P with Si. Calorimetry scans to determine the effects of Si concentration on the glass transition, crystallization, solidus, and liquidus temperatures were performed (FIGS. 40 and 41). Interestingly, minority additions of Si are shown to considerably raise the glass-transition temperature without substantially affecting the liquidus temperature.

Figure 42:
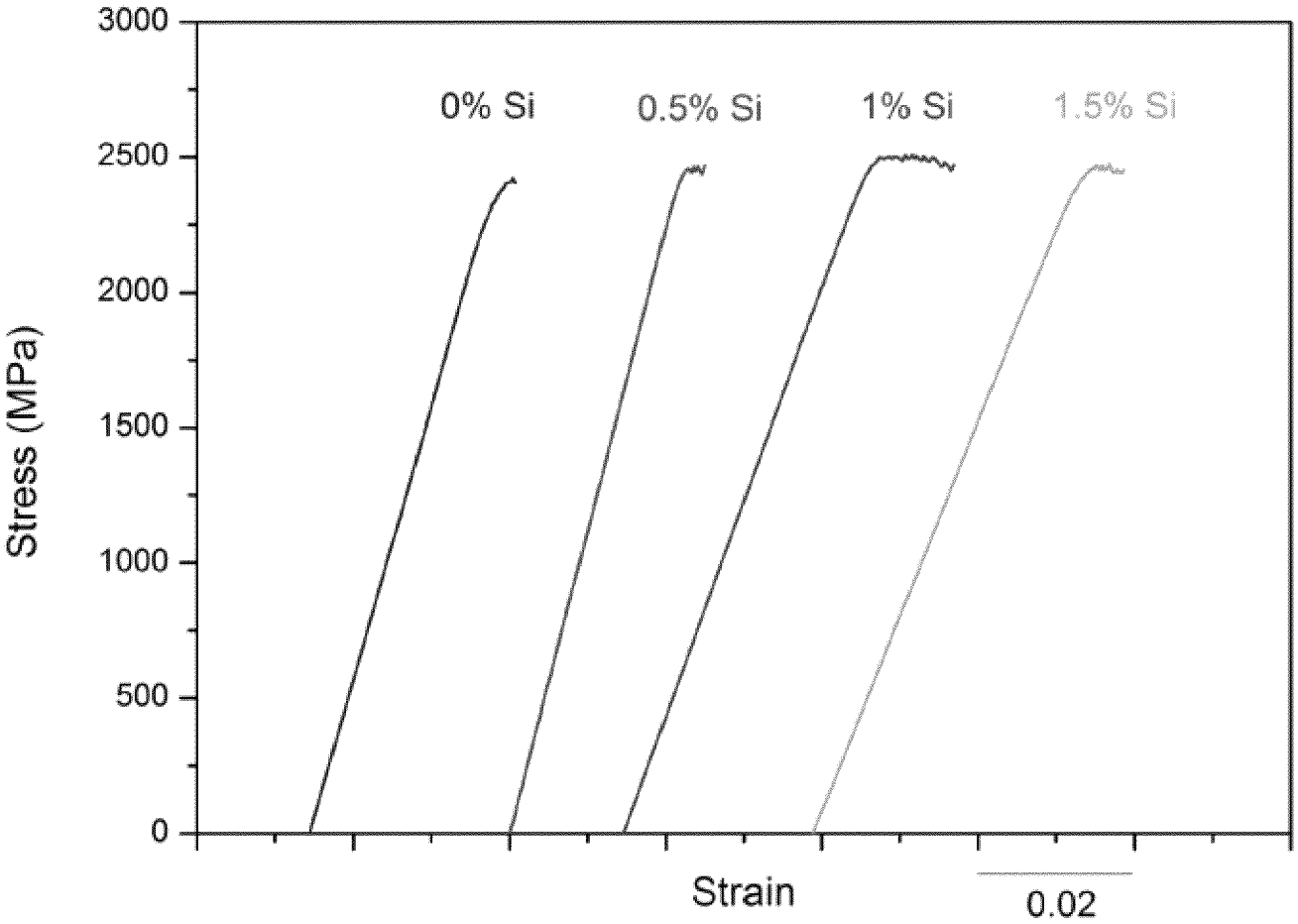
FIG. 42 provides compressive stress-strain responses of exemplary amorphous alloys $Ni_{68.5}Cr_9Nb_3P_{16.5-x}B_3Si_x$ for $0 \le x \le 1.5$.
Figure 43:
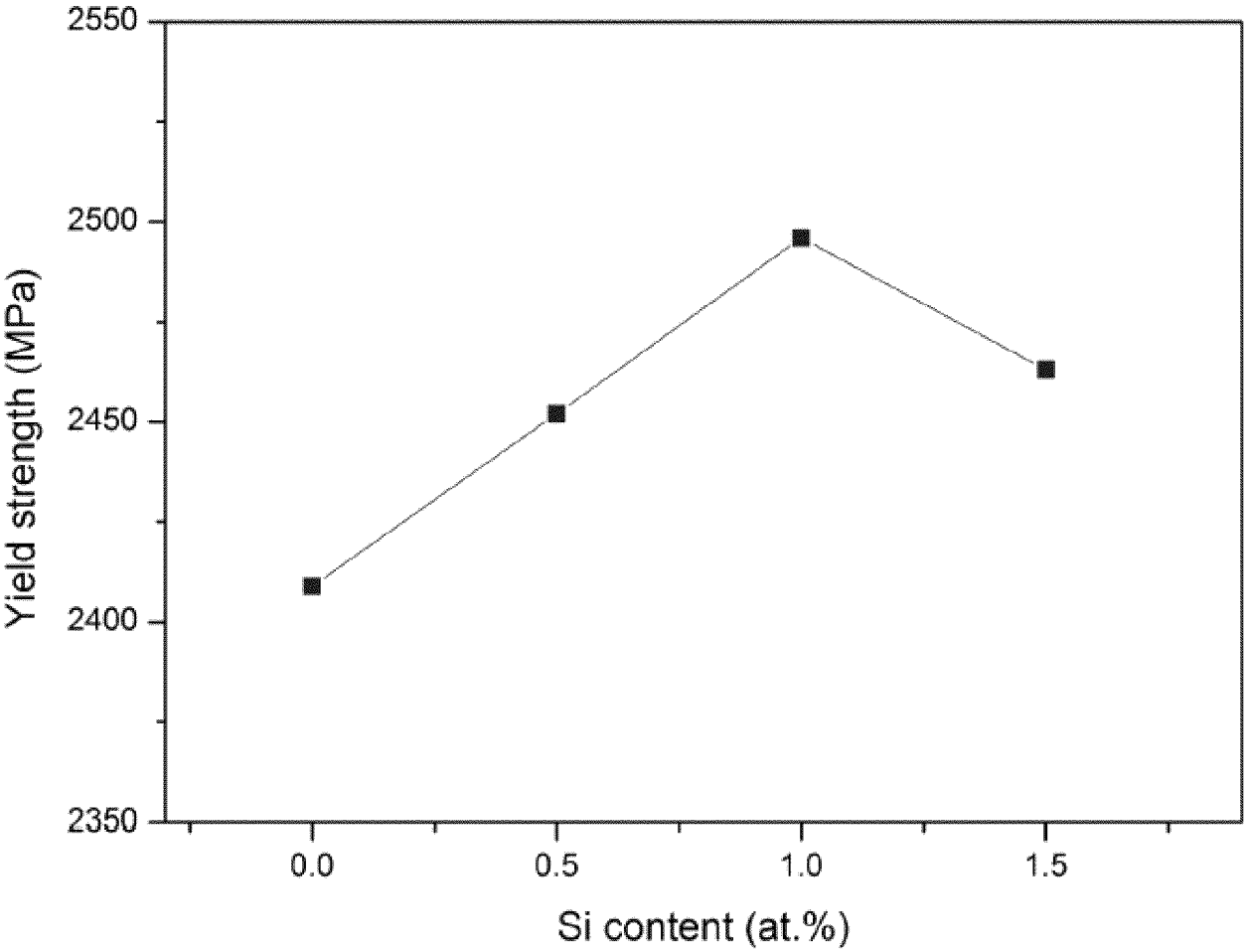
FIG. 43 provides a data plot showing the compressive yield strength of exemplary amorphous alloys $Ni_{68.5}Cr_9Nb_3P_{16.5-x}B_3Si_x$ for $0 \le x \le 1.5$. (Data are listed in Table 17).
Figure 44:
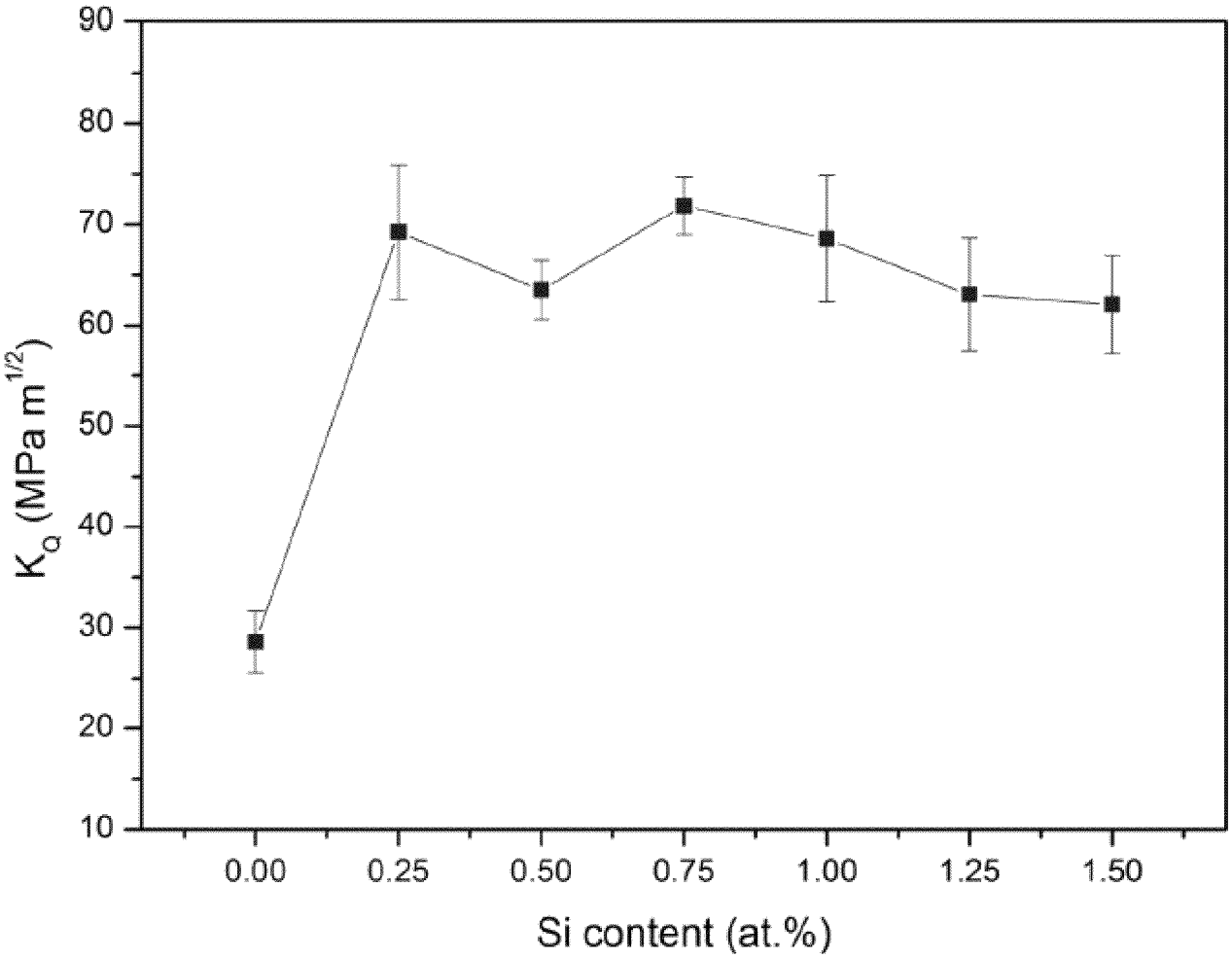
FIG. 44 provides a data plot showing notch toughness of exemplary amorphous alloys $Ni_{68.5}Cr_9Nb_3P_{16.5-x}B_3Si_x$ for $0 \le x \le 1.5$. (Data are listed in Table 17).
Figure 45:
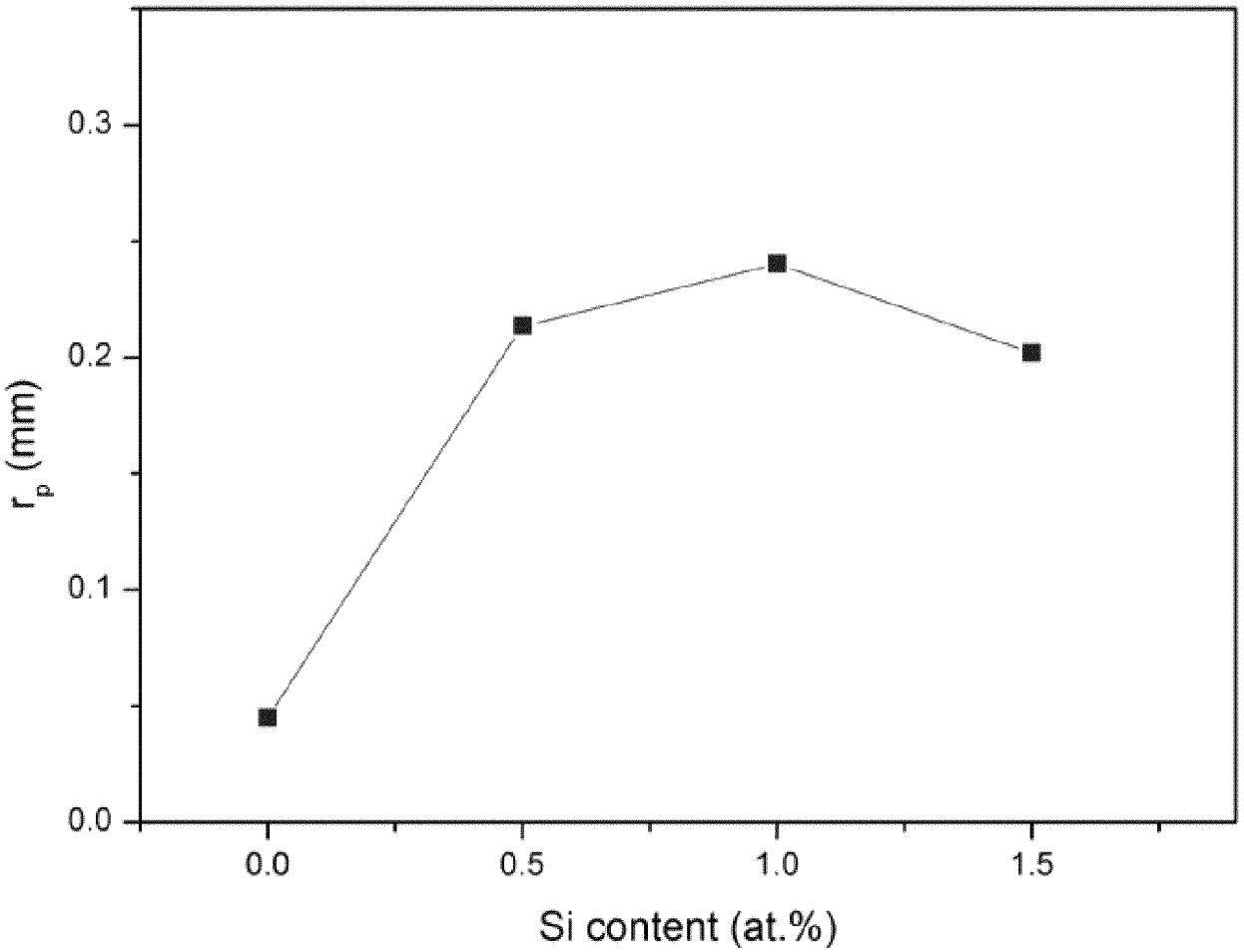
FIG. 45 provides a data plot showing the plastic zone radii of exemplary amorphous alloys $Ni_{68.5}Cr_9Nb_3P_{16.5-x}B_3Si_x$ for $0 \le x \le 1.5$. (Data are listed in Table 17).
Figure 46:
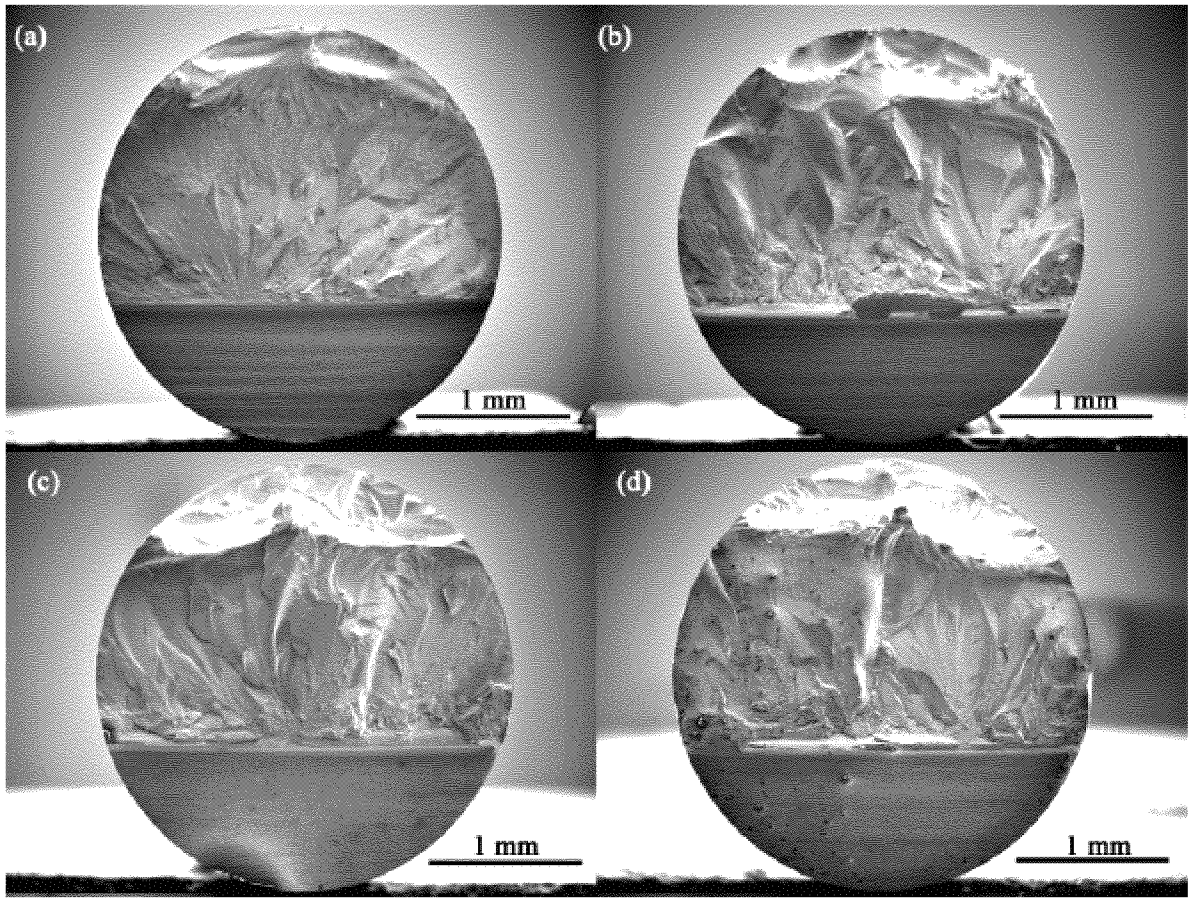
FIG. 46 provides images of fracture surfaces of pre-notched specimens of exemplary amorphous alloys $Ni_{68.5}Cr_9Nb_3P_{16.5-x}B_3Si_x$: (a) x=0; (b) x=0.5; (c) x=1; (d) x=1.5.

Minority addition of Si as a replacement for P is also found to have surprisingly dramatic effects on the mechanical properties. The compressive strength, notch toughness, and bending ductility of inventive alloys $Ni_{68.5}Cr_9Nb_3P_{16.5-x}B_3Si_x$, where x is between 0 and 1.5, were investigated. The compressive strength of the Si bearing alloys is shown to increase with increasing Si content (Table 17 and FIGS. 42 and 43), consistent with the increasing $T_g$ (FIG. 40). More importantly, the notch toughness is shown to rise dramatically by a factor of two or more with even minor Si additions as low as 0.25% (Table 17 and FIG. 44). The slightly higher strength and considerably higher toughness result in a larger plastic zone radius (Table 17 and FIG. 45). The higher toughness and larger plastic zone radius of the Si bearing alloys are reflected in their fracture surface morphology. As shown in FIG. 46, the fracture surface morphology of Si bearing alloys exhibits "rough" highly jagged features indicating substantial plastic flow prior to fracture. By contrast, the fracture surface morphology of a Si-free alloy exhibits "sharp" cleavage-like features indicating limited plastic flow prior to fracture. Lastly, the critical bending diameter at which a rod can be bent plastically around a 6.3 mm bent radius and the associated bending ductility are found to decrease linearly with increasing Si content (Table 17).

TABLE 17

Effect of increasing Si atomic concentration at the expense of P on the yield strength, notch toughness, plastic zone radius, critical bending diameter and bending ductility of the Ni—Cr—Nb—P—B—Si system

| Example | Composition | $\sigma_y$ (MPa) | $K_Q$ (MPa $m^{1/2}$) | $r_p$ (mm) | $d_{cr}$ (mm) | $\epsilon_p$ |
|---|---|---|---|---|---|---|
| 27 | $Ni_{68.5}Cr_9Nb_3P_{16.5}B_3$ | 2446 | 38.18 ± 6.02 | 0.0775 | 0.85 | 0.135 |
| 43 | $Ni_{68.5}Cr_9Nb_3P_{16.25}B_3Si_{0.25}$ | — | 69.24 ± 6.65 | — | — | — |
| 39 | $Ni_{68.5}Cr_9Nb_3P_{16}B_3Si_{0.5}$ | 2452 | 63.50 ± 2.94 | 0.2135 | 0.80 | 0.127 |
| 44 | $Ni_{68.5}Cr_9Nb_3P_{15.75}B_3Si_{0.75}$ | — | 71.86 ± 2.88 | — | — | — |
| 40 | $Ni_{68.5}Cr_9Nb_3P_{15.5}B_3Si_1$ | 2496 | 68.57 ± 6.29 | 0.2402 | 0.70 | 0.111 |
| 45 | $Ni_{68.5}Cr_9Nb_3P_{15.25}B_3Si_{1.25}$ | — | 63.04 ± 5.58 | — | — | — |
| 41 | $Ni_{68.5}Cr_9Nb_3P_{15}B_3Si_{1.5}$ | 2463 | 62.02 ± 4.87 | 0.2019 | — | — |

Figure 47:
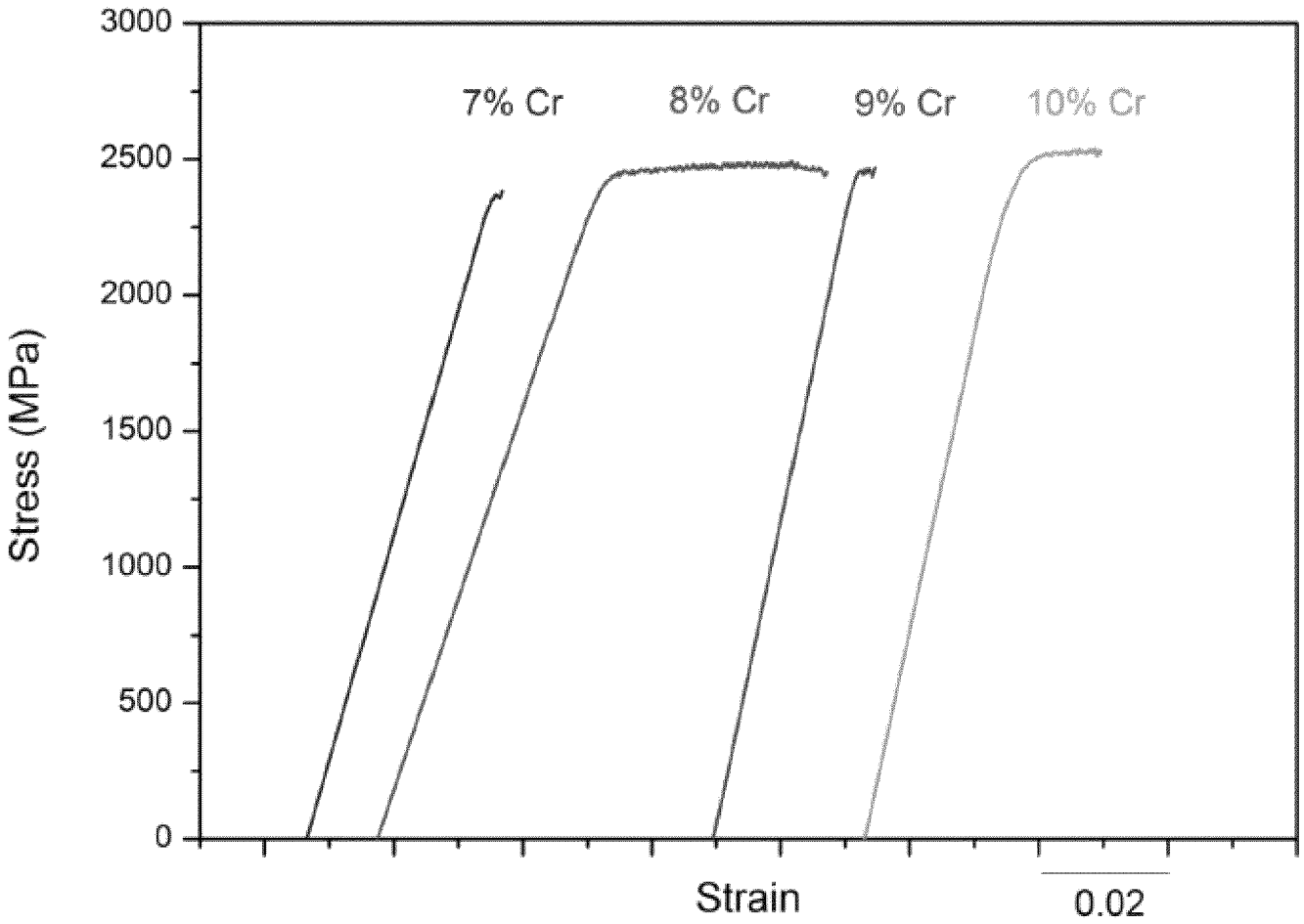
FIG. 47 provides compressive stress-strain responses of exemplary amorphous alloys $Ni_{77.5-x}Cr_xNb_3P_{16}B_3Si_{0.5}$ for $7 \le x \le 10$.
Figure 48:
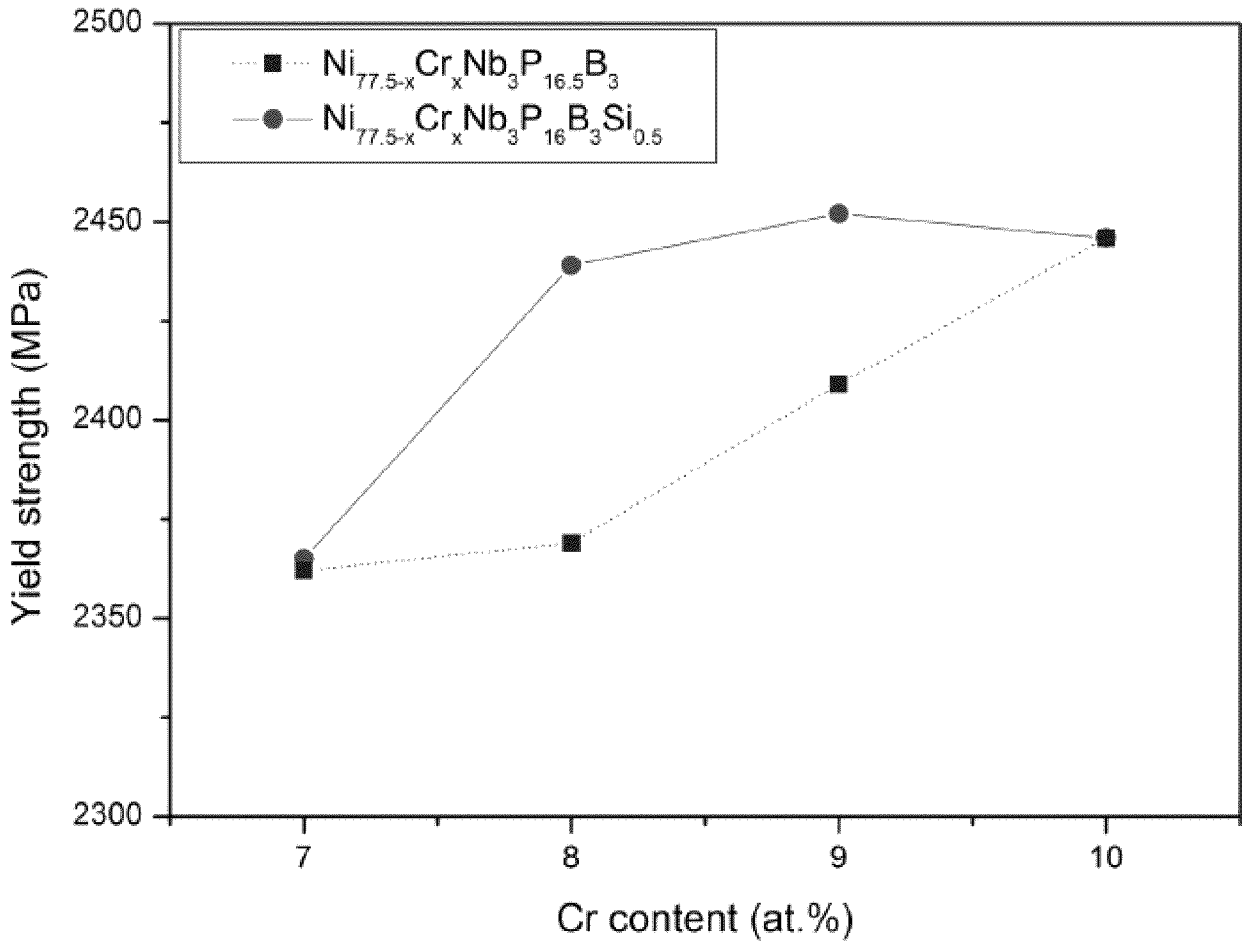
FIG. 48 provides compressive yield strengths of exemplary amorphous alloys $Ni_{77.5-x}Cr_xNb_3P_{16.5}B_3$ and $Ni_{77.5-x}Cr_xNb_3P_{16}B_3Si_{0.5}$ for $7 \le x \le 10$. (Data are listed in Table 18).
Figure 49:
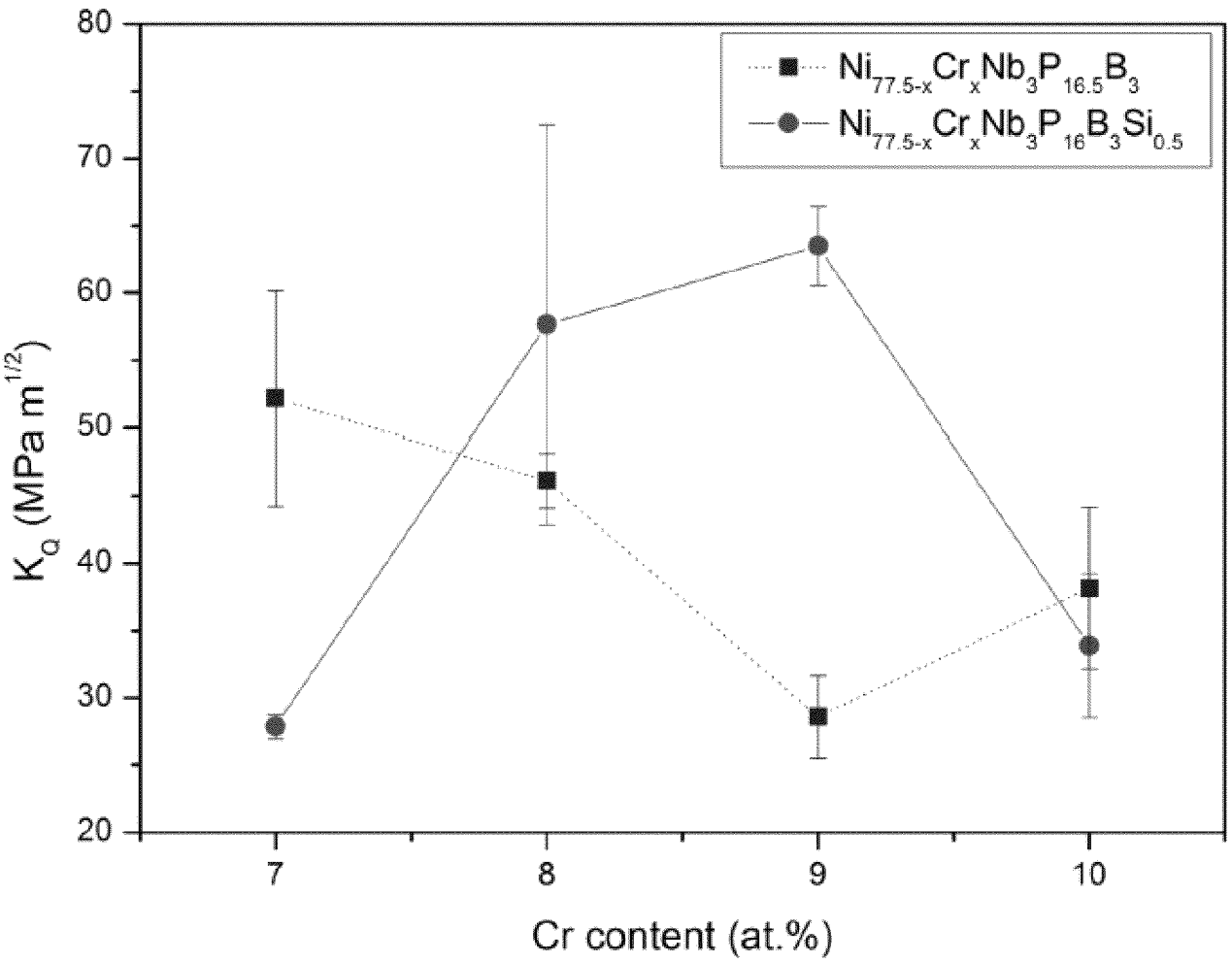
FIG. 49 provides notch toughness of exemplary amorphous alloys $Ni_{77.5-x}Cr_xNb_3P_{16.5}B_3$ and $Ni_{77.5-x}Cr_xNb_3P_{16}B_3Si_{0.5}$ for $7 \le x \le 10$. (Data are listed in Table 18).
Figure 50:
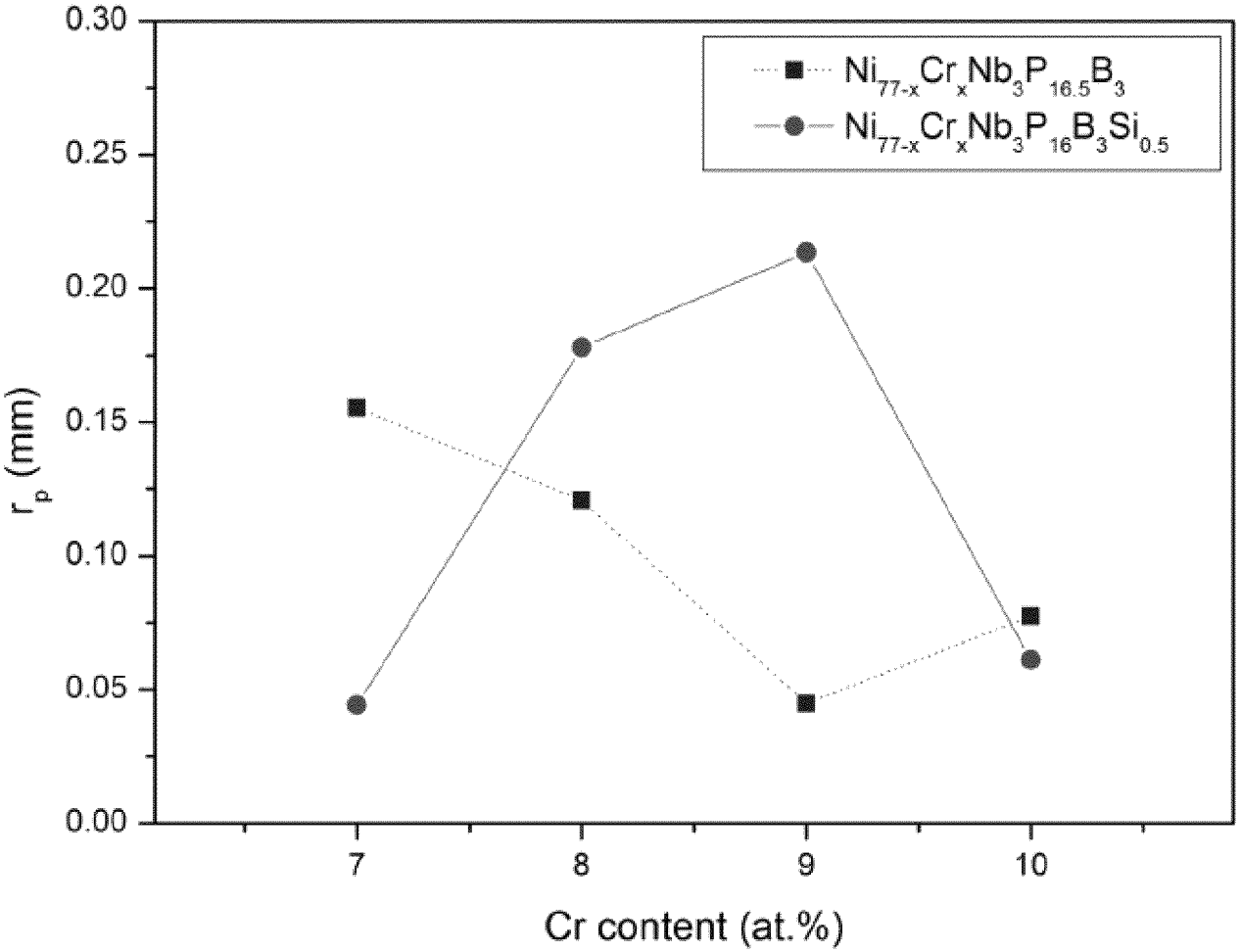
FIG. 50 provides plastic zone radii of exemplary amorphous alloys $Ni_{77.5-x}Cr_xNb_3P_{16.5}B_3$ and $Ni_{77.5-x}Cr_xNb_3P_{16}B_3Si_{0.5}$ for $7 \le x \le 10$. (Data are listed in Table 18).
Figure 51:
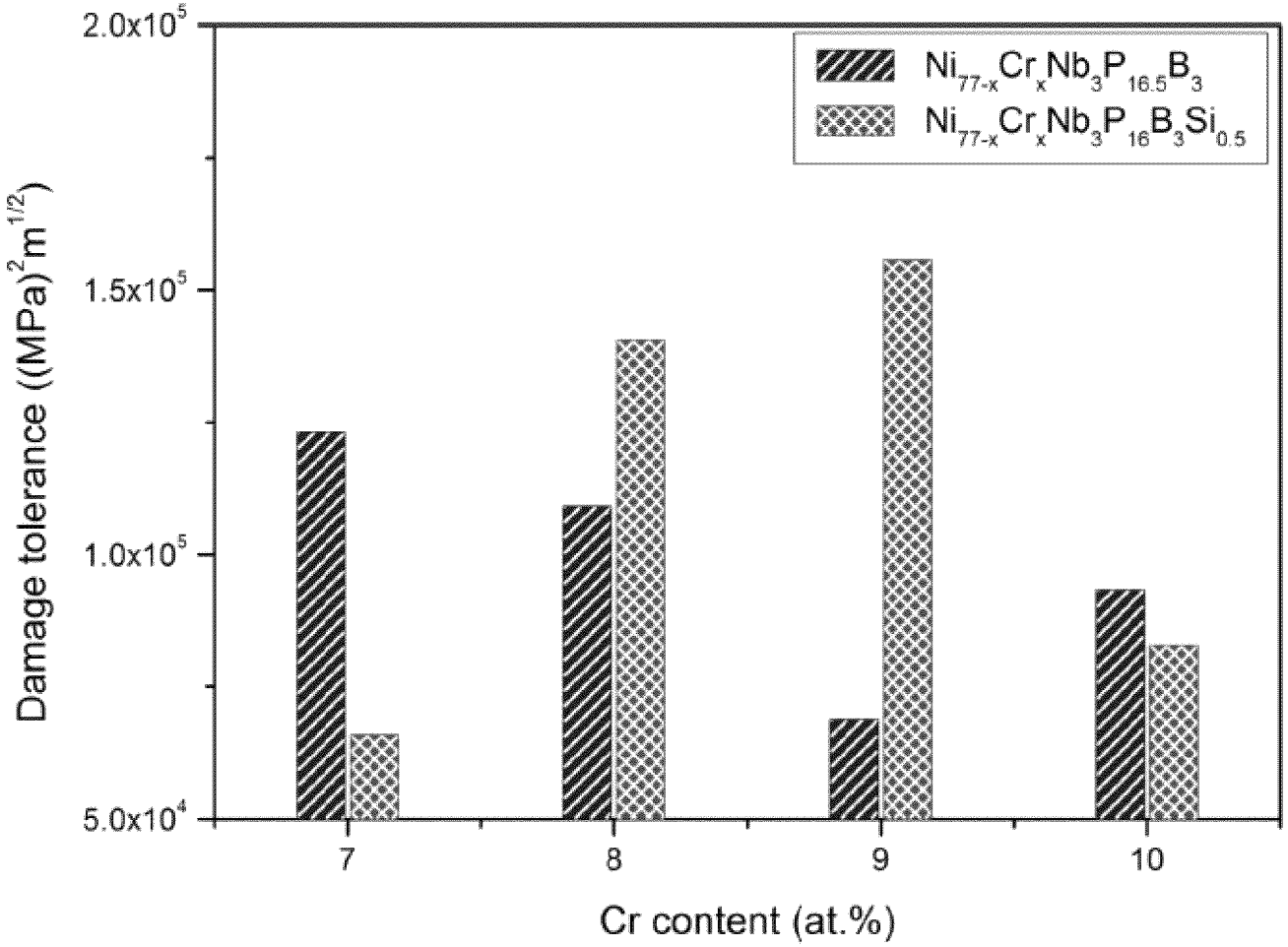
FIG. 51 provides a data plot of damage tolerance of exemplary amorphous alloys $Ni_{77.5-x}Cr_xNb_3P_{16.5}B_3$ and $Ni_{77.5-x}Cr_xNb_3P_{16}B_3Si_{0.5}$ for $7 \le x \le 10$.

The compressive strength and notch toughness were also investigated for inventive alloys $Ni_{77.5-x}Cr_xNb_3P_{16}B_3Si_{0.5}$, where x is between 7 and 10 (FIG. 47), and were compared to inventive alloys $Ni_{77.5-x}Cr_xNb_3P_{16.5}B_3$, where x is between 7 and 10. Interestingly, the strength (Table 18 and FIG. 48) and especially the toughness (Table 18 and FIG. 49) and plastic zone radius (Table 18 and FIG. 50) increased for the alloys containing 0.5 atomic percent Si compared to the Si-free alloys. As a result of an increased strength and toughness, a higher damage tolerance would be expected for the alloys containing 0.5 atomic percent Si compared to the Si-free alloys. One can loosely define damage tolerance as the product of strength and toughness. Computing damage tolerance in this manner for the two sets of inventive alloys, one will find a substantially higher damage tolerance for the alloys containing 0.5 atomic percent Si compared to the Si-free alloys when x is between 7.5 and 9.5 (FIG. 51).

TABLE 18

Effect of Si atomic concentration on the yield strength, notch toughness, and plastic zone radius of the Ni—Cr—Nb—P—B—Si system

| Example | Composition | $\sigma_y$ (MPa) | $K_Q$ (MPa $m^{1/2}$) | $r_p$ (mm) |
|---|---|---|---|---|
| 46 | $Ni_{70.5}Cr_7Nb_3P_{16}B_3Si_{0.5}$ | 2365 | 27.88 ± 0.90 | 0.0442 |
| 47 | $Ni_{69.5}Cr_8Nb_3P_{16}B_3Si_{0.5}$ | 2439 | 57.67 ± 0.90 | 0.1880 |
| 39 | $Ni_{68.5}Cr_9Nb_3P_{16}B_3Si_{0.5}$ | 2452 | 63.50 ± 2.94 | 0.2135 |
| 48 | $Ni_{67.5}Cr_{10}Nb_3P_{16}B_3Si_{0.5}$ | 2446 | 33.89 ± 5.36 | 0.0611 |

Figure 52:
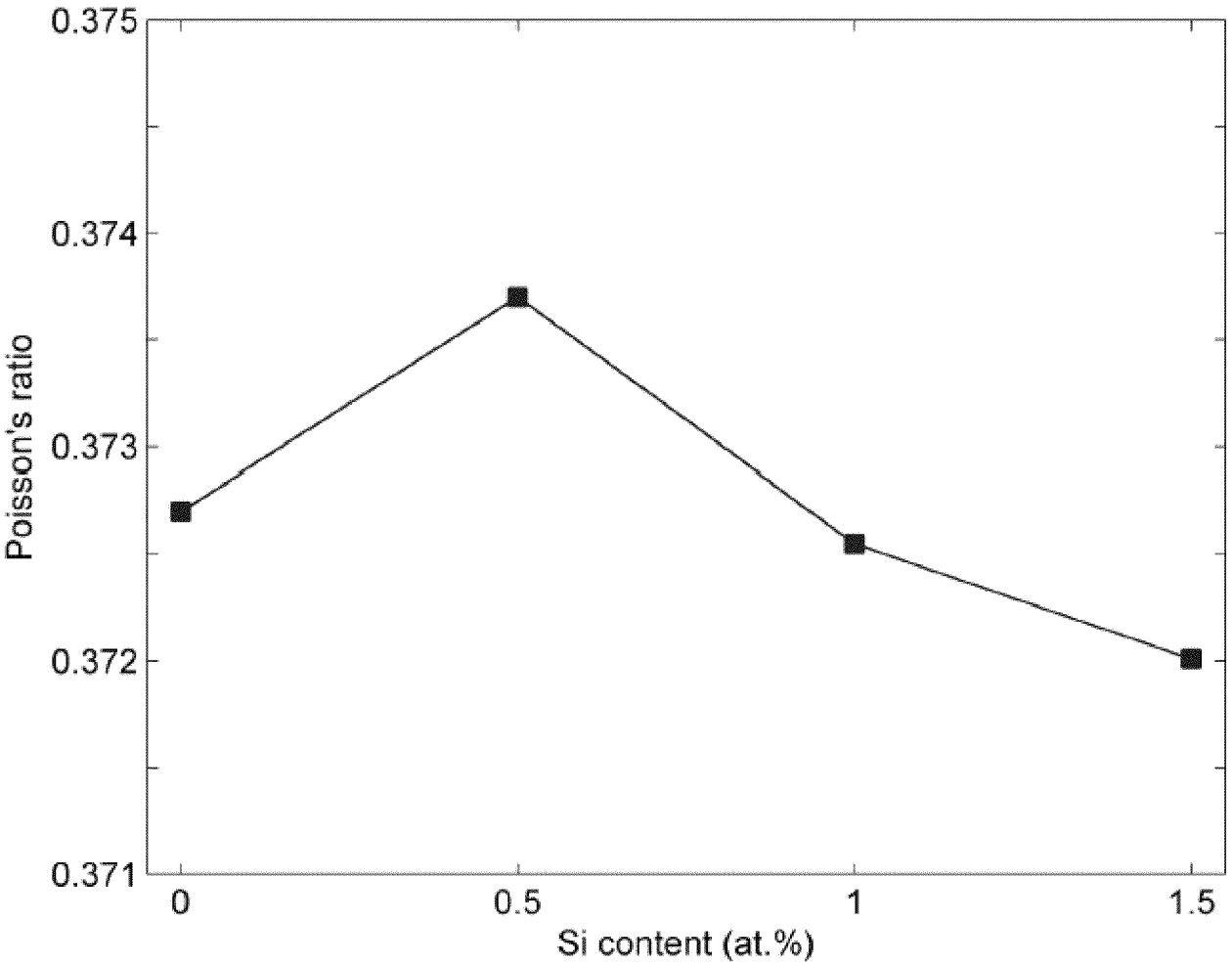
FIG. 52 provides a data plot showing the Poisson's ratio of exemplary amorphous alloys $Ni_{68.5}Cr_9Nb_3P_{16.5-x}B_3Si_x$ for $0 \le x \le 1.5$. (Data are listed in Table 19).

The density, shear, bulk, and Young's moduli, and Poisson's ratio of inventive alloys $Ni_{68.5}Cr_9Nb_3P_{16.5-x}B_3Si_x$, where x is between 0 and 1.5, were measured (Table 19). The Poisson's ratio is plotted against the Si content (FIG. 52), and is shown to exhibit a peak at 0.5% Si.

TABLE 19

The effect of increasing Si atomic concentration at the expense of P on the Poisson's ratio of the Ni—Cr—Nb—P—B—Si system.

| Example | Composition | G (GPa) | B (GPa) | E (GPa) | Poisson's ratio | Density (g/cc) |
|---|---|---|---|---|---|---|
| 27 | $Ni_{68.5}Cr_9Nb_3P_{16.5}B_3$ | 51.01 | 183.35 | 140.04 | 0.37270 | 7.8977 |
| 39 | $Ni_{68.5}Cr_9Nb_3P_{16}B_3Si_{0.5}$ | 51.06 | 185.11 | 140.28 | 0.37370 | 7.9452 |
| 40 | $Ni_{68.5}Cr_9Nb_3P_{15.5}B_3Si_1$ | 51.48 | 184.79 | 141.31 | 0.37255 | 7.9765 |
| 41 | $Ni_{68.5}Cr_9Nb_3P_{15}B_3Si_{1.5}$ | 52.51 | 187.64 | 144.09 | 0.37201 | 8.0429 |

Effect of Minority Ta and Mo Additions

Although the above results provide detailed studies of the effect of Si on the GFA of the inventive alloys, in yet another embodiment up to 1.5 atomic percent of Nb in the inventive alloys can be substituted by Ta, V, or combinations thereof, while retaining bulk glass formation in rods of at least 3 mm in diameter. Exemplary embodiments of alloys containing additions of Si and Ta are presented in Table 20 below, and are shown to be able to form amorphous rods up to 6 mm in diameter. Also, up to 2 atomic percent of the Cr or up to 2 atomic percent of the Ni in the inventive alloys can be optionally substituted by Fe, Co, Mn, W, Mo, Ru, Re, Cu, Pd, Pt, or combinations thereof.

TABLE 20

Exemplary amorphous alloys of the Ni—Cr—Nb—Ta—P—B—Si system

| Example | Composition | Critical Rod Diameter [mm] |
|---|---|---|
| 49 | $Ni_{68}Cr_9Nb_{2.5}Ta_{0.5}P_{16}B_3Si_1$ | 5 |
| 50 | $Ni_{67.5}Cr_{9.5}Nb_{2.5}Ta_{0.5}P_{16}B_3Si_1$ | 3 |
| 51 | $Ni_{68.5}Cr_{8.5}Nb_{2.5}Ta_{0.5}P_{16}B_3Si_1$ | 5 |
| 52 | $Ni_{69}Cr_8Nb_{2.5}Ta_{0.5}P_{16}B_3Si_1$ | 5 |
| 53 | $Ni_{68.5}Cr_9Nb_2Ta_{0.5}P_{16}B_3Si_1$ | 5 |
| 54 | $Ni_{69}Cr_{8.5}Nb_{2.5}Ta_{0.5}P_{15.5}B_3Si_1$ | 6 |
| 55 | $Ni_{68.5}Cr_9Nb_{2.5}Ta_{0.5}P_{15.5}B_3Si_1$ | 5 |
| 56 | $Ni_{68.5}Cr_{8.5}Nb_{2.5}Ta_{0.5}P_{15.5}B_{3.5}Si_1$ | 5 |
| 57 | $Ni_{69.5}Cr_{8.5}Nb_{2.5}Ta_{0.5}P_{15.5}B_3Si_1$ | 6 |

Figure 53:
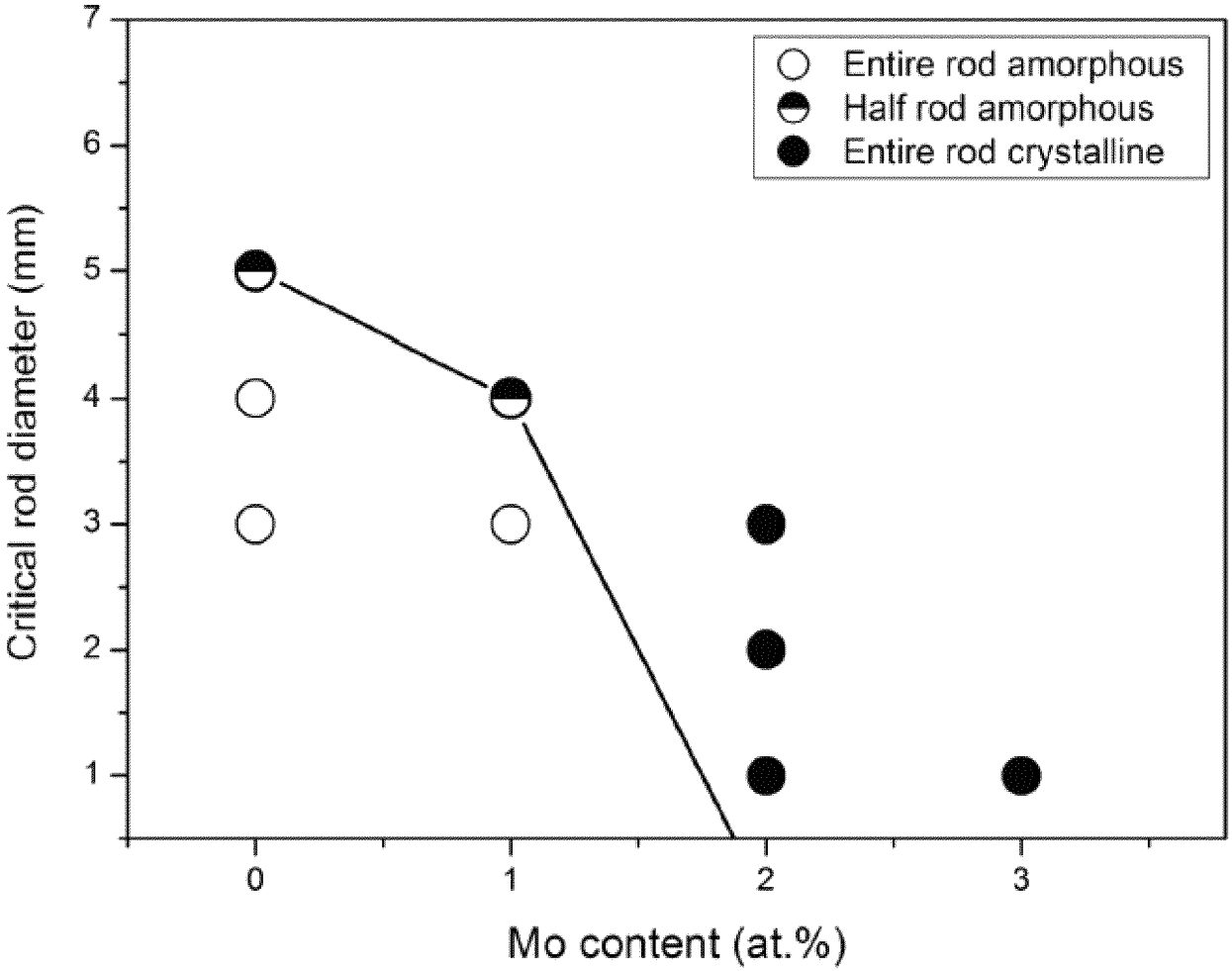
FIG. 53 provides a data plot showing the effect of Mo atomic concentration on the glass forming ability of exemplary amorphous alloys $Ni_{68.5}Cr_{8.5-x}Nb_3Mo_xP_{16}B_4$ for $0 \le x \le 3$. (Compositions are listed in Table 21).

The effect of Mo addition on the glass forming ability was examined for the compositions listed in Table 21, below. FIG. 53 provides a data plot showing the effect of Mo atomic concentration on the glass forming ability of exemplary amorphous alloys $Ni_{68.5}Cr_{8.5-x}Nb_3Mo_xP_{16}B_4$ for $0 \le x \le 3$. As demonstrated, addition of even minute fractions of Mo dramatically degrades bulk-glass formation. Specifically, it is shown that is very difficult to achieve formation of bulk glassy articles if Mo is included in atomic concentrations of more than 1%. Accordingly, it is important to the inventive alloy that contributions of Mo be avoided.

TABLE 21

Exemplary amorphous alloys demonstrating the effect of Mo atomic concentration on the glass forming ability of the Ni—Cr—Nb—Mo—P—B system

| Example | Composition | Critical Rod Diameter [mm] |
|---|---|---|
| 8 | $Ni_{68.5}Cr_{8.5}Nb_3P_{16}B_4$ | 5 |
| 58 | $Ni_{68.5}Cr_{7.5}Nb_3Mo_1P_{16}B_4$ | 4 |
| 59 | $Ni_{68.5}Cr_{6.5}Nb_3Mo_2P_{16}B_4$ | <1 |
| 60 | $Ni_{68.5}Cr_{5.5}Nb_3Mo_3P_{16}B_4$ | <1 |

Finally, despite the above, it will be understood that standard impurities related to the manufacturing limitations of some materials can be tolerated in concentrations of up to 1 wt. % without impacting the properties of the inventive alloys.

Corrosion Resistance

Figure 54:
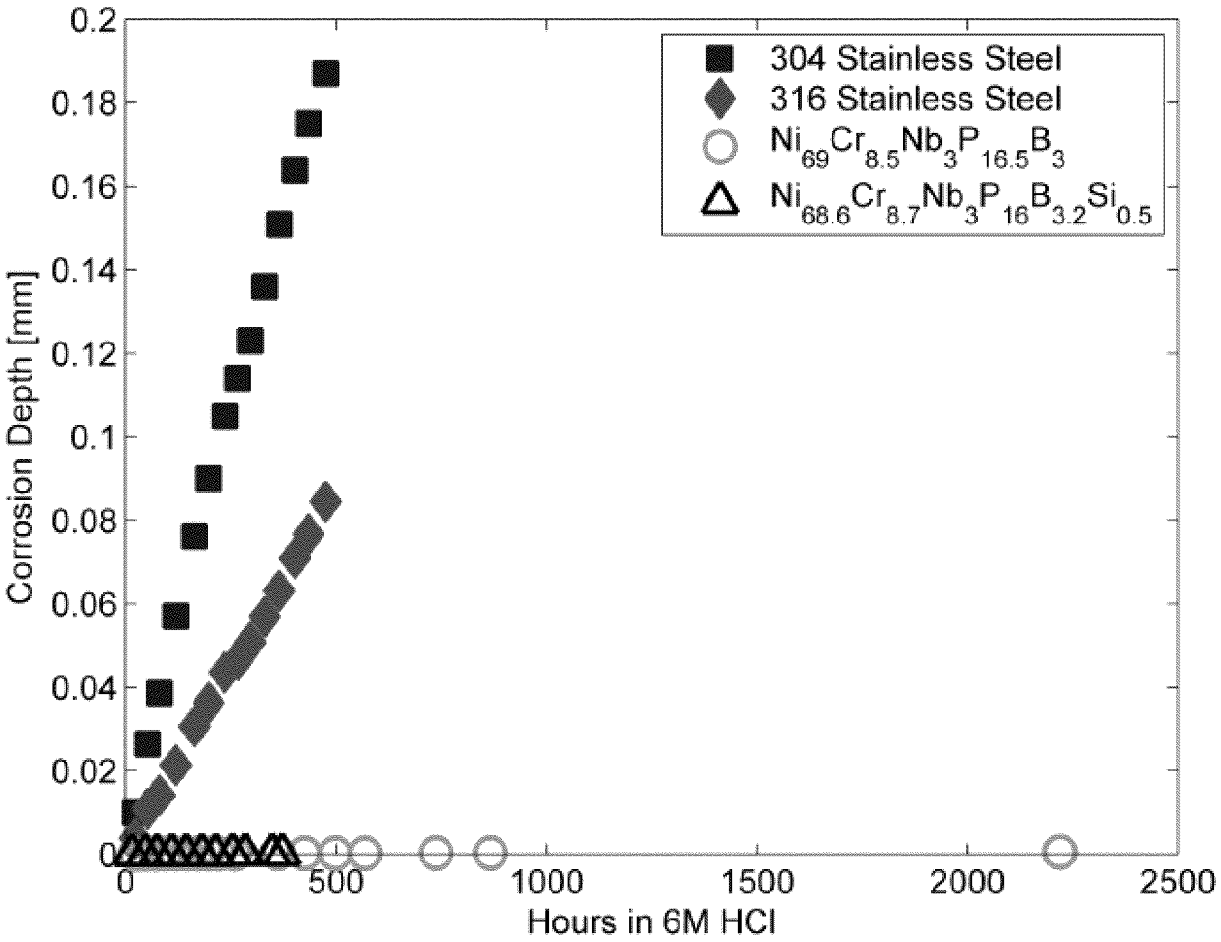
FIG. 54 provides a data plot showing corrosion depth vs. time for stainless steel 304, stainless steel 316, and exemplary amorphous alloys $Ni_{69}Cr_{8.5}Nb_3P_{16.5}B_3$ and $Ni_{68.6}Cr_{8.7}Nb_3P_{16}B_{3.2}Si_{0.5}$ in 6M HCl.
Figure 55:
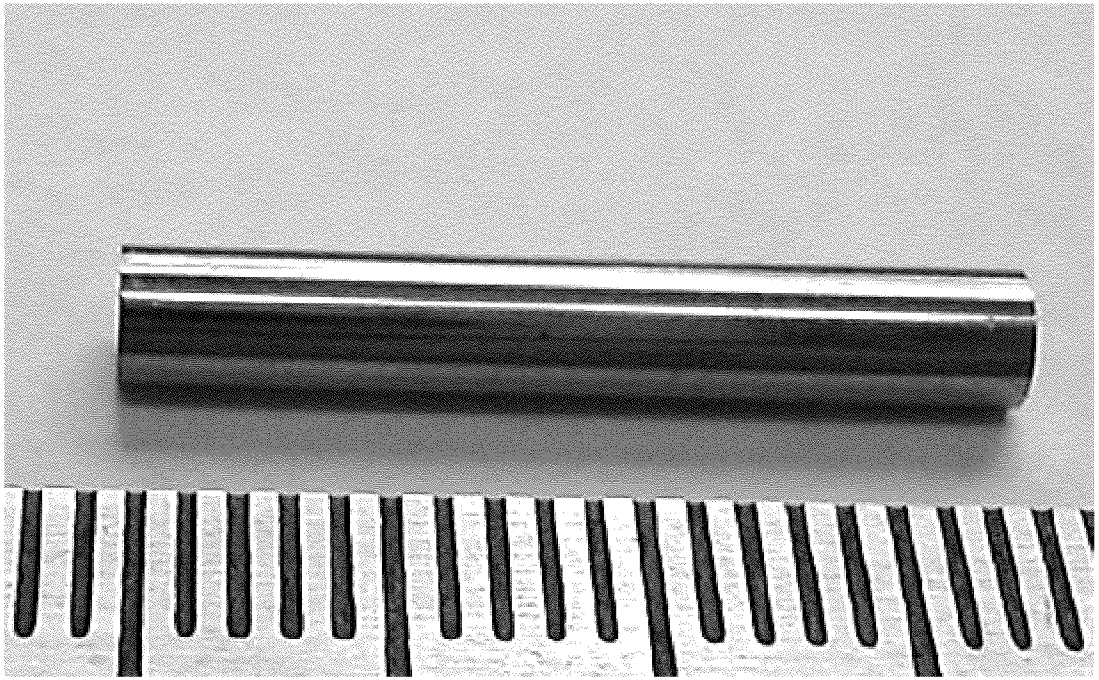
FIG. 55 provides an image of a 3-mm rod of exemplary amorphous alloy $Ni_{69}Cr_{8.5}Nb_3P_{16.5}B_3$ after 2220 hours of immersion in 6M HCl.

The corrosion resistances of exemplary amorphous alloys $Ni_{69}Cr_{8.5}Nb_3P_{16.5}B_3$ and $Ni_{68.6}Cr_{8.7}Nb_3P_{16}B_{3.2}Si_{0.5}$ were evaluated by immersion tests in 6M HCl, and were compared against highly corrosion-resistant stainless steels. The plot of the corrosion depth vs. time for the three alloys is presented in FIG. 54. Using mass loss measurements, the corrosion depth of 304 stainless steel over about 475 hours was estimated to be about 187 micrometers and that of 316 stainless steel about 85 micrometers. By contrast, the corrosion depth of the exemplary amorphous alloy $Ni_{68.6}Cr_{8.7}Nb_3P_{16}B_{3.2}Si_{0.5}$ over about 373 hours was estimated to be only about 0.14 micrometers. More interestingly, the corrosion depth of the exemplary amorphous alloy $Ni_{69}Cr_{8.5}Nb_3P_{16.5}B_3$ over about 2220 hours was estimated to be only about 0.6 micrometers. As shown in FIG. 55, the rod after 2200 hours immersion is shown to be almost entirely intact. By fitting the corrosion depth data and assuming linear corrosion kinetics, the corrosion rate of 304 stainless steel was estimated to be about 3400 micrometers/year, and that of 316 stainless steel about 1500 micrometers/year. By contrast, the corrosion rate of exemplary amorphous alloy $Ni_{69}Cr_{8.5}Nb_3P_{16.5}B_3$ was estimated to be only about 2.1 micrometers/year, while that of $Ni_{68.6}Cr_{8.7}Nb_3P_{16}B_{3.2}Si_{0.5}$ about 2.6 micrometers/year. Even though the superb corrosion resistance of Ni-based Cr- and P-bearing amorphous alloys was noted in many prior art articles and patents, this is the first time such high corrosion resistance is reported for Ni-based Cr- and P-bearing amorphous alloys capable of forming bulk glassy rods with diameters ranging from 3 mm to 10 mm or higher.

EXEMPLARY EMBODIMENTS

Example 1

Method of Forming the Inventive Amorphous Alloys

A preferred method for producing the inventive alloys involves inductive melting of the appropriate amounts of elemental constituents in a quartz tube under inert atmosphere. The purity levels of the constituent elements were as follows: Ni 99.995%, Cr 99.996%, Nb 99.95%, Ta 99.95%, Si 99.9999%, P 99.9999%, and B 99.5%. A preferred method for producing glassy rods from the alloy ingots involves re-melting the ingots in quartz tubes of 0.5-mm thick walls in a furnace at 1100° C. or higher, and preferably between 1150 and 1250° C., under high purity argon and rapidly quenching in a room-temperature water bath. In general, amorphous articles from the alloy of the present disclosure can be produced by (1) re-melting the alloy ingots in quartz tubes of 0.5-mm thick walls, holding the melt at a temperature of about 1100° C. or higher, and preferably between 1150 and 1250° C., under inert atmosphere, and rapidly quenching in a liquid bath; (2) re-melting the alloy ingots, holding the melt at a temperature of about 1100° C. or higher, and preferably between 1150 and 1250° C., under inert atmosphere, and injecting or pouring the molten alloy into a metal mold, preferably made of copper, brass, or steel. Optionally, prior to producing an amorphous article, the alloyed ingots can be fluxed with dehydrated boron oxide or any other reducing agent by re-melting the ingots in a quartz tube under inert atmosphere, bringing the alloy melt in contact with the molten reducing agent and allowing the two melts to interact for about 1000 s at a temperature of about 1100° C. or higher, and subsequently water quenching.

Example 2

Test Methodology for Assessing Glass-Forming Ability

Figure 56:
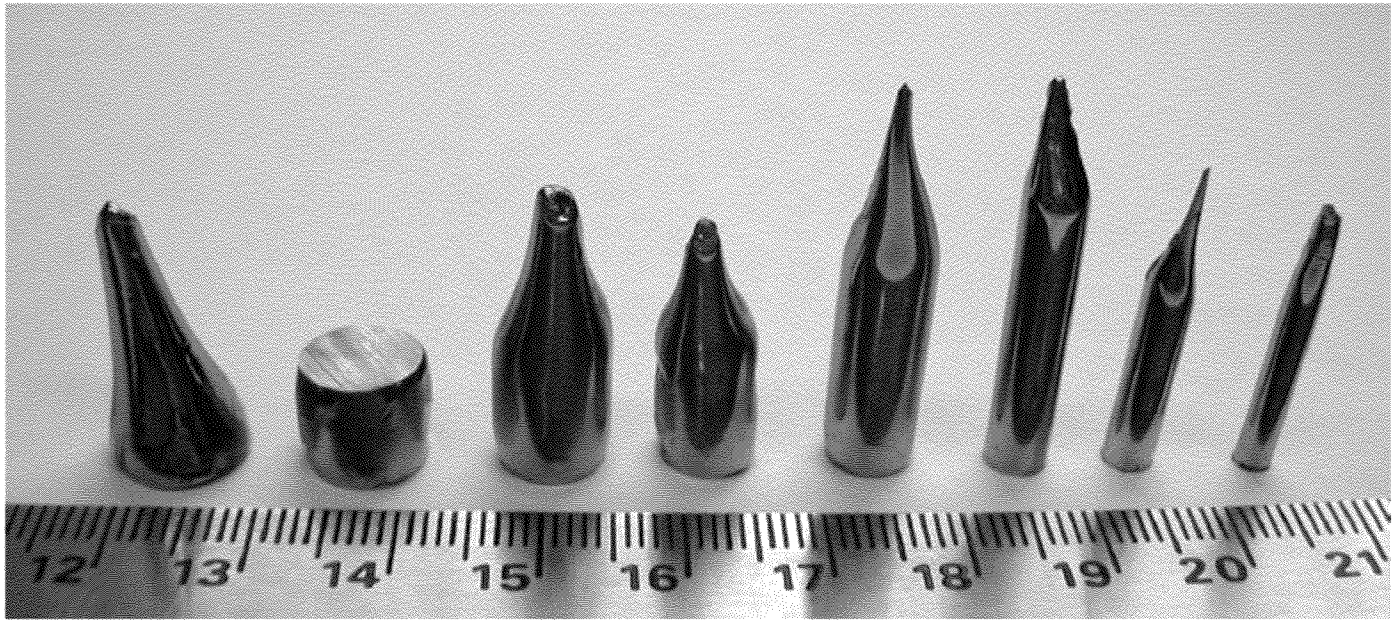
FIG. 56 provides images of fully amorphous rods made from exemplary amorphous alloys of the present disclosure with diameters ranging from 3 to 10 mm.

The glass-forming ability of each inventive alloy was assessed by determining the maximum rod diameter in which the amorphous phase can be formed when processed by the preferred method described above. X-ray diffraction with Cu—Kα radiation was performed to verify the amorphous structure of the inventive alloys. Images of fully amorphous rods made from exemplary amorphous alloys of the present disclosure with diameters ranging from 3 to 10 mm are provided in FIG. 56.

Figure 57:
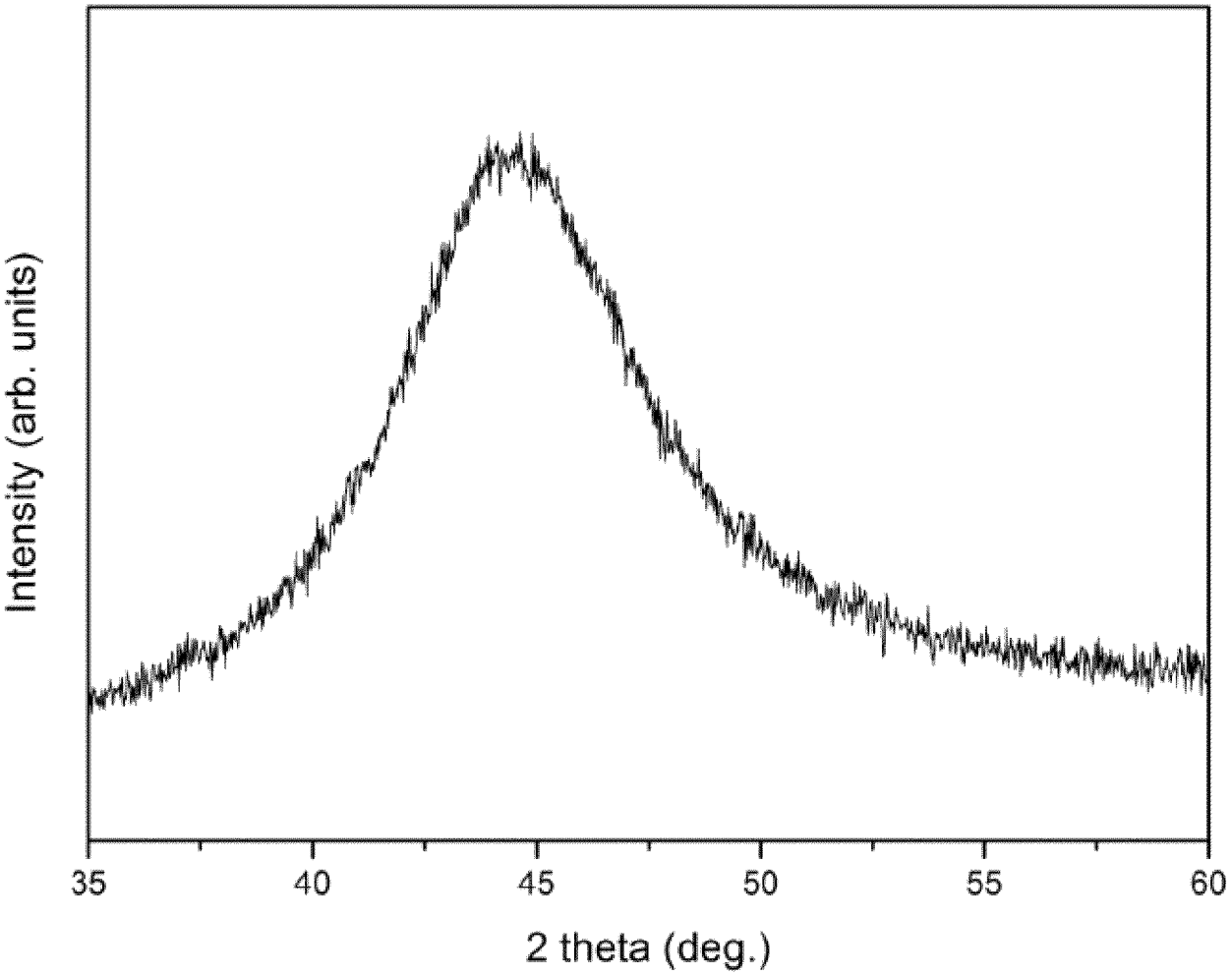
FIG. 57 provides an X-ray diffractogram with Cu—Kα radiation verifying the amorphous structure of a 10-mm rod of exemplary amorphous alloy $Ni_{68.6}Cr_{8.7}Nb_3P_{16}B_{3.2}Si_{0.5}$, produced by quenching the melt in a quartz tube with 1-mm thick wall.

Exemplary alloy $Ni_{68.6}Cr_{8.7}Nb_3P_{16}B_{3.2}Si_{0.5}$ was found to exhibit particularly high glass-forming ability. It was not only able to form 10 mm amorphous rods when quenched in a quartz tube with 0.5 mm thick wall, but can also form 10 mm amorphous rods when quenched in a quartz tube with 1 mm thick wall. This suggests that the critical rod diameter assessed by quenching in quartz tubes with 0.5 mm thick walls should be between 11 and 12 mm. An X-ray diffractogram with Cu—Kα radiation verifying the amorphous structure of a 10-mm rod of exemplary amorphous alloy $Ni_{68.6}Cr_{8.7}Nb_3P_{16}B_{3.2}Si_{0.5}$ produced by quenching in a quartz tube with 1 mm thick wall is shown in FIG. 57.

Example 3

Test Methodology for Differential Scanning Calorimetry

Differential scanning calorimetry at a scan rate of 20° C./min was performed to determine the glass-transition, crystallization, solidus, and liquidus temperatures of exemplary amorphous alloys.

Example 4

Test Methodology for Measuring Density and Elastic Constants

The shear and longitudinal wave speeds of exemplary amorphous alloys were measured ultrasonically on a cylindrical specimen 3 mm in diameter and about 3 mm in length using a pulse-echo overlap set-up with 25 MHz piezoelectric transducers. Densities were measured by the Archimedes method, as given in the American Society for Testing and Materials standard C693-93.

Example 5

Test Methodology for Measuring Compressive Yield Strength

Compression testing of exemplary amorphous alloys was performed on cylindrical specimens 3 mm in diameter and 6 mm in length by applying a monotonically increasing load at constant cross-head speed of 0.001 mm/s using a screw-driven testing frame. The strain was measured using a linear variable differential transformer. The compressive yield strength was estimated using the 0.2% proof stress criterion.

Example 6

Test Methodology for Measuring Notch Toughness

The notch toughness of exemplary amorphous alloys was performed on 3-mm diameter rods. The rods were notched using a wire saw with a root radius of between 0.10 and 0.13 μm to a depth of approximately half the rod diameter. The notched specimens were placed on a 3-point bending fixture with span distance of 12.7 mm and carefully aligned with the notched side facing downward. The critical fracture load was measured by applying a monotonically increasing load at constant cross-head speed of 0.001 mm/s using a screw-driven testing frame. At least three tests were performed, and the variance between tests is included in the notch toughness plots. The stress intensity factor for the geometrical configuration employed here was evaluated using the analysis by Murakimi (Y. Murakami, Stress Intensity Factors Handbook, Vol. 2, Oxford: Pergamon Press, p. 666 (1987)). The fracture surface morphology of the inventive alloys is investigated using scanning electron microscopy.

Example 7

Test Methodology for Measuring Bending Ductility

The ability of rods made of exemplary amorphous alloys to bend plastically around a fixed bent radius was evaluated. Rods of various diameters were bent plastically around 6.3 mm bend diameter. The rod diameter at which a permanent 30° bent angle could be achieved was deemed as the "critical bending diameter", $d_{cr}$. The "bending ductility" $\epsilon_p$, representing the plastic strain attainable in bending, was estimated by dividing $d_{cr}$ by 6.3 mm.

Example 8

Test Methodology for Measuring Hardness

Figure 58:
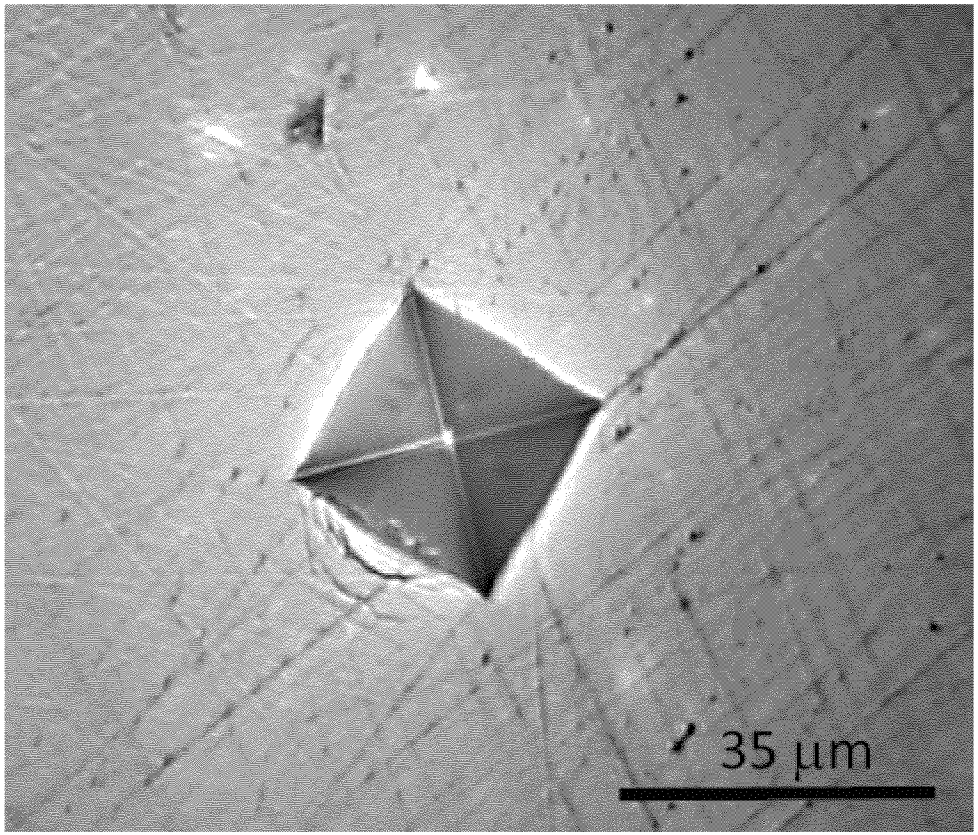
FIG. 58 provides a micrograph showing a Vickers micro-indentation on a disk of exemplary amorphous alloy $Ni_{68.6}Cr_{8.7}Nb_3P_{16}B_{3.2}Si_{0.5}$.

The hardness of exemplary amorphous alloy $Ni_{68.6}Cr_{8.7}Nb_3P_{16}B_{3.2}Si_{0.5}$ was measured using a Vickers microhardness tester. Six tests were performed where micro-indentions were inserted on the flat and polished cross section of a 3-mm rod using a load of 500 g and a duel time of 10 s. A micrograph showing a micro-indentation is presented in FIG. 58. Substantial plasticity (shear banding) and absence of cracking is evident in the vicinity of the indentation, thereby supporting the high toughness of the alloy.

Example 9

Test Methodology for Measuring Corrosion Resistance

The corrosion resistance of exemplary amorphous alloys was evaluated by immersion tests in hydrochloric acid (HCl), and was compared against highly corrosion-resistant stainless steels. A rod of inventive alloys $Ni_{69}Cr_{8.5}Nb_3P_{16.5}B_3$ with initial diameter of 2.91 mm and length of 18.90 mm, a rod of inventive alloys $Ni_{68.6}Cr_{8.7}Nb_3P_{16}B_{3.2}Si_{0.5}$ with initial diameter of 2.90 mm and length of 20.34 mm, a rod of stainless steel 304 (dual-certified Type 304/304L stainless steel, ASTM A276 and ASTM A479, 'cold rolled' or 'mill finish' (unpolished)) with initial diameter of 3.15 mm and length of 16.11 mm, and a rod of stainless steel 316 (Super-Corrosion-Resistant Stainless Steel (Type 316), ASTM A276 and ASTM A479, 'cold rolled' or 'mill finish' (unpolished)) with initial diameter of 3.15 mm and length of 17.03 mm were immersed in a bath of 6M HCl at room temperature. The stainless steel rods were immersed for about 475 hours, the inventive alloy $Ni_{69}Cr_{8.5}Nb_3P_{16.5}B_3$ rod was immersed for 2200 hours and $Ni_{68.6}Cr_{8.7}Nb_3P_{16}B_{3.2}Si_{0.5}$ for 373 hours. The corrosion depth at various stages during the immersion was estimated by measuring the mass change with an accuracy of ±0.01 mg. Corrosion rates were estimated assuming linear kinetics.

Example 10

Figure 59:
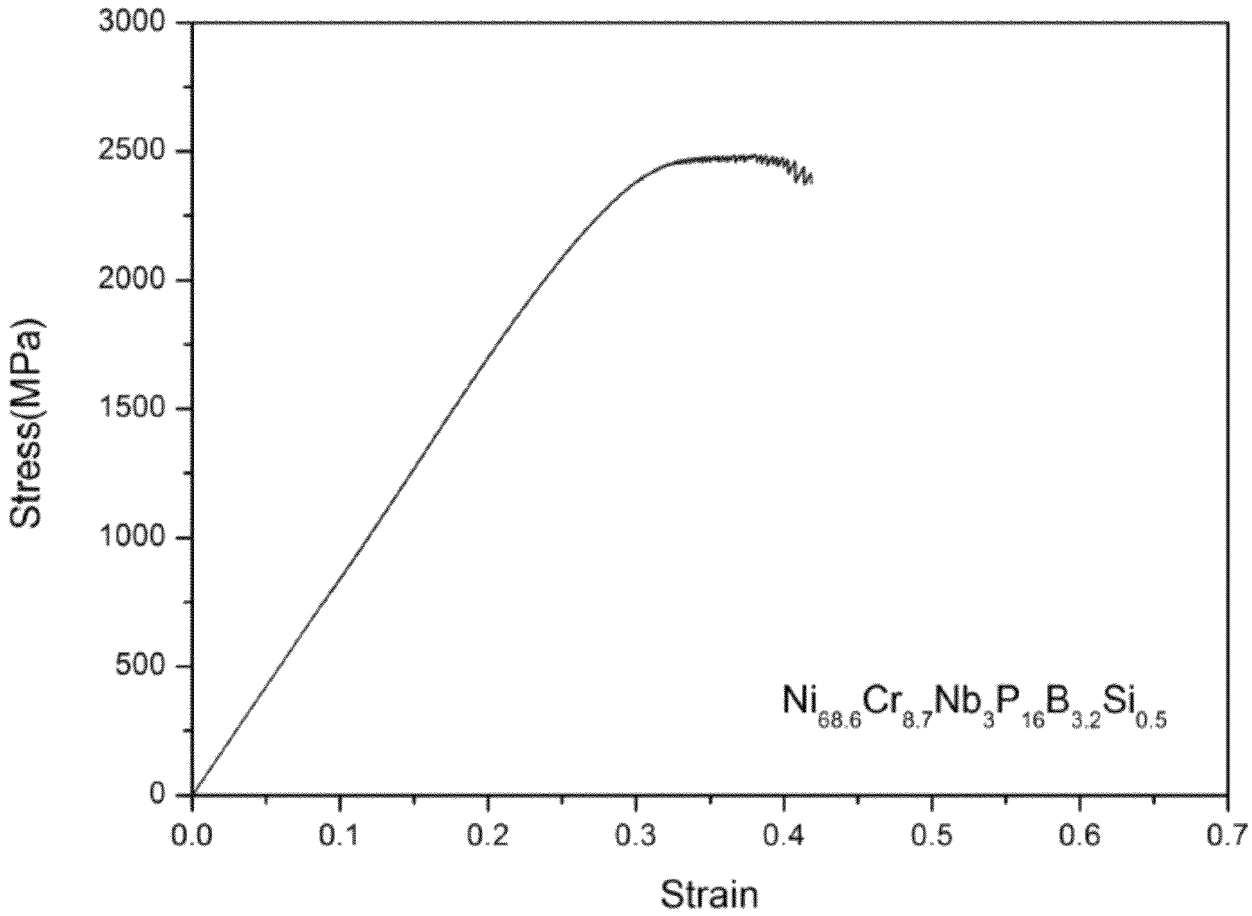
FIG. 59 provides a compressive stress-strain response of exemplary amorphous alloy $Ni_{68.6}Cr_{8.7}Nb_3P_{16}B_{3.2}Si_{0.5}$.

Engineering Data Base for Exemplary Amorphous Alloy $Ni_{68.6}Cr_{8.7}Nb_3P_{16}B_{3.2}Si_{0.5}$ A database listing thermophysical and mechanical properties for exemplary amorphous alloy $Ni_{68.6}Cr_{8.7}Nb_3P_{16}B_{3.2}Si_{0.5}$ (Example 42) has been generated. The differential calorimetry scan for this alloy is presented in FIG. 41, while the compressive stress-strain diagram is presented in FIG. 59.

TABLE 22

Thermophysical and Mechanical properties for exemplary amorphous alloy $Ni_{68.6}Cr_{8.7}Nb_3P_{16}B_{3.2}Si_{0.5}$.

| | |
|---|---|
| Composition | $Ni_{68.6}Cr_{8.7}Nb_3P_{16}B_{3.2}Si_{0.5}$ |
| Critical rod diameter | >11 mm |
| Glass-transition temperature | 405.3° C. |
| Crystallization temperature | 448.8° C. |
| Solidus temperature | 845.6° C. |
| Liquidus temperature | 884.4° C. |
| Density | 7.7639 g/cc |
| Yield strength | 2360 MPa |
| Hardness | 745.2 ± 18.0 HV |
| Notch toughness | 51.4 ± 8.4 MPa $m^{1/2}$ |
| Critical bending diameter | 0.75 mm |
| Bending ductility | 0.1190 |
| Shear modulus | 51.08 GPa |
| Bulk modulus | 184.21 GPa |
| Young's modulus | 140.35 GPa |
| Poisson's ratio | 0.37369 |
| Corrosion rate (6M HCl) | 2.6 μm/year |

Doctrine of Equivalents

Those skilled in the art will appreciate that the foregoing examples and descriptions of various preferred embodiments of the present disclosure are merely illustrative of the disclosure as a whole, and that variations in the steps and various components of the present disclosure may be made within the spirit and scope of the disclosure. For example, it will be clear to one skilled in the art that including minor additions or impurities to the compositions of the current disclosure would not impact the properties of those compositions, nor render them unsuitable for their intended purpose. Accordingly, the present disclosure is not limited to the specific embodiments described herein but, rather, is defined by the scope of the appended claims.

What is claimed is:

1. A metallic glass alloy comprising:

$$Ni_{(68.6-w-x-y-z)}Cr_{8.7+w}Nb_{3+x}P_{16.5+y}B_{3.2+z},$$

where w, x, y, and z are positive or negative atomic percentages that represent a deviation from the base composition having absolute values that satisfy:

$$0.21|w|+0.84|x|+0.96|y|+1.18|z|<1.89, \text{ and}$$

wherein the alloy has a critical rod diameter of at least 3 mm.

2. The metallic glass alloy of claim 1, where w, x, y, and z have absolute values that satisfy the condition:

$$0.21|w|+0.84|x|+0.96|y|+1.18|z|<1.05, \text{ and}$$

wherein the alloy has a critical rod diameter of at least 5 mm.

3. The metallic glass alloy of claim 1, where w, x, y, and z have absolute values that satisfy the condition:

$$0.21|w|+0.84|x|+0.96|y|+1.18|z|<0.43, \text{ and}$$

wherein the alloy has a critical rod diameter of at least 8 mm.

4. A metallic glass alloy comprising:

$$Ni_{(100-a-b-c-d)}Cr_aNb_bP_cB_d$$

where a, b, c, and d represent atomic percentages, and where:

a is greater than 2.5 and less than 15, b is greater than 1.5 and less than 4.5, c is greater than 14.5 and less than 18.5, and d is greater than 1.5 and less than 4.5; and wherein the alloy has a critical rod diameter of at least 4 mm.

5. The metallic alloy of claim 4, wherein a is greater than 6 and less than 10.5, b is greater than 2.6 and less than 3.2, c is greater than 16 and less than 17, d is greater than 2.7 and less than 3.7, and the alloy has a critical rod diameter of at least 8 mm.

6. The metallic alloy of claim 4, wherein a is between 3 and 7, and the stress intensity at crack initiation $K_Q$, when measured on a 3 mm diameter rod containing a notch with length between 1 and 2 mm and root radius between 0.1 and 0.15 mm, is at least 60 MPa $m^{1/2}$.

7. The metallic alloy of claim 4, wherein b is between 1.5 and 3, and the stress intensity at crack initiation $K_Q$, when measured on a 3 mm diameter rod containing a notch with length between 1 and 2 mm and root radius between 0.1 and 0.15 mm, is at least 60 MPa $m^{1/2}$.

8. The metallic alloy of claim 4, wherein a is between 3 and 7, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

9. The metallic alloy of claim 4, wherein b is between 1.5 and 3, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

10. The metallic alloy of claim 4, wherein a is between 3 and 7, and a wire made of such glass having a diameter of 1 mm undergoes macroscopic plastic bending under load without fracturing catastrophically.

11. The metallic alloy of claim 4, wherein b is between 1.5 and 3, and a wire made of such glass having a diameter of 1 mm undergoes macroscopic plastic bending under load without fracturing catastrophically.

12. The metallic alloy of claim 4, wherein b is between 2.5 and 3.5, and the alloy has a critical rod diameter of at least 5 mm.

13. The metallic alloy of claim 4, wherein d is greater than 2 and less than 4, and the alloy has a critical rod diameter of at least 5 mm.

14. The metallic alloy of claim 4, wherein c+d is between 18.5 and 20.5, and the alloy has a critical rod diameter of at least 5 mm.

15. The metallic glass alloy of claim 4, wherein up to 1.5 atomic % of Nb is substituted by a materials selected from the group consisting of Ta, V, or combinations thereof.

16. The metallic glass alloy of claim 4, wherein up to 2 atomic % of Cr is substituted by Fe, Co, Mn, W, Mo, Ru, Re, Cu, Pd, Pt, Ti, Zr, Hf, or combinations thereof.

17. The metallic glass alloy of claim 4, wherein up to 2 atomic % of Ni is substituted by Fe, Co, Mn, W, Mo, Ru, Re, Cu, Pd, Pt, Ti, Zr, Hf, or combinations thereof.

18. The metallic glass alloy of claim 4, wherein a rod formed of the materials having a diameter of at least 0.5 mm undergoes macroscopic plastic bending under load without fracturing catastrophically.

19. The metallic glass alloy of claim 4, wherein the compressive yield strength, $\sigma_y$, obtained using the 0.2% proof stress criterion is greater than 2000 MPa.

20. The metallic glass alloy of claim 4, wherein the temperature of the alloy is raised to 1100° C. or higher prior to quenching below the glass transition to form a glass.

21. The metallic glass alloy of claim 4, wherein the Poisson's ratio is at least 0.35.

22. The metallic glass alloy of claim 4, wherein the corrosion rate in 6M HCl is not more than 0.01 mm/year.

23. A metallic glass alloy comprising:

$$Ni_{(100-a-b-c-d-e)}Cr_aNb_bP_cB_dSi_e$$

where a, b, c, d, and e are atomic percentages, and wherein:

a is between 4 and 14, b is between 1.8 and 4.3, c is between 13.5 and 17.5, d is between 2.3 and 3.9, and e is up to 2; and wherein the alloy has a critical rod diameter of at least 3 mm.

24. The metallic glass alloy of claim 23, wherein a is greater than 7 and less than 10, and the stress intensity at crack initiation when measured on a 3 mm diameter rod containing a notch with length between 1 and 2 mm and root radius between 0.1 and 0.15 mm is at least 60 MPa $m^{1/2}$.

25. The metallic glass alloy of claim 23, wherein b is greater than 1.5 and less than 3, and the stress intensity at crack initiation when measured on a 3 mm diameter rod containing a notch with length between 1 and 2 mm and root radius between 0.1 and 0.15 mm is at least 60 MPa $m^{1/2}$.

26. The metallic glass alloy of claim 23, wherein a is greater than 7 and less than 10, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

27. The metallic glass alloy of claim 23, wherein b is greater than 1.5 and less than 3, and the plastic zone radius $r_p$, defined as $(1/\pi)(K_Q/\sigma_y)^2$, where $K_Q$ is the stress intensity at crack initiation measured on a 3 mm diameter rod containing a notch with length between 1 and 2 mm and root radius between 0.1 and 0.15 mm, and where $\sigma_y$ is the compressive yield strength obtained using the 0.2% proof stress criterion, is greater than 0.2 mm.

28. The metallic glass alloy of claim 23, wherein a is greater than 7 and less than 10, and a wire made of such glass having a diameter of 1 mm undergoes macroscopic plastic bending under load without fracturing catastrophically.

29. The metallic glass alloy of claim 23, wherein b is greater than 1.5 and less than 3, and a wire made of such glass having a diameter of 1 undergoes macroscopic plastic bending under load without fracturing catastrophically.

30. The metallic glass alloy of claim 23, wherein b is between 2.5 and 3.5, and the alloy has a critical rod diameter of at least 4 mm.

31. The metallic glass alloy of claim 23, wherein d is between 2.9 and 3.5, and the alloy has a critical rod diameter of at least 4 mm.

32. The metallic glass alloy of claim 23, wherein e is up to 1.5, and the alloy has a critical rod diameter of at least 4 mm.

33. The metallic glass alloy of claim 23, wherein c+d+e is between 18.5 and 20.5, and the alloy has a critical rod diameter of at least 4 mm.

34. The metallic glass alloy of claim 23, wherein up to 1.5 atomic % of Nb is substituted by a materials selected from the group consisting of Ta, V, or combinations thereof.

35. The metallic glass alloy of claim 23, wherein up to 2 atomic % of Cr is substituted by Fe, Co, Mn, W, Mo, Ru, Re, Cu, Pd, Pt, Ti, Zr, Hf, or combinations thereof.

36. The metallic glass alloy of claim 23, wherein up to 2 atomic % of Ni is substituted by Fe, Co, Mn, W, Mo, Ru, Re, Cu, Pd, Pt, Ti, Zr, Hf, or combinations thereof.

37. The metallic glass alloy of claim 23, wherein a rod formed of the materials having a diameter of at least 0.5 mm undergoes macroscopic plastic bending under load without fracturing catastrophically.

38. The metallic glass alloy of claim 23, wherein the compressive yield strength, $\sigma_y$, obtained using the 0.2% proof stress criterion is greater than 2000 MPa.

39. The metallic glass alloy of claim 23, wherein the temperature of the alloy is raised to 1100° C. or higher prior to quenching below the glass transition to form a glass.

40. The metallic glass alloy of claim 23, wherein the Poisson's ratio is at least 0.35.

41. The metallic glass alloy of claim 23, wherein the corrosion rate in 6M HCl is not more than 0.01 mm/year.

42. A metallic glass alloy selected from the group consisting of: $Ni_{69}Cr_{8.5}Nb_3P_{17}B_{2.5}$, $Ni_{69}Cr_{8.5}Nb_3P_{16.75}B_{2.75}$, $Ni_{69}Cr_{8.5}Nb_3P_{16.5}B_3$, $Ni_{69}Cr_{8.5}Nb_3P_{16}B_{3.5}$, $Ni_{69}Cr_{8.5}Nb_3P_{15.75}B_{3.75}$, $Ni_{69}Cr_9Nb_{2.5}P_{16.5}B_3$, $Ni_{69}Cr_{8.75}Nb_{2.75}P_{16.5}B_3$, $Ni_{69}Cr_{8.25}Nb_{3.25}P_{16.5}B_3$, $Ni_{69}Cr_8Nb_{3.5}P_{16.5}B_3$, $Ni_{69}Cr_{7.5}Nb_4P_{16.5}B_3$, $Ni_{72.5}Cr_5Nb_3P_{16.5}B_3$, $Ni_{71.5}Cr_6Nb_3P_{16.5}B_3$, $Ni_{70.5}Cr_7Nb_3P_{16.5}B_3$, $Ni_{69.5}Cr_8Nb_3P_{16.5}B_3$, $Ni_{68.5}Cr_9Nb_3P_{16.5}B_3$, $Ni_{68}Cr_{9.5}Nb_3P_{16.5}B_3$, $Ni_{67.5}Cr_{10}Nb_3P_{16.5}B_3$, $Ni_{66.5}Cr_{11}Nb_3P_{16.5}B_3$, $Ni_{65.5}Cr_{12}Nb_3P_{16.5}B_3$, $Ni_{68.5}Cr_9Nb_3P_{16}B_3Si_{0.5}$, $Ni_{68.5}Cr_9Nb_3P_{15.5}B_3Si_1$, $Ni_{69}Cr_{8.5}Nb_3P_{16}B_3Si_{0.5}$, $Ni_{69}Cr_{8.5}Nb_3P_{15.5}B_3Si_1$, $Ni_{69.03}Cr_{8.75}Nb_{3.02}P_{16.08}B_{3.12}$, $Ni_{68.17}Cr_{8.65}Nb_{2.98}P_{16.92}B_{3.28}$, $Ni_{67.75}Cr_{8.59}Nb_{2.96}P_{17.34}B_{3.36}$, $Ni_{69}Cr_{8.5}Nb_{2.5}Ta_{0.5}P_{15.5}B_3Si_1$, and $Ni_{69.5}Cr_{8.5}Nb_{2.5}Ta_{0.5}P_{15.5}B_3Si_1$; wherein the alloy has a critical rod diameter of at least 3 mm.

43. A metallic glass alloy comprising: $Ni_{68.6}Cr_{8.7}Nb_3P_{16.5}B_{3.2}$; wherein the alloy has a critical rod diameter of at least 3 mm.

44. A metallic glass alloy comprising: $Ni_{68.6}Cr_{8.7}Nb_3P_{16}Si_{0.5}B_{3.2}$; wherein the alloy has a critical rod diameter of at least 3 mm.

* * * * *

UNITED STATES PATENT AND TRADEMARK OFFICE

CERTIFICATE OF CORRECTION

PATENT NO. : 9,085,814 B2
APPLICATION NO. : 13/592095
DATED : July 21, 2015
INVENTOR(S) : Na et al.

It is certified that error appears in the above-identified patent and that said Letters Patent is hereby corrected as shown below:

In the claims

| Column | Line | | Should Be |
|---|---|---|---|
| 35 | 10 | "having a diameter of 1 undergoes macroscopic plastic bend-" | -- having a diameter of 1 mm undergoes macroscopic plastic bend- -- |
| 36 | 23 | "$Ni_{69}Cr_{8.5}Nb_3P_{15.5}B_3Si_1$, $Ni_{69.03}Cr_{8.75}Nb_{3.02}P_{16.08}B_{3.12}$," | -- $Ni_{69}Cr_{8.5}Nb_3P_{15.5}B_3Si_1$, $Ni_{69.45}Cr_{8.81}Nb_{3.04}P_{15.66}B_{3.04}$, $Ni_{69.03}Cr_{8.75}Nb_{3.02}P_{16.08}B_{3.12}$, -- |

Signed and Sealed this
First Day of December, 2015

Michelle K. Lee

Michelle K. Lee
*Director of the United States Patent and Trademark Office*